US006004211A

United States Patent [19]

Brenner et al.

[11] Patent Number: 6,004,211

[45] Date of Patent: Dec. 21, 1999

[54] INTERACTIVE WAGERING SYSTEMS AND PROCESSES

[75] Inventors: Mark A. Brenner, Tulsa; Everett L. Devore, Broken Arrow; Ronald E. Dewell, Tulsa; Andrew T. Lucas, Broken Arrow; Richard E. McNutt, Glenpool; Mitch L. Neilsen, Stillwater; Brent E. Perry, Tulsa; W. Scott Reneau, Tulsa; Kannan Srikanth, Tulsa; Jon C. Zaring, Tulsa, all of Okla.

[73] Assignee: O.D.S. Technologies, L.P., Broomfield, Colo.

[21] Appl. No.: 09/138,953

[22] Filed: Aug. 24, 1998

Related U.S. Application Data

[63] Continuation of application No. 08/526,007, Sep. 8, 1995, Pat. No. 5,830,068.

[51] Int. Cl.[6] ..... A63F 9/22

[52] U.S. Cl. ..... 463/40; 463/25; 700/93

[58] Field of Search ..... 463/42, 41, 40, 463/28, 25, 16, 6, 1; 364/412.1, 411.1, 410.1; 700/91, 92, 93

[56] References Cited

U.S. PATENT DOCUMENTS

| | | | |
|---|---|---|---|
| 3,697,698 | 10/1972 | Oswald et al. . | |
| 3,810,627 | 5/1974 | Levy | 273/138 A |
| 3,909,002 | 9/1975 | Levy | 273/138 A |
| 4,339,798 | 7/1982 | Hedges et al. | 364/412 |
| 4,467,424 | 8/1984 | Hedges et al. | 364/412 |
| 4,592,546 | 6/1986 | Fascenda et al. | 273/1 E |
| 4,652,998 | 3/1987 | Koza et al. | 364/412 |
| 4,669,730 | 6/1987 | Small | 273/138 A |
| 4,694,490 | 9/1987 | Harvey et al. | 380/20 |
| 4,704,725 | 11/1987 | Harvey et al. | 380/9 |
| 4,706,121 | 11/1987 | Young | 358/142 |
| 4,745,468 | 5/1988 | Von Kohorn | 358/84 |
| 4,760,527 | 7/1988 | Sidley | 364/412 |
| 4,799,683 | 1/1989 | Bruner, Jr. | 273/138 A |

(List continued on next page.)

FOREIGN PATENT DOCUMENTS

| | | | |
|---|---|---|---|
| 0 450 520 A2 | 10/1991 | European Pat. Off. | A63F 3/06 |
| 0 620 688 A2 | 10/1994 | European Pat. Off. | H04N 7/14 |
| 0 624 039 A2 | 11/1994 | European Pat. Off. | H04N 7/173 |
| 2 229 565 | 9/1990 | United Kingdom | A63F 9/00 |
| 2300535 | 11/1996 | United Kingdom . | |
| WO 81/01664 | 6/1981 | WIPO | A63B 71/06 |
| WO 95/01058 | 1/1995 | WIPO | H04N 7/16 |

OTHER PUBLICATIONS

"And We're Off To The Races!" John Burgess, The Washington Post, Jan. 16, 1995.

"The Home Betting Channel," Vinnie Perrone, The Washington Post, Dec. 15, 1994.

"Interactive Wagering A Good Bet," Maury Wolff, Daily Racing Form, Jan. 29, 1995.

"New On TV: You Bet Your Horse," Ross Peddicord, The Sun, Baltimore, Maryland, Dec. 15, 1994.

"Home Wagering Is On The Way," Michael Hiestand, USA Today, Dec. 7, 1994.

(List continued on next page.)

*Primary Examiner*—Michael O'Neill
*Attorney, Agent, or Firm*—Fish & Neave; G. Victor Treyz

[57] ABSTRACT

Systems and processes for interactive off-track wagering are provided. A user reviews racing information and places bets using an off-track terminal. The user interactively selects a desired racetrack and race. Odds, pools, and payoff amounts may be viewed for a variety of complex wager types. To place a wager, the user selects a wager type, wager amount, and the desired runners. Account information can be reviewed. If desired, the user can transfer funds from a bank account to in account used for wagering. Racing videos can be viewed while the user reviews odds and places bets. Video clips of past races can be ordered. Related advertisements can be presented using text or video clips. Merchandise may be ordered interactively. Information regarding system usage may be gathered.

59 Claims, 50 Drawing Sheets

U.S. PATENT DOCUMENTS

| | | | | |
|---|---|---|---|---|
| | 4,815,741 | 3/1989 | Small | 273/138 A |
| | 4,876,592 | 10/1989 | Von Kohorn | 358/84 |
| | 4,882,473 | 11/1989 | Bergeron et al. | 235/380 |
| | 4,926,255 | 5/1990 | Von Kohorn | 358/84 |
| | 4,965,825 | 10/1990 | Harvey et al. | 380/9 |
| | 5,034,807 | 7/1991 | Von Kohorn | 358/84 |
| | 5,038,022 | 8/1991 | Lucero | 235/380 |
| | 5,057,915 | 10/1991 | Von Kohorn | 358/84 |
| | 5,073,931 | 12/1991 | Audebert et al. | 380/23 |
| | 5,083,271 | 1/1992 | Thacher et al. | 364/411 |
| | 5,083,800 | 1/1992 | Lockton | 273/439 |
| | 5,109,414 | 4/1992 | Harvey et al. | 380/9 |
| | 5,128,752 | 7/1992 | Von Kohorn | 358/84 |
| | 5,227,874 | 7/1993 | Von Kohorn | 358/84 |
| | 5,233,654 | 8/1993 | Harvey et al. | 380/20 |
| | 5,249,044 | 9/1993 | Von Kohorn | 358/86 |
| | 5,259,613 | 11/1993 | Marnell, II | 273/138 A |
| | 5,283,734 | 2/1994 | Van Kohorn | 364/412 |
| | 5,340,119 | 8/1994 | Goldfarb | 273/439 |
| | 5,408,417 | 4/1995 | Wilder . | |
| | 5,411,258 | 5/1995 | Wilson et al. | 273/86 B |
| | 5,415,416 | 5/1995 | Scagnelli et al. | 273/439 |
| | 5,462,275 | 10/1995 | Lowe et al. . | |
| | 5,564,977 | 10/1996 | Algie | 463/42 |
| | 5,647,795 | 7/1997 | Stanton . | |
| B1 | 4,745,468 | 6/1991 | Von Kohorn . | |

OTHER PUBLICATIONS

"Telegambling Is Odds On Bet To Make An Impact," Gary Arlen, Multichannel News, Nov. 7, 1994.

"ODS Bets On Horse Racing," Mitch Mauer, Tulsa World, Oct. 23, 1994.

"Patents," Sabra Chartrand, The New York Times, Feb. 28, 1994.

"An Open–Systems Approach To Video On Demand," Yee–Hsiang Chang et al., IEEE Communications Magazine, May, 1994.

"A Scenario For The Deployment Of Interactive Multimedia Cable Television Systems In The United States In The 1990's," Matthew D. Miller, Proceedings of the IEEE, vol. 82, No. 4, Apr., 1994, pp. 585–589.

"Are Coin–Op Slot Machines Going The Way Of The Dinosaur?," Matt Connor, Gaming Business, vol. 15, No. 4, Apr. 5, 1994, pp. 1, 56, and 58.

TrackMaster User's Guide Version 2.0.7, Apr., 1994, AXCIS Pocket Information Network, Inc., Santa Clara, California.

Video Technology News, Feb. 14, 1994, pp. 7 and 8.

"Big League Electronics," Playboy (undated).

Tiny Tim Brochure, AutoTote Systems Inc., Newark, Delaware (undated).

BetMate Brochure, AmTote, Hunt Valley, Maryland (undated).

Probe XL Brochure, AutoTote Systems, Inc., Newark, Delaware (undated).

220
222
PIM - 3
225
7:56
19 MIN.
TO POST.
$ SELECT AMOUNT $
1
2
3
4
5
10
15
20
25
50
75
100
150
224
226
DONE
GO BACK
228
218
ODDS
1 20
2 8
3 9 - 2
4 7 - 2
5 8
6 3
7 6
8 10
9 8
216

232

PIM

RCE 3

ODS

5/ 16 /95

1:50

| HRS | ODDS | WIN | PLACE | SHOW |
|---|---|---|---|---|
| 1 | 20/1 | 70 | 19 | 21 |
| 2 | 8/1 | 91 | 24 | 12 |
| 3 | 9/2 | 126 | 43 | 31 |
| 4 | 7/2 | 128 | 17 | 8 |
| 5 | 8/1 | 97 | 51 | 32 |
| 6 | 3/1 | 340 | 110 | 117 |
| 7 | 6/1 | 176 | 61 | 20 |
| 8 | 10/1 | 19 | 11 | 5 |
| TOTALS (ALL) | | 1102 | 350 | 255 |

268

FIG. 18

FIG. 19

272

| ODDS | 1 AND | AND 1 |
|---|---|---|
| 1 20 | - - | - - |
| 2 8 | 150 | 159 |
| 3 9-2 | 212 | 222 |
| 4 7-2 | 464 | 365 |
| 5 8 | 425 | 255 |
| 6 3 | 511 | 189 |
| 7 6 | 269 | 111 |
| 8 10 | 511 | 567 |
| 9 8 | 1277 | 1022 |

PIM - 3

1:50

19 MIN.
TO POST

EXACTA PAYS

274

POOL: $ 17,000

(USE UP/DOWN KEYS
FOR NEXT HORSE)

280 282 284 286 288 292 294 296 290 298

| RACE 1 | 5.0D | CL $17.5K | CR68 | $14.6 | AGE 2 |
|---|---|---|---|---|---|
| P # HORSE NAME | DAYS OFF | W/ST D·SP | MORN. ODDS | POWER RATING | |
| 1. BIG FUZZY | 2 | 0/3 | 3/1 | 61.7 | |
| 2. TRAE | 13 | 0/2 | 6/1 | 55.5 | |
| 3. DIAMOND RIO | | 0/2 | 10/1 | 0.0 | |
| 4. BUBBA FORBES | | 0/2 | 12/1 | 0.0 | |
| 5. DESIARD | 13 | 0/1 | 6/1 | 56.5 | |
| 6. BYOU BUM | 13 | 0/2 | 8/1 | 56.6 | |
| 7. RUN IN THE FAST LANE | 2 | 0/1 | 12/1 | 51.2 | |
| 8. SURF'S UP DUDE | 13 | 0/1 | 7/2 | 57.7 | |
| 9. RAJA'S BEST SWIN | 13 | 0/2 | 10/1 | 55.7 | |
| USE UP/DOWN KEYS FOR MORE INFO | | | | | |

278

FIG. 20

304 308 310 312 314

| RACE 1 5.0D | CL $17.5K | CR68 | $14.6 | AGE 2 |
|---|---|---|---|---|
| P# HORSE NAME | SR | SR D/S | SR HI | CR | CR LAST |
| 1. BIG FUZZY | 0 | 66 | 67 | 68 | 67 |
| 2. TRACE | 177 | 61 | 61 | 69 | 68 |
| 3. DIAMOND RIO | 184 | 0 | 0 | 0 | 0 |
| 4. BUBBA FORBES | 191 | 0 | 0 | 0 | 0 |
| 5. DESIARD | 198 | 62 | 62 | 68 | 68 |
| 6. BYOU BUM | 205 | 61 | 62 | 69 | 68 |
| 7. RUN IN THE FAST LANE | 212 | 58 | 58 | 67 | 67 |
| 8. SURF'S UP DUDE | 219 | 54 | 54 | 68 | 68 |
| 9. ROJA'S BEST SWIN | 226 | 58 | 62 | 69 | 68 |
| USE UP/DOWN ARROW KEYS FOR MORE INFO | | | | | |

306 316

302

FIG. 21

RACE 1 5.0D CL$17.5K CR68 $14.6K AGE 2

| P# HORSE NAME | PACE ALL EARLY | MID | FIN | #R |
|---|---|---|---|---|
| 1. BIG FUZZY | 3.3 | 3.8 | 3.0 | 10 |
| 2. TRACE | 3.4 | 3.7 | 3.0 | 10 |
| 3. DIAMOND RIO | ⋮ | ⋮ | ⋮ | ⋮ |
| 4. ⋮ | ↑ | ↑ | ↑ | ↑ |
| 5. ⋮ | | | | |
| 6. | 322 | 324 | 326 | 328 |
| 7. | | | | |
| 8. | | | | |
| 9. | | | | |

USE UP/DOWN KEYS FOR MORE INFO

320

FIG. 22

RACE 1 5.0D CL $17.5K CR68 $14.6K AGE 2

| P# | JOCKEY/TRAINER | WINS | 1 | 2 | 3 |
|---|---|---|---|---|---|
| 1. | HERBERT, JR / BISANO | 2 | 2 | 4 | 2 |
| 2. | | | | | |
| 3. | | | | | |
| 4. | | | | | |
| 5. | | | | | |
| 6. | | | | | |
| 7. | | | | | |
| 8. | | | | | |
| 9. | | | | | |

334

336

USE UP/DOWN KEYS FOR MORE INFO

332

FIG 23

WTOP 1500AM - RACE DAYS AT 11:15AM
SUNDAYS AT 11:30AM

WBAL 1090AM - RACE DAYS AT 10:05AM

WTOP 1500AM - SCRATCHES WITH CLEM FLORIO
RACE DAYS AT 10:20AM, SUNDAYS AT 10:00AM

WWLG 1360AM - RACE RESULTS WITH CLEM
FLORIO. RACE DAYS AT 2:10, 3:45.

5 / 16 /95
1:50

IF YOU BET TO WIN, YOU COLLECT IF YOUR HORSE FINISHES FIRST. IF YOU BET TO PLACE, YOU WIN IF YOUR HORSE FINISHES FIRST OR SECOND. IF YOU BET TO SHOW, YOU COLLECT IF YOUR HORSE FINISHES FIRST, SECOND, OR THIRD. YOU WILL USUALLY COLLECT MORE ON A SUCCESSFUL WIN BET THAN A SUCCESSFUL SHOW BET.

484

518

538

| RUNNER NO. | ODDS | ODDS PERCENTAGE |
|---|---|---|
| 1 | 20 | 5.0 % |
| 2 | 8 | 12.5 % |
| 3 | 9/2 | 22.2 % |
| 4 | 7/2 | 28.6 % |
| 5 | 9/5 | 55.6 % |
| 6 | 3 | 33.3 % |
| 7 | 6 | 16.7 % |
| 8 | 5 | 20.0 % |
| 9 | 10 | 10.0 % |

FIG. 45

INTERACTIVE WAGERING SYSTEMS AND PROCESSES

This is a continuation of application Ser. No. 08/526,007, filed Sep. 8, 1995, now U.S. Pat. No. 5,830,068.

BACKGROUND OF THE INVENTION

This invention relates to interactive wagering systems and particularly to interactive wagering systems for racetrack wagering. More particularly, this invention relates to off-track interactive wagering systems having user terminals for receiving racing videos and racing information via a medium other than conventional telephone lines and for displaying this information on a television monitor.

Wagering on sporting events such as horse, dog, and harness racing is a popular leisure activity. However, it is sometimes inconvenient to attend racing events in person. Not all racing fans have sufficient time to visit racetracks as often as they would like and some fans have difficulties in obtaining suitable transportation to the track. Thus, there is a need for wagering services for fans who cannot attend racing events in person.

Off-track betting establishments, which are generally more readily accessible than racetracks, have attempted to fill this need. However, a racing fan who desires to place a wager still faces the prospect of traveling to the off-track betting establishment.

Wagering via telephone is another option. A user of a telephone-based system typically sets up a telephone account against which wagers may be made. In order to place wagers, the user must interact with a computerized telephone ordering system by pressing appropriate buttons on a touch-tone telephone. This type of system is mainly used for placing wagers. Detailed racing information is typically obtained from other sources, such as printed racing programs.

Another approach for off-track wagering involves the use of dedicated devices that permit twoway serial modem communications with wagering equipment at a racetrack. These devices receive limited wagering information from the racetrack via telephone lines and provide it to a user on a liquid crystal display (LCD) screen. The user places a wager by making entries into the device which are then transmitted to the racetrack using the modem. Typical of this category of off-track wagering device are the Tiny TIM terminal of Autotote Systems, Inc., Newark, Del. and the terminal sold under the trademark "BetMate" of AmTote, Hunt Valley, Md.

Although it is possible to use terminals such as these in the home, doing so would monopolize the users' telephone line at certain times. And because the only data link with the racetrack using terminals such as the Tiny TIM or BetMate terminals is via telephone, it is not possible to receive racing videos with such terminals. In addition, the LCDs in these terminals make it difficult to display racing information in a way that may be easily viewed by the user. Because the Tiny TIM and BetMate terminals cannot be used with a television monitor, it is not possible for a user of such a terminal to display racing information on his home television set. Further, systems capable of interacting with off-track wagering terminals that use telephone lines to receive wagering information must provide a large number of simultaneous telephone connections to service each of the of the terminals. Because there is typically an extended connect time associated with each user, such systems are often unwieldy.

In addition, the racing information available through known off-track betting terminals is limited to a subset of the racing information provided by the racetracks. For example, presently available terminals may allow a user to view "twin" odds (the amount wagered on a runner to win versus the amount wagered on competing runners to win). However, such terminals do not allow the user to view odds, pools, or predicted payoffs for wagers such as show, place, or more advanced wager types, such as exactas, trifectas, daily doubles, pick threes, pick fours etc.

Further, with presently known terminals, the user cannot receive or display any additional information, such as handicapping information, weather conditions, or information regarding which races at a particular track are available as video transmissions on a given day.

It would therefore be desirable to provide interactive wagering systems and processes that provide racing data to off-track wagering terminals via a medium other than conventional telephone lines.

It would also be desirable to provide interactive wagering systems and processes that provide racing data to off-track wagering terminals that display the racing data on a home television monitor.

It would also be desirable to provide wagering systems and processes that provide racing data and racing videos to off-track wagering terminals on which the racing data and racing videos are displayed.

It would also be desirable to be able to provide wagering systems and processes that provide an improved level of racing data to off-track wagering terminals.

SUMMARY OF THE INVENTION

It is therefore an object of this invention to provide interactive wagering systems and related processes for off-track wagering in which a user terminal receives racing data and video signals, displays the racing data on a monitor, and transmits wagers to a wagering facility.

It is also an object of the invention to provide interactive wagering systems and related processes for off-track wagering in which a user terminal receives racing data from a cable headend or other transmission facility.

It is also an object of the invention to provide interactive wagering systems and related processes for off-track wagering in which a user terminal receives racing data within the bandwidth of a television channel.

It is also an object of the invention to provide interactive wagering systems and related processes for off-track wagering in which a user terminal provides a user with menu options allowing selection of a racetrack, a set of races within a racetrack (e.g., a morning or afternoon "performance"), a race, a wager type, wager amount, and runners.

It is also an object of the invention to provide interactive wagering systems and related processes for off-track wagering in which a user terminal provides racing odds, pools, predicted and actual payoffs, and handicapping information.

It is also an object of the invention to provide interactive wagering systems and related processes for off-track wagering in which a user terminal provides odds for wager types other than win odds, such as the odds for shows, places, exactas, trifectas, daily doubles, etc.

It is also an object of this invention to provide interactive wagering systems and related processes for off-track wagering in which a user terminal receives racing data from a racing data interface and racing videos from a source of racing videos and simultaneously displays the racing data and video signals on a monitor.

It is also an object of the invention to provide interactive wagering systems and related processes for off-track wagering in which a user terminal presents a racing simulcast schedule on a monitor.

It is also an object of the invention to provide interactive wagering systems and related processes for off-track wagering in which a user terminal allows a user to calculate a personal power rating based on the selection by the user of personal power rating "weights" for various handicapping categories. The user terminal calculates and displays a corresponding set of personal power ratings for a number of runners.

It is also an object of the invention to provide interactive wagering systems and related processes for off-track wagering in which a user terminal displays race results in the form of prerecorded race videos supplied to a user on demand.

It is also an object of the invention to provide interactive wagering systems and related processes for off-track wagering in which a user terminal alerts a user that a race is about to be run by triggering an alarm.

It is also an object of the invention to provide interactive wagering systems and related processes for off-track wagering in which a user terminal sets a video recorder to record one or more preselected races.

It is also an object of the invention to provide interactive wagering systems and related processes for off-track wagering in which a user terminal transmits transfer instructions that initiate a transfer of funds from a bank account at a bank facility to a wagering account at a wagering facility or allows the user to draw directly from his bank account when placing wagers.

The present invention involves off-track wagering systems and related processes. Racing data such as the names and post positions of the runners that are in various races and the current odds and payoffs for those races are provided by a wagering facility (typically based on a system known as a "totalisator" located at a racetrack). Supplemental racing data such as the weather conditions at various racetracks may be provided by additional sources. A computer-based data concentrator processes the racing data from the totalisator and any additional sources and provides the racing data to a television network—typically at a main distribution node for a cable television network known as the "headend" facility. The cable headend provides the racing data to a number of user terminals. Typically, the cable headend provides the racing data with video signals on at least one television channel. Suitable approaches involve providing the racing data on a sideband or on a separate television channel.

If desired, the racing data may be distributed via satellite. With this approach, the racing data are provided within an available portion of the bandwidth of the television channel either in an available portion of the bandwidth of an analog television channel or as a portion of a digital television channel. Further, the racing data may be provided on a separate satellite channel or may be broadcast using a radio or television broadcast system.

Each user terminal receives the video signals and the racing data and separates out the racing data. Racing data are displayed on a monitor (preferably a conventional television monitor) using display and control circuitry. The racing data that may be displayed include odds, pools, and predicted and actual payoffs for selected wager types, races, and runners. The odds, pools, and payoffs for sophisticated wager types, such as exactas, trifectas, and daily doubles may by provided due to the relatively high bandwidth pathway that is made available between the data concentrator and each user terminal.

Another aspect of the invention relates to simultaneously displaying racing videos and racing data on a monitor. Racing data are provided from totalisators and from third party sources. A racing data interface processes the racing data and provides the processed data to a video and data distribution system. The racing video source provides racing videos to the video and data distribution system from a source of racing videos, such as live video feeds from racetracks.

The video and data distribution system may involve satellite distribution or distribution via a cable headend facility. Regardless of the medium over which the racing data and racing videos are distributed, the racing data are preferably provided with the racing videos on at least one television channel. One suitable approach for distribution of the racing data uses a frequency modulated carrier on a sideband of a television signal.

The racing data and racing videos are distributed to a number of user terminals. Preferably, the user terminals display the racing data and racing videos on a conventional television monitor.

The user can review the racing data at the user terminal in a variety of formats. For example, odds, pools, predicted payoffs, and actual payoffs can be displayed. Handicapping information can also be displayed. And additional information, such as news, weather, advertising, help, late changes/overweights, and scratches, etc. can be displayed. Based on this information, a user can select a desired racetrack or performance, which is a set of races at a particular track (i.e., a morning performance or afternoon performance). The user can also select a race, a wager type, wager amount, and one or more runners.

When a user has entered all of the data necessary to place a wager, the corresponding wager data are transmitted to a wagering data management system that preferably includes a totalisator for maintaining the user's wagering account. The wagering data management system adjusts the user's account based on the user's wagers. Typically, the user's account is debited when a wager is placed. If, following a race, a user's wager is successful, the wagering data management system credits the user's account accordingly.

Occasionally, the user may wish to transfer funds from a bank account into the wagering account at the wagering data management system. To do so, the user enters the amount to transfer and a personal identification code into the user terminal. This information is transmitted to an appropriate bank facility, which, after verifying the user's account information, authorizes the transfer of the selected amount of funds from the bank account into the wagering account. Alternatively, the user may place wagers directly against his regular bank account. A security measure that may be used, either in addition to requiring the personal identification code or as an alternative to the personal identification code is to use a physical key or access device, such as a smart card, magnetic stripe card, or electronic hardware key.

When the user desires to view the results of races that have been run, the user can place an order for a racing video of that race. The user terminal transmits the ordering information to, e.g., the video and data distribution center, which plays back the ordered racing video for the desired race. The user can also instruct the user terminal to trigger an alarm when an upcoming race is about to be run. Either an audible tone or a video message may be used to alert the user of the racing video for the upcoming race. If the user wishes to record a racing video, then the user enters the necessary race information into the user terminal. The user terminal either programs a video recorder to record the desired race at a predetermined time, or directly actuates a video recorder to record the racing video when the appropriate time arrives.

BRIEF DESCRIPTION OF THE DRAWINGS

The above and other objects and advantages of the present invention will be apparent upon consideration of the following detailed description, taken in conjunction with the accompanying drawings, in which like reference characters refer to like parts throughout, and in which:

FIGS. 8–28 are illustrative option menus and display screens suitable for use with the illustrative wagering system of FIG. 1;

FIGS. 35–50 are illustrative option menus and display screens suitable for use with the illustrative wagering system of FIG. 29.

DETAILED DESCRIPTION OF THE INVENTION

Figure 1:
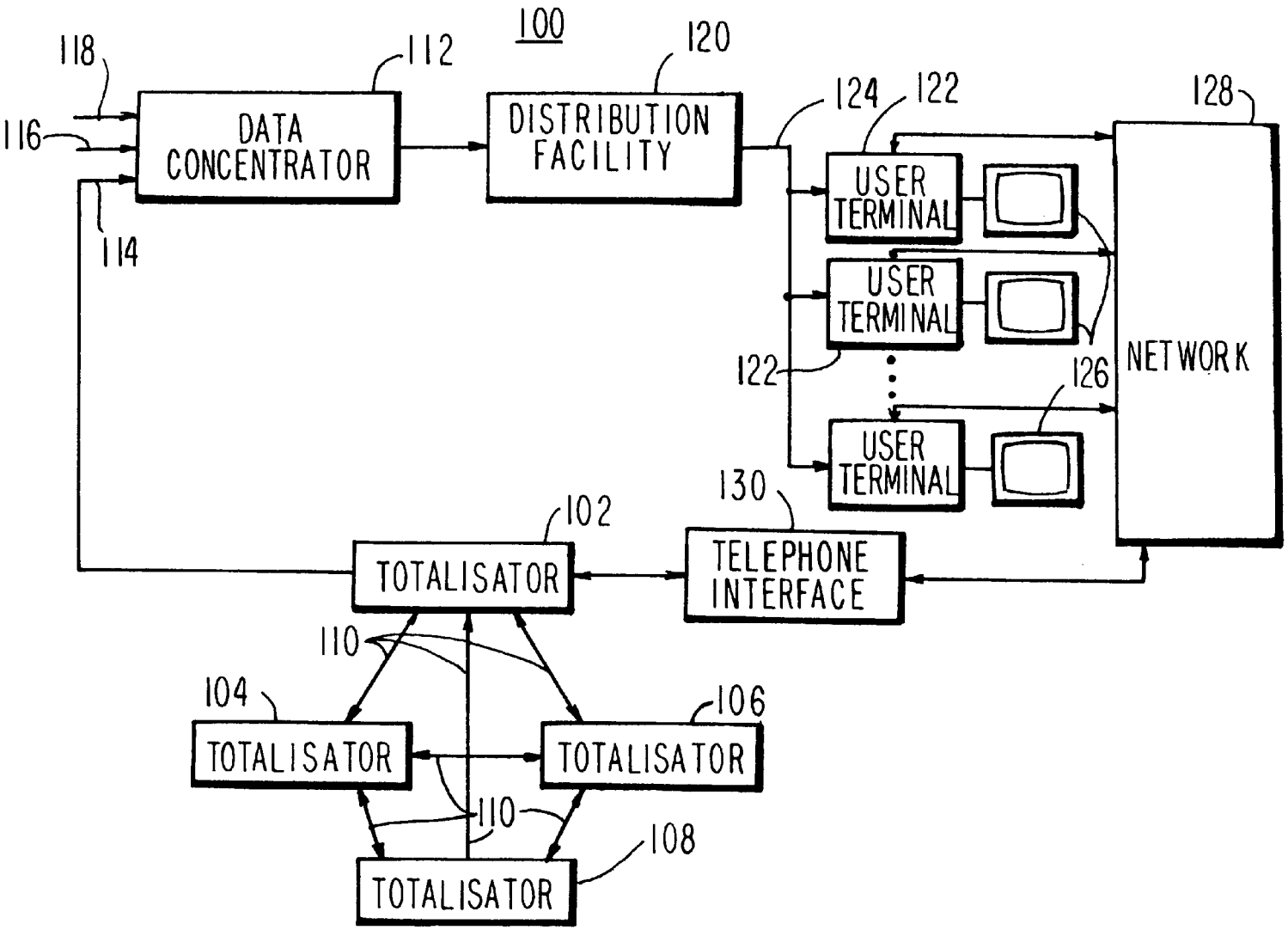
FIG. 1 is a block diagram of a wagering system constructed in accordance with the present invention.

A schematic block diagram of a wagering system 100 constructed in accordance with the present invention is show in FIG. 1. Wagering system 100 uses wagering machines known as "totalisators," such as totalisators 102, 104, 106, and 108, to generate wagering odds in realtime based on the wagers placed on racing events at various racetracks. Totalisators are available from companies such as Amtote International, Inc. of Hunt Valley, Md., Autotote Limited of Newark, Del., and United Tote Company of Shepherd, Mont. Typically, each racetrack has an installed totalisator for handling the wagering odds and information at that track. Thus, totalisators 102, 104, 106, and 108 are generally each located at a separate racetrack. Totalisators are also capable of communicating data between one another.

For example, as shown in FIG. 1, totalisators 102, 104, 106, and 108 are interconnected by data lines 110. Totalisators 102–108 communicate between one another using data lines 110 and a communication protocol known as the Intertote Track System Protocol (ITSP). The communication between totalisators 102–108 allows totalisators 102–108 to share pools, thereby allowing racing fans that interact with one totalisator to view odds and place wagers on races at other racetracks.

The odds and other racing data from each of the totalisators connected to totalisator 102 are provided to data concentrator 112. Data concentrator 112 is a computer-based system that receives racing data from totalisator 102 and provides the data to a suitable data distribution system for providing the data to racing fans in their homes. Typical racing data received from totalisator 102 include the current race at each track, which races and tracks are open for wagering, the post times of each race, and the number of races associated with each track. Racing data from totalisator 102 also include the win, place and show "pool" totals for each runner (e.g., a horse) and the exacta, trifecta, and quinella payoff predictions and pool totals for every runner combination. Odds are provided for all races that have not started (i.e., those races for which wagering has not been closed). Totalisator 102 also provides the number of minutes remaining until post time for the current race at each track to data concentrator 112.

Other racing data provided by totalisator 102 to data concentrator 112 include race results, such as the order-of-finish list for at least the first three positions and payoff values versus a standard wager amount for win, place, and show, for each associated combination of the finish list. Also provided are payoff values for the winning complex wager types, including exacta, trifecta, quinella, pick-n (where n is the number of races involved in the pick-n wager), and daily double. The payoff values may also be accompanied by a synopsis of the associated finish list.

Further racing data provided by totalisator 102 to data concentrator 112 include the number of runners in each race, the valid wager amounts accepted by totalisators 102–108, and valid wager types accepted by totalisators 102–108. Racing data provided by totalisator 102 also include a scratch list of those runners entered but removed from a race.

Preferably, additional "program information" (racing information typically provided in printed programs) may be provided from totalisator 102 to data concentrator 112. Such program information may include early odds, early scratches, race descriptions (including the distance of each race and the race surface—grass, dirt, artificial turf, etc.), allowed class ratings (based on a fixed ratio of external criteria), purse value (payoff to winning runner), allowed age range of runners, and the allowed number of wins and starts for each runner.

In addition to receiving racing data from totalisator 102 at line 114, data concentrator 112 preferably receives supplemental racing data from third party information sources, such as Axcis Pocket Information Network, Inc. of Santa Clara, Calif., at input 116. Typical supplemental racing data include the post times of each race, jockey names, runner names, and the number of races associated with each track. Weather information is also available from third party data sources. For example, the weather for the city and state in which each racetrack is located can be obtained.

More detailed weather information, including track conditions, temperature, humidity, dewpoint, and a short status description of the current weather (sunny, raining, foggy, etc.) may also be provided. Some racing data, such as the data describing regional weather conditions may be widely available in an electronic format. Other racing data may need to be entered manually, via input 118.

Data concentrator 112 processes the racing data received at inputs 114, 116, and 118 and assembles the data into a suitable data format for transmission to distribution facility 120, which is preferably a cable headend. Transmission of the racing data between data concentrator 112 and distribution facility 120 may be via cable, satellite, or any suitable transmission medium with an adequate bandwidth to supply a large quantity of racing data in realtime.

Typically, large metropolitan cable television networks have at least several headend facilities. Television signals are provided to home viewers from the headends, generally using fiber optic cable and coaxial cable, collectively referred to here as "cable." Television distribution to the home is also possible in a system in which headends or similar facilities capable of data transmission deliver television signals to user terminals 122 via satellite.

In wagering system 100, racing data are provided from distribution facility 120 to user terminals 122 via a distribution network 124, which uses either cable wired directly to the home, a system of home satellite receivers, or radio or television broadcasting equipment. An advantage of using cable, satellites, or broadcast systems in distribution network 124 is that video information along with large quantities of racing data may be supplied to a large array of user terminals 122 more economically than with other systems. Although racing data is preferably supplied to the user terminals using the same medium used for video transmissions, this need not be the case. For example, racing data could be broadcast over-the-air while video information is received by the user via cable or satellite. If desired, videos of races can be provided along with the racing data. Using this type of system, the user can receive the racing data continuously, without forcing the wagering system 100 to monopolize the user's telephone line.

User terminal 122, which is preferably microprocessor-based, supports software capable of coordinating the receipt and display of racing data and the placing of wagers electronically. Preferably, user terminals 122 generate easy-to-read menus on displays 126, which may be, for example, conventional television sets. User terminal 122 executes instructions that enable terminal 122 to process the racing data received from distribution facility 120 and display the data on display 126 in a suitable format. The user can interact with user terminal 122 using any suitable user interface, such as a keyboard, pointing device, or voice-actuated controller. Preferably, the user interacts with user terminal 122 using an infrared or other suitable type of wireless remote control.

In order to place wagers, a user typically establishes an account associated with a totalisator (e.g., at a particular racetrack). The user's account balance and other wagering transactional information is stored in the totalisator. Preferably, user terminal 122 includes suitable communication circuitry to establish a communications link with totalisator 102. One suitable method of establishing such a link is to use modem communications between user terminal 122 and totalisator 102. For example, telephone network 128 and telephone interface 130 support two-way communications between user terminal 122 and totalisator 102. If a user desires to place a wager, the data necessary to execute the transaction are transmitted via network 128. Telephone interface 130 processes the wager data so that the data may be received by totalisator 102. For example, if many incoming signals are received at once, telephone interface 130 receives them in parallel. Typically, once the user places a wager the user's account at totalisator 102 is debited. If the user's wager pays off, the user's account at totalisator 102 is credited by the appropriate amount.

Figure 2:
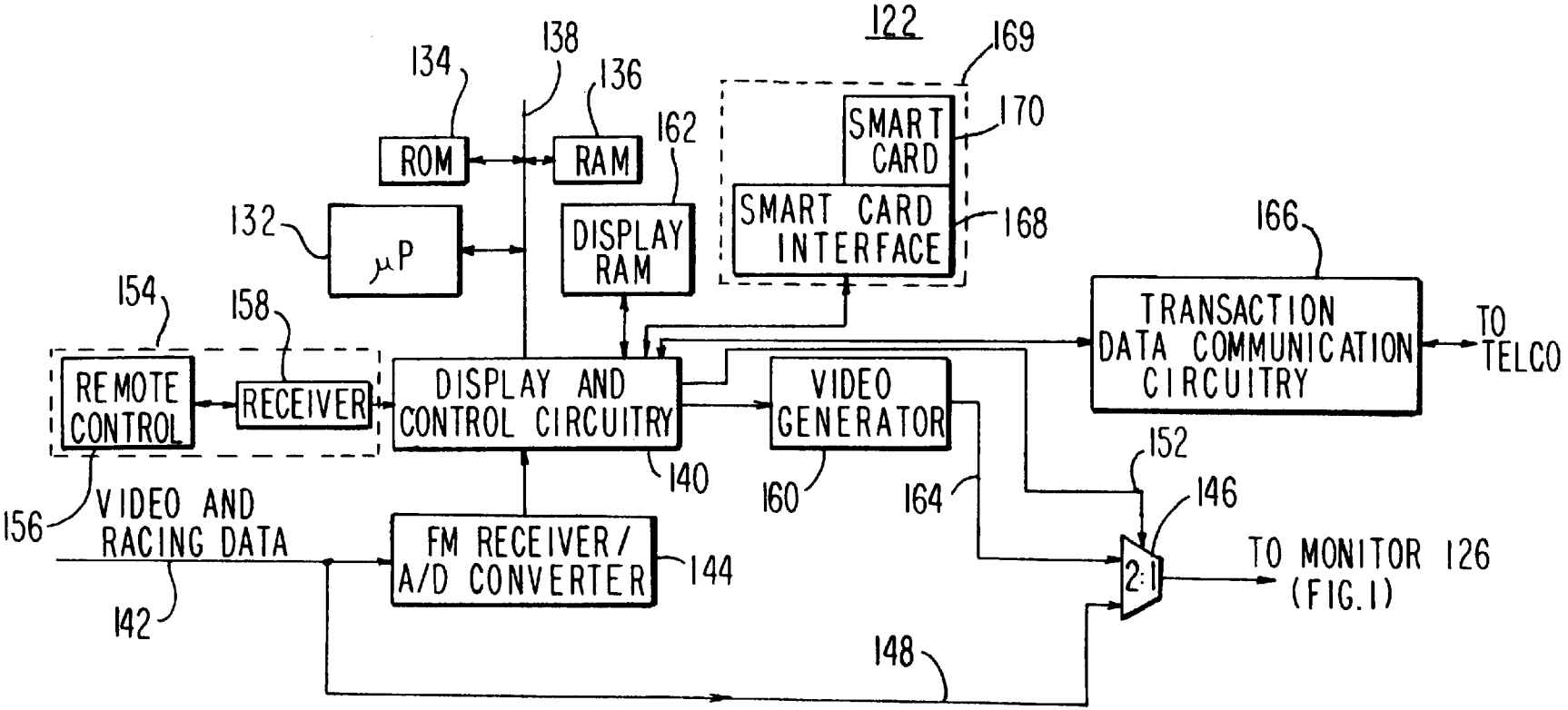
FIG. 2 is a block diagram of a user terminal suitable for use with the wagering system of FIG. 1.

User terminal 122 is shown in more detail in FIG. 2. Microprocessor 132 is connected to memory 134—preferably a read-only memory (ROM)—and memory 136—preferably a random-access memory (RAM) via bus 138. Bus 138 is also used to interconnect microprocessor 132 and memory 134 and 136 with display and control circuitry 140. Display and control circuitry 140 coordinates the operation of the various display, control, and communications peripherals of user terminal 122. Memory 134 and memory 136 contain instructions that are executed by microprocessor 132. Microprocessor 132 operates in conjunction with display and control circuitry 140 to direct the operation of user terminal 122.

Racing data and video signals are received at input 142 of FM receiver/analog-to-digital converter 144. The racing data are transmitted on an FM carrier in an open range within the bandwidth of the video signals. FM receiver/analog-to-digital converter 144 separates out the racing data signal and demodulates it to a digital format that is processed by display and control circuitry 140. The video signals received at input 142 are passed to multiplexer 146. When the user desires to view video programs corresponding to the video signals received at input 142, multiplexer 146 is switched to allow the video signals on line 148 to pass to monitor 126 (FIG. 1). The control signals used to switch multiplexer 146 may be provided by display and control circuitry 140 via line 152. Preferably, monitor 126 (FIG. 1) is a conventional television set.

The racing data that are received by user terminal 122 are stored in memory 136, so that microprocessor 132 can process this information as desired by the user. The user controls the functions of user terminal 122 via input interface 154, which is preferably a combination of a remote control 156 and a receiver 158. Based on user commands received via input interface 154, display and control circuitry 140 displays various information on monitor 126 (FIG. 1) using video generator 160 and display memory 162. The information to be displayed on monitor 126 (FIG. 1) is provided at output 164 of video generator 160. Display and control circuitry 140 generates an appropriate control signal on line 152, so that the output of video generator 160 is provided to monitor 126 (FIG. 1) via multiplexer 146.

User terminal 122 also has transaction data communication circuitry 166 provide a two-way communications link between user terminal 122 and totalisator 102 (FIG. 1). Transaction data communication circuitry 164 may be based on any suitable communication circuitry such as conventional modem circuitry for communicating via telephone lines. If the distribution network 124 (FIG. 1) supports two-way communications, then transmission and communication circuitry 164 may include appropriate back-haul circuitry to provide a communications link with totalisator 102 (FIG. 1) via a return path over distribution network 124 (FIG. 1) rather than over network 128 (FIG. 1).

In order to place wagers, the user must typically supply a personal identification code to the totalisator 102 (FIG. 1) at which the user maintains an account. The personal identification code is transmitted using the transaction data communication circuitry 166. By transmitting the personal identification code to totalisator 102 (FIG. 1) when placing a wager, the totalisator 102 (FIG. 1) can ensure that the user's personal identification code matches an authorized code, and can verify the user's account balance prior to authorizing the wager. As an added measure of security, user terminal 122 preferably also has a non-volatile storage device 169, which is used to maintain a local account balance and which contains a user's personal identification code. Suitable non-volatile storage devices include magnetic stripe cards and electronic hardware keys. Physical keys can also be used to provide additional security, if desired.

Preferably, non-volatile storage device 169 includes a smart card interface 168 that accepts smart card 170. Smart card interface 168 allows account and account verification information to be stored on smart card 170. Smart card 170 must be inserted in smart card interface 168 in order to place a wager. Thus, if a user removes the smart card 170, no wagers can be placed against that user's account by a third party, even if the user's personal identification code is known by that party.

In operation, user terminal 122 displays various menus of options on monitor 126 (FIG. 1). The menus can be invoked by pressing an appropriate "enter" button on remote control 156. Remote control 156 also has cursor keys that allow the user to cursor forward and backward and up and down through the menus. In order to leave the system, the user presses an "exit" button on remote control 156.

Figure 3:
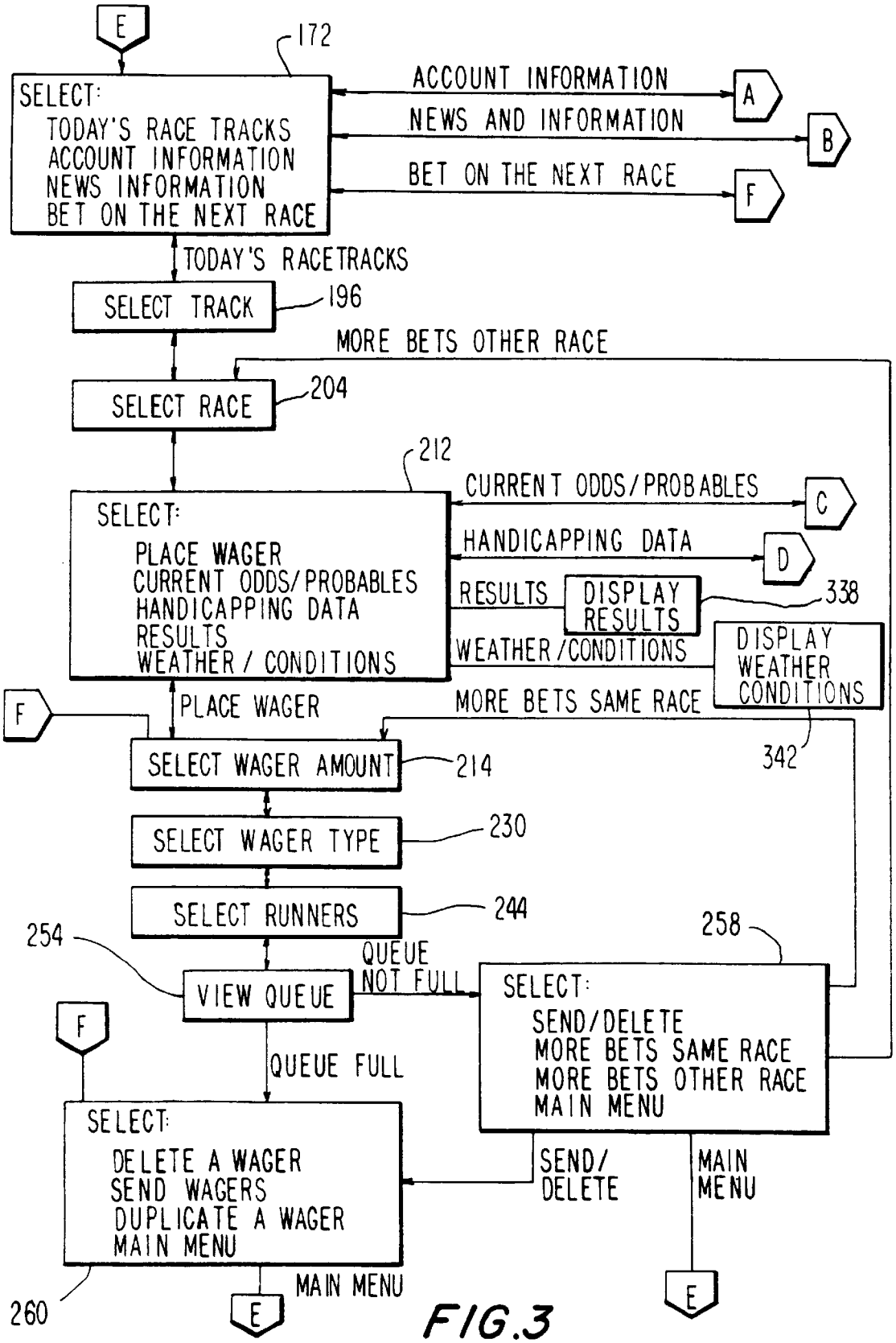
FIGS. 3–7 are logic flow diagrams illustrating the operation of the wagering system of FIG. 1.
Figure 6:
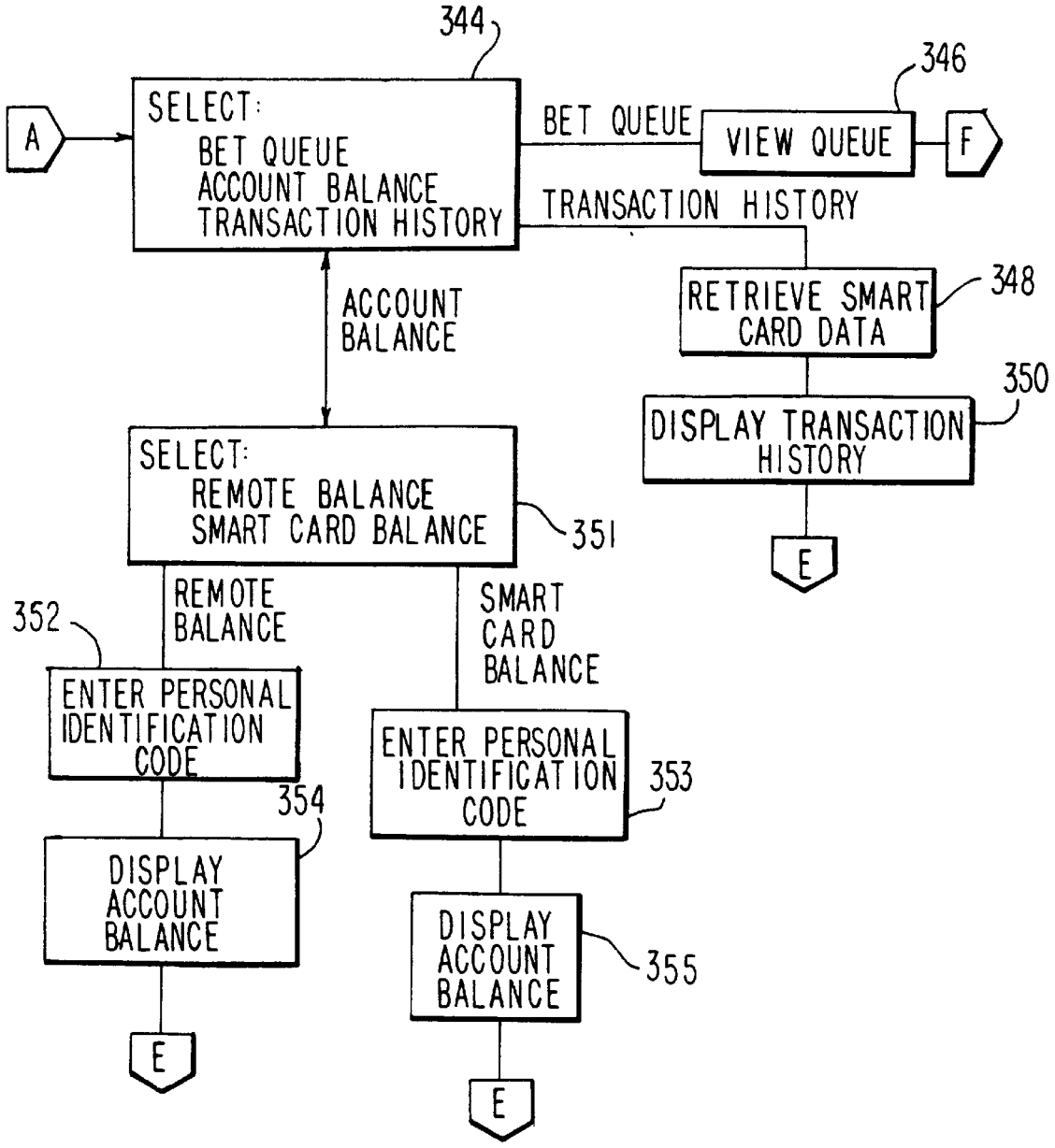
Figure 7:
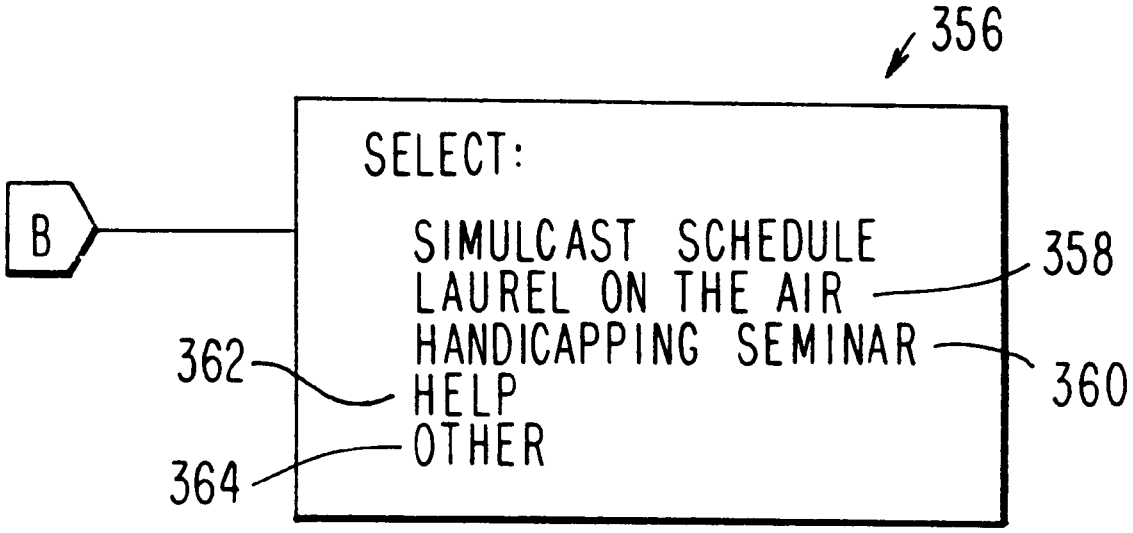
Figure 8:
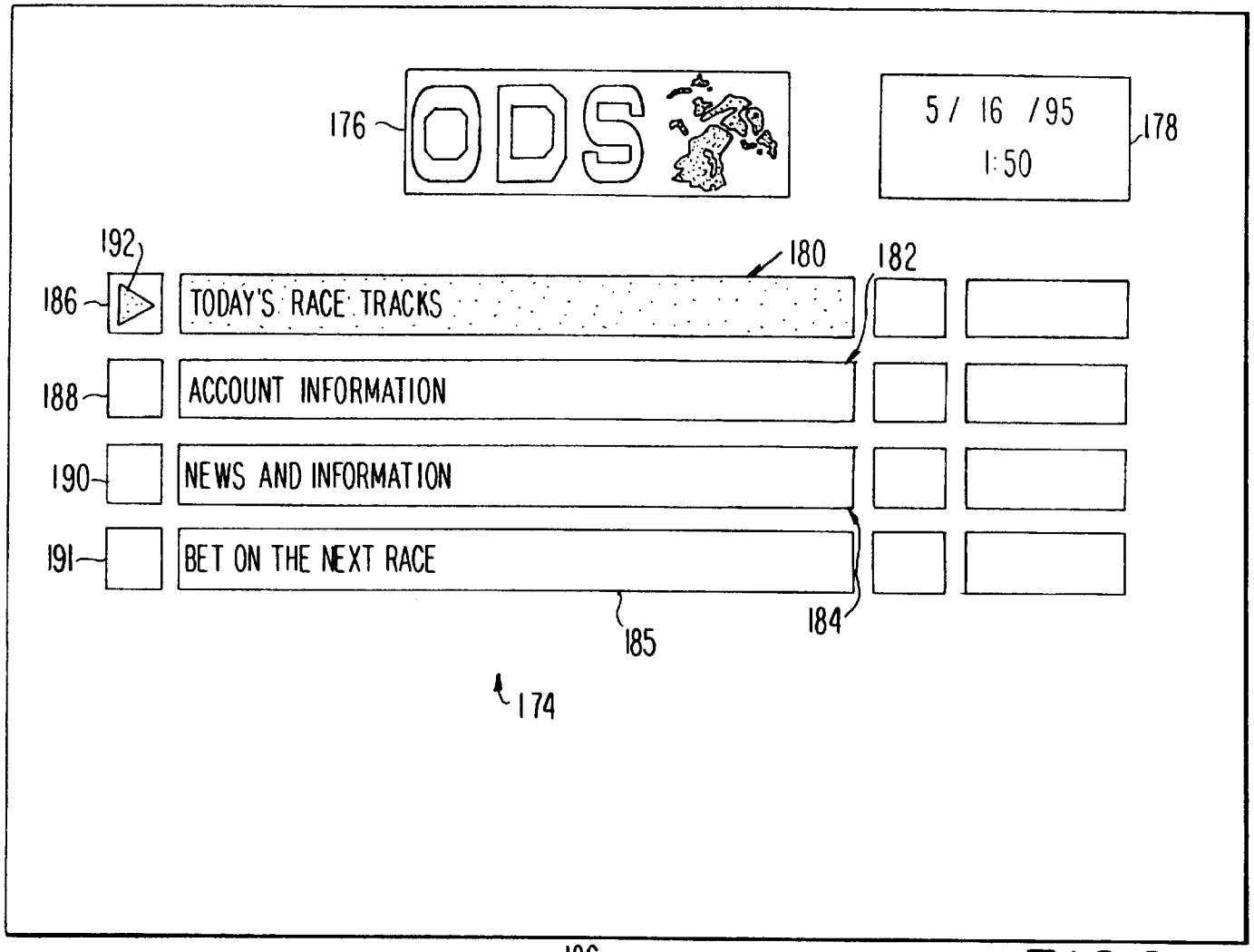

The logical flow of the operation of wagering system 100 (FIG. 1) including menus and options provided by user terminal 122 (FIG. 2) is summarized in FIGS. 3–7. As shown in FIG. 3, at step 172 the user selects between several available options: "today's race tracks," "account information," "news and information," and "bet on the next race." A menu 174 corresponding to step 172 is shown in FIG. 8. As shown in FIG. 8, menu 174 preferably contains corporate logo 176 and date and time information 178. Menu options 180, 182, 184, and 185 are preferably displayed in the center of screen 186. To the left of menu options 180, 182, 184, and 185, are cursor boxes 186, 188, 190, and 191. In FIG. 8, cursor 192 is positioned adjacent to the next available menu option—option 180, thereby "highlighting" that option. When a user desires to select the highlighted option, the user presses "enter" or the "right" cursor key on remote control 156 (FIG. 1). If the user wishes to select a different menu option, the user moves the cursor to the next lower or higher menu option on menu 174 using cursor up/down keys on remote control 156 (FIG. 2).

Figure 9:
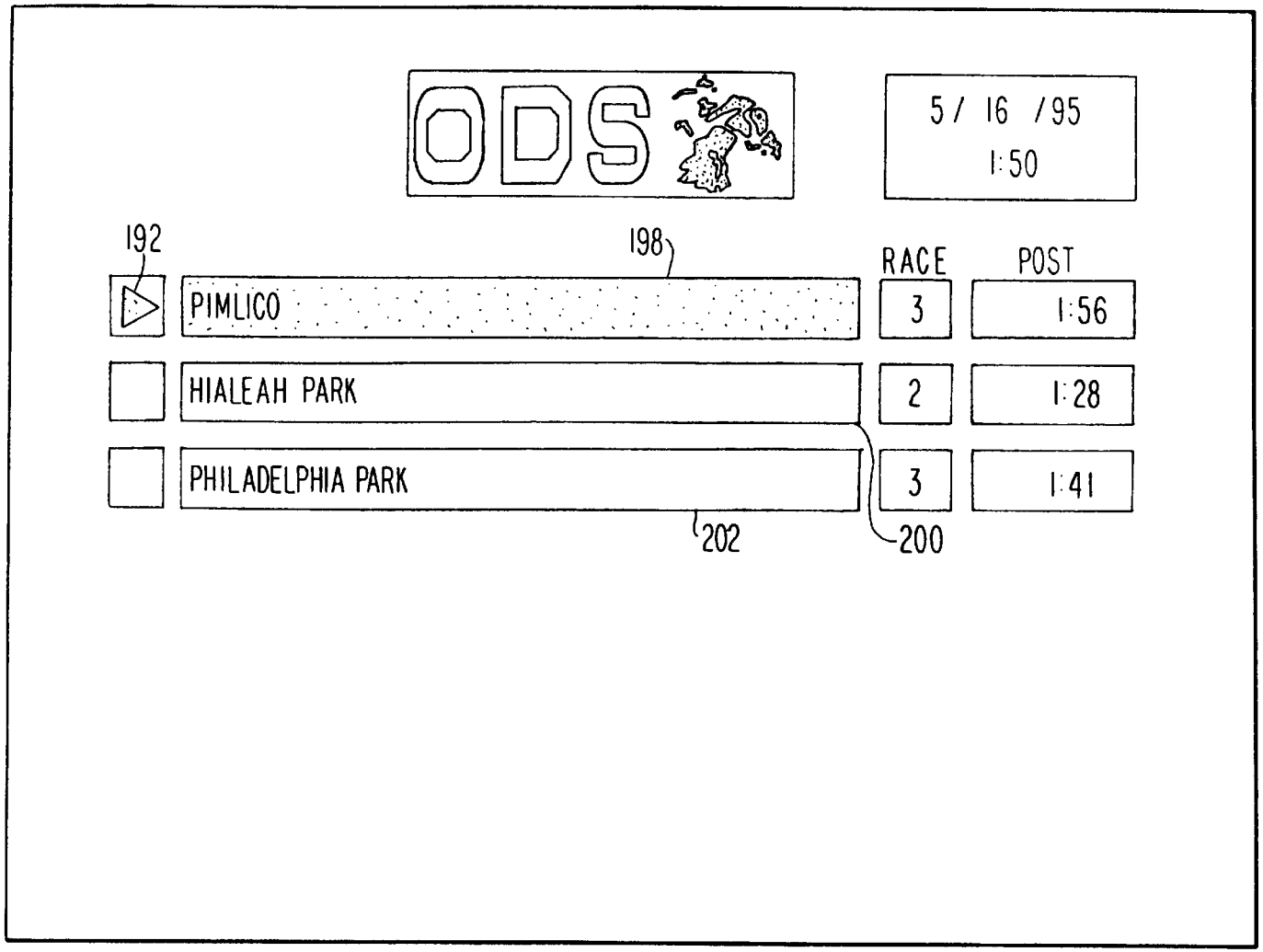

As shown in FIG. 3, if the user selects "today's racetracks" (menu option 180 in FIG. 8) at step 172, the user may then select a desired racetrack at step 196. A menu corresponding to step 196 is shown in FIG. 9. Racetrack menu options 198, 200, and 202 are racetracks available for wagering. Preferably, the list of available racetracks is provided by distribution facility 120 (FIG. 1) to user terminals 122 (FIG. 1), so that by controlling this list it is possible to "black out" certain racetracks.

Cursor 192 is used to highlight the desired track. The menu option adjacent to cursor 192 is also preferably highlighted by changing the color etc. of the option. The next race available for wagering at each racetrack and its corresponding post time are preferably listed adjacent to each track name. For example, the next available race at the Pimlico racetrack is race 3, which has a post time of 1:56. As with the available racetracks, the list of which races are scheduled is preferably provided to user terminals 122 (FIG. 1) by distribution facility 120 (FIG. 1). Accordingly, if it is desired to limit which races are available to the user, this may be done by making this selection at distribution facility 120.

Figure 10:
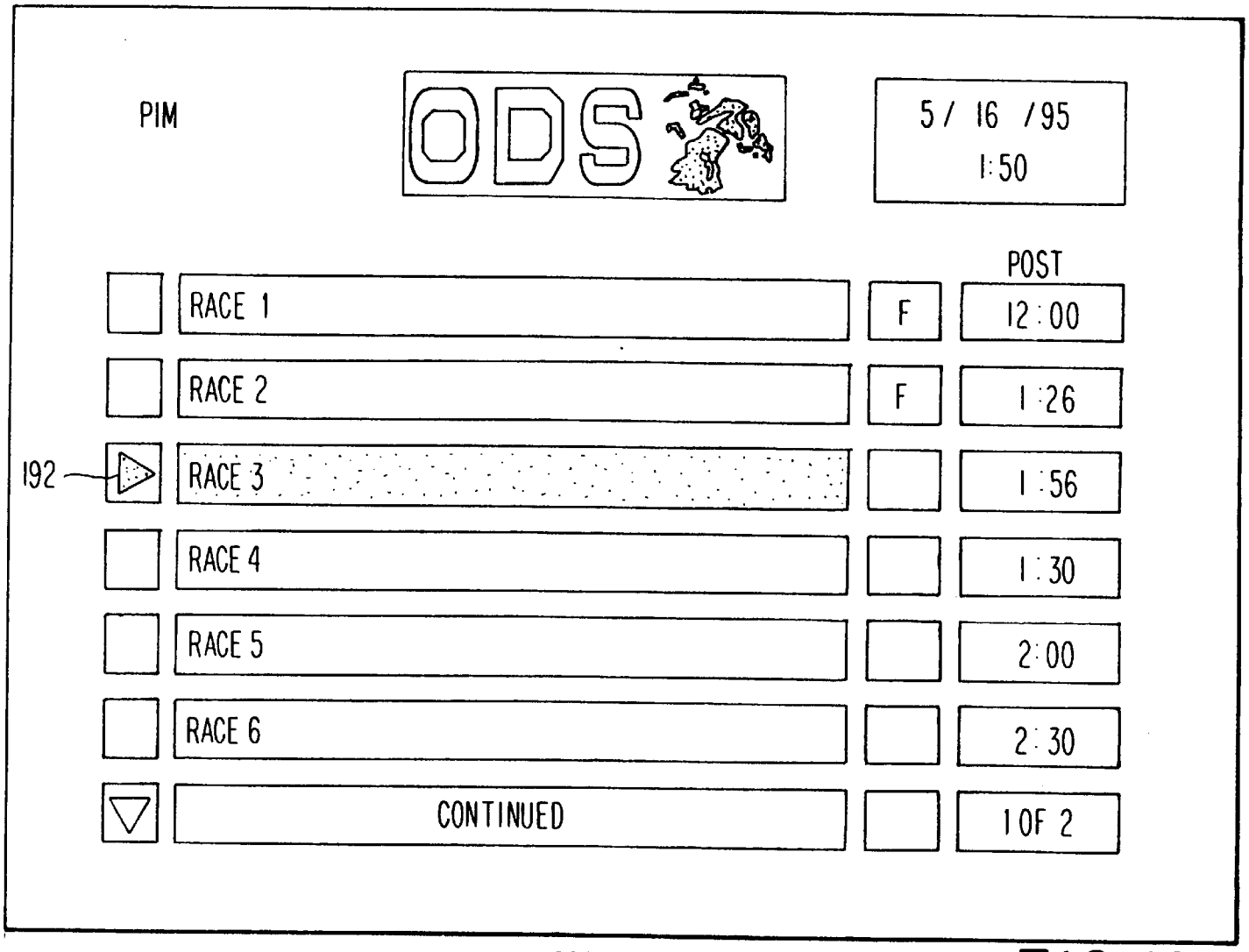
Figure 11:
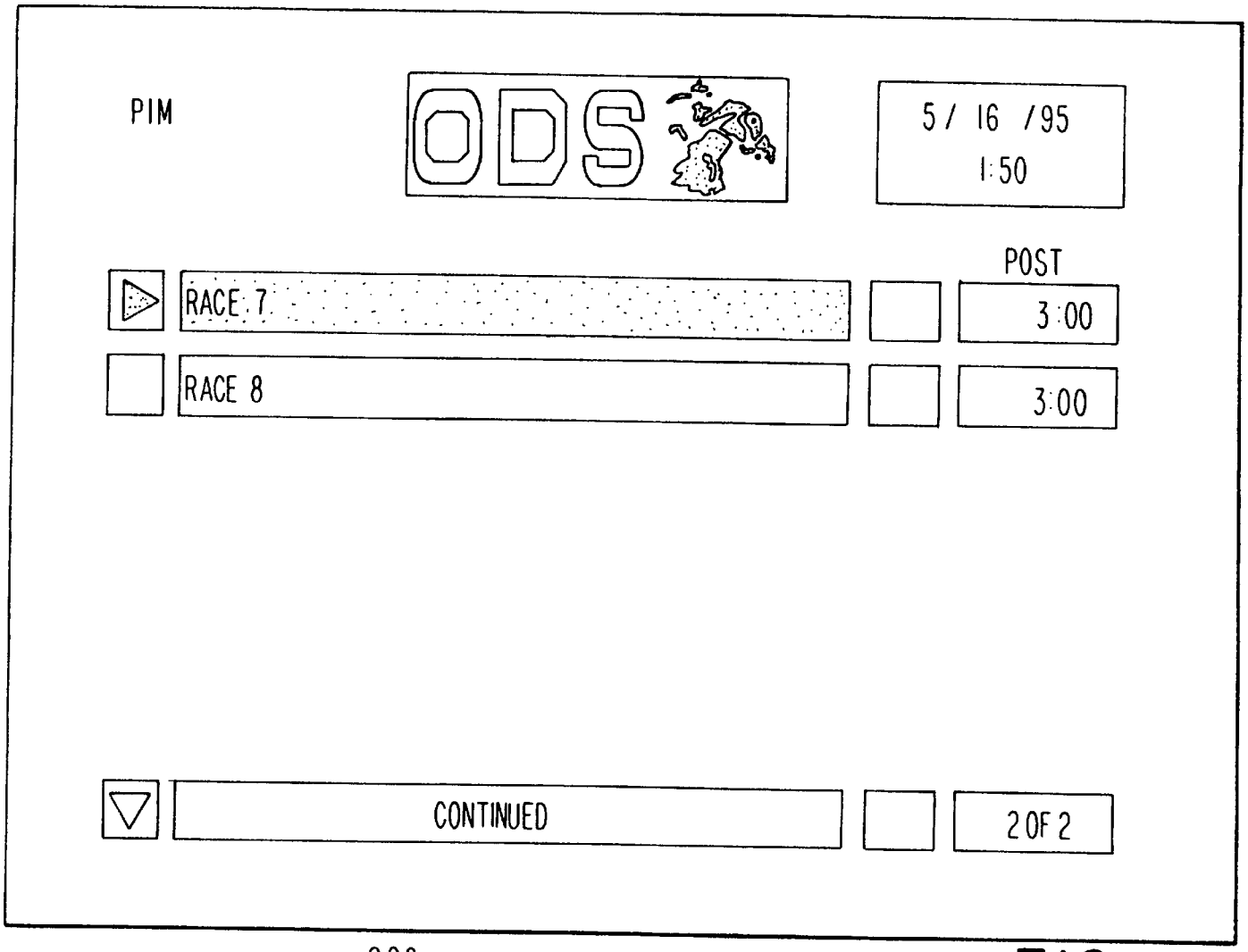

After selecting a track, such as Pimlico, at step 196 (FIG. 3), the user selects a race at step 204 (FIG. 3). The race selection menus 206 and 208 for the Pimlico racetrack are shown in FIGS. 10 and 11. Preferably, the data in menus such as menus 206 and 208 and other menus/screens that are used to display racing data are periodically automatically updated (e.g., at least every 15 minutes) to reflect the most current racing data. To update the display automatically, user terminal 122 (FIG. 1) may display racing data as it is received from distribution facility 120 (FIG. 1) in realtime, or may update the display at predetermined time intervals, based on the most recently acquired data.

Menu 208 is illustrative of a type of menu that may be used whenever it is desired to display more information than fits easily onto a single screen. Races 1–8 are listed on menus 206 and 208. As shown in FIG. 10, the letter "F" is placed adjacent to races 1 and 2 to indicate that those races have been run and for which the results have been declared final. No wagers can be placed on these races. When menu 206 is displayed (at step 204 of FIG. 3), cursor 192 is placed at a default position adjacent to race 3, because that is the next race available for wagering. As shown in the upper left corner of menu 206, an abbreviation of the racetrack (in this case "PIM" for Pimlico) is displayed to remind the user of the currently selected racetrack. A user selects a desired race by moving cursor 192 to a race and pressing "enter" or an equivalent action button on remote control 156 (FIG. 2).

Returning to FIG. 3, after the user has selected a race at step 204, the user is presented with a menu of available options at step 212. For example, the user can place a wager or view current odds/probables, handicapping data, race results, or weather. If the user chooses to place a wager, the viewer selects an amount to wager at step 214. The amounts available for wagering are preferably transmitted to user terminals 122 (FIG. 1) from distribution facility 120, so that it is possible to limit which wagering amounts are available to the user as desired. Preferably, the user can select the wager amount using an interactive menu such as menu 216 shown in FIG. 12. On the left of menu 216, current odds 218 are listed for each of the runners (e.g., 1–9). Typically, win odds are listed. Thus, as shown on menu 216, the odds for runner 1 winning race 3 are 20 to 1.

The racetracks, races, wager types, wager amounts, and various other menu options that are available to the user at user terminal 122 (FIG. 1) may be controlled from the distribution facility 120 (FIG. 1). For example, the distribution facility 120 can limit the content of its transmissions to user terminals 122 (FIG. 1), so that only certain features are available. If it is desired to black out a given racetrack, then the racing data (and any accompanying instructions to be executed by user terminal 122 of FIG. 1) for that racetrack are not provided to user terminals 122. With this approach, the menu options of user terminals 122 (FIG. 1) may be configured on a system-wide basis.

If desired, user terminals 122 (FIG. 1) may also be individually addressable, which allows distribution facility 120 (FIG. 1) to provide different types of service to different sets of user terminals 122 (FIG. 1). Any suitable addressing technique may be used. For example, an addressing technique similar to that used in conventional addressable cable converter units may be used. User terminals 122 (FIG. 1) may be provided with preprogrammed authorization codes when they are manufactured or a user may be provided with an appropriate authorization code to enter into user terminal 122 (FIG. 1) (e.g., using remote control 156 or smart card 170). Distribution facility 120 (FIG. 1) transmits the racing data and any instructions that are to be executed by microprocessor 132 and display and control circuitry 140 (FIG. 2) in transmission blocks containing an authorization code. User terminals 122 (FIG. 1) compare each incoming transmission block with their authorization code. When the code matches, racing and other data within the transmission block are accepted for use by that user terminal 122 (FIG. 1).

Individual addressability allows selected subsets of user terminals 122 (FIG. 1) to be permitted to have access to certain racetracks, sets of races, wager types, or wager amounts. Because distribution facility 120 (FIG. 1) can provide preselected features to selected subsets of users, it is possible to provide various tiers of service, etc.

Figure 12:
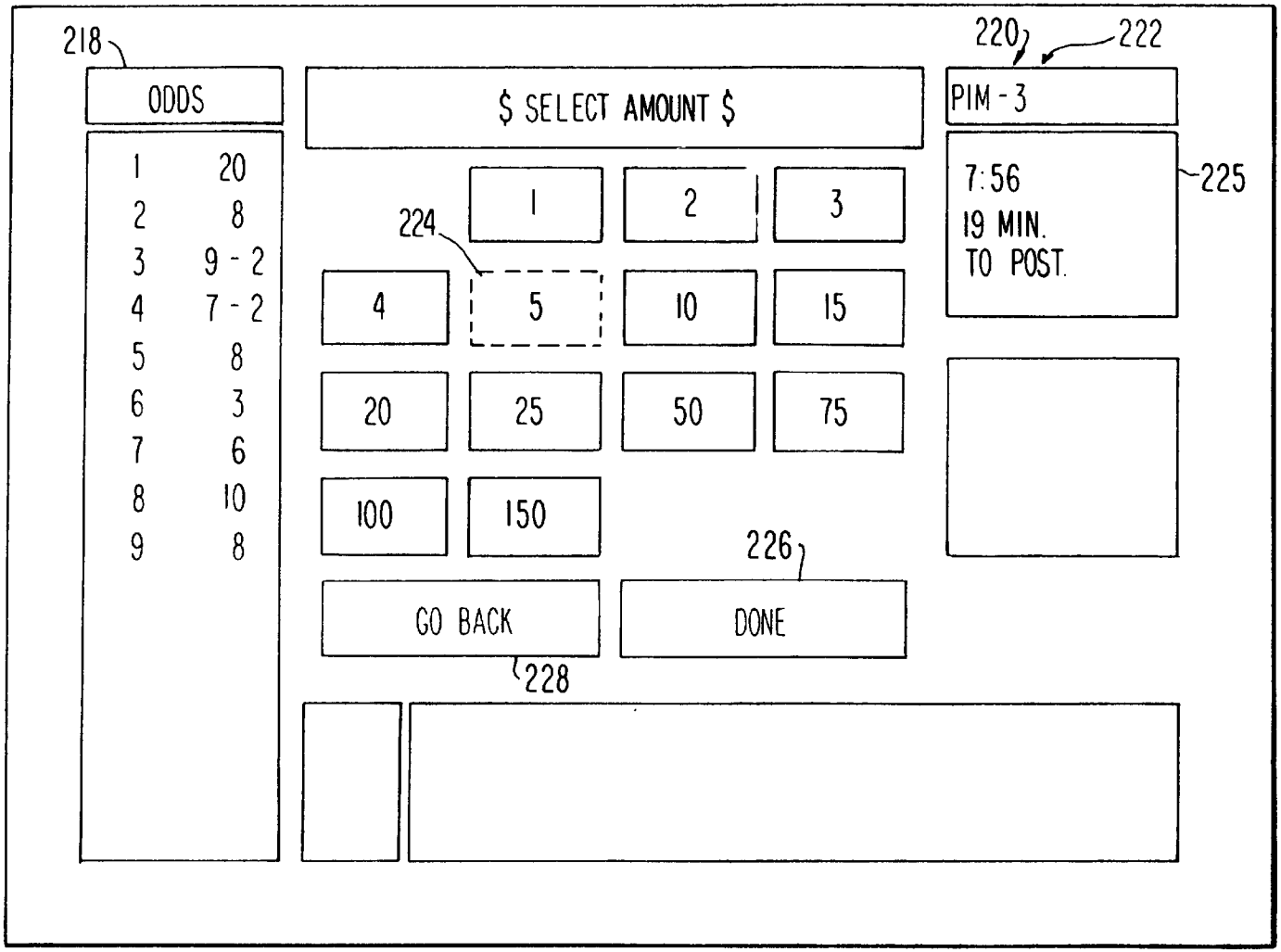

As shown in FIG. 12, on the right of menu 216 is an abbreviation 220 of the currently selected racetrack (i.e., "PIM" for Pimlico). Current race 222 is also listed (i.e., race 3). Information such as the current time and the time remaining to post time is displayed in box 225. Preferably, the post time blinks or otherwise changes its appearance within a certain predefined time window prior to a race, so as to provide a visual clue that the start of the race is approaching.

When first presented to the user, menu 216 has a highlighted portion 224 (e.g., $5). The user selects the desired wager amount by moving highlighted portion 224 using the up/down and left/right cursor keys of remote control 156 (FIG. 2). When highlighted portion 224 rests on the desired wager amount, the user presses the enter key on remote control 156 (FIG. 2). Highlighted portion 224 is then placed on the done box 226. If the user is ready to proceed, the user presses the enter key on remote control 156 (FIG. 2). If, instead, the user wishes to return to menus 206 and 208 (FIGS. 10 and 11), which correspond to step 212 (FIG. 3), then the user highlights and selects go back box 228.

Figure 13:
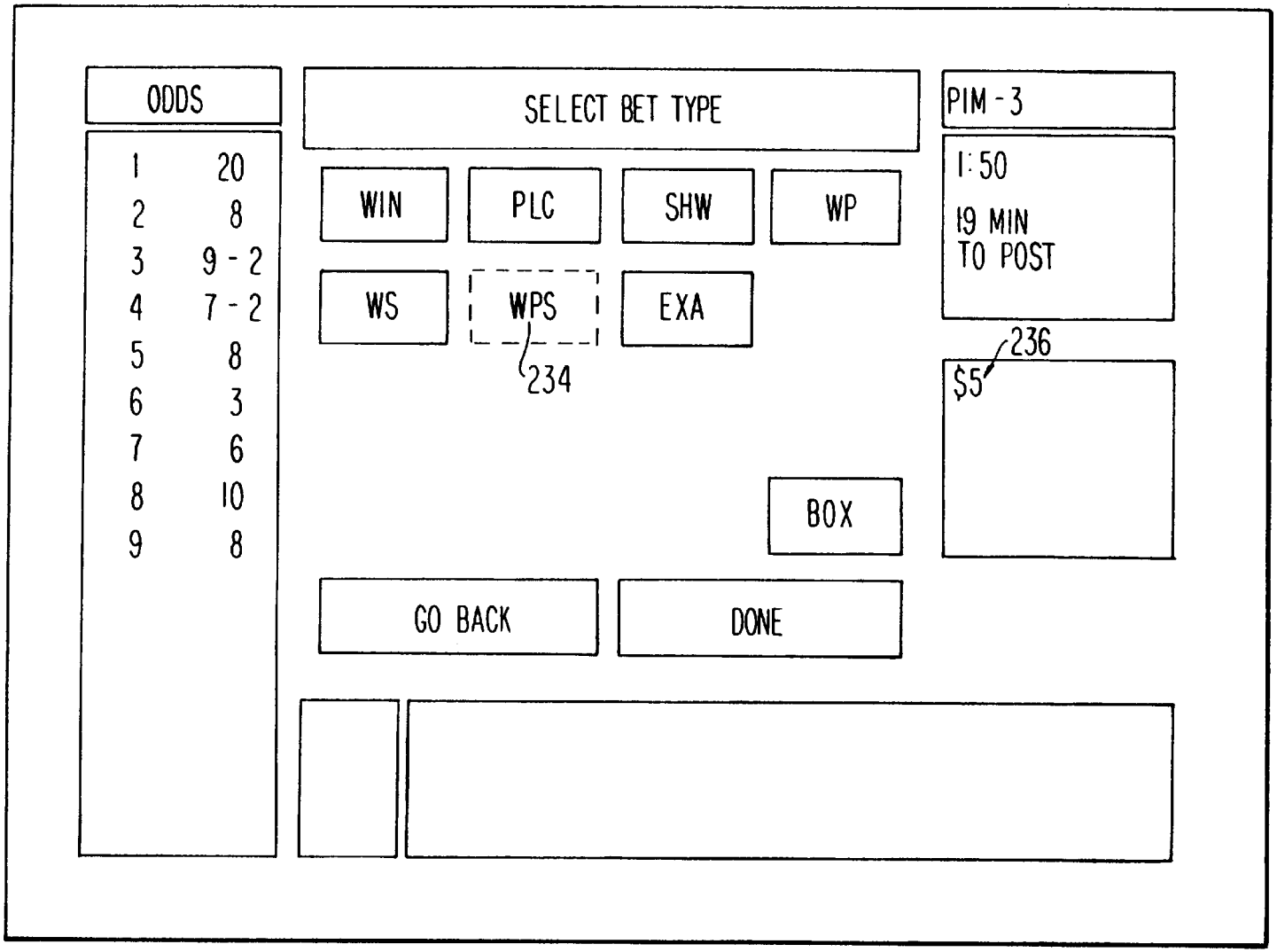

As shown in FIG. 3, following selection of the wager amount at step 214, the user selects a desired type of wager at step 230. A typical wager type selection menu 232 is shown in FIG. 13. Additional wager types can be supported by providing additional wager selections on wager selection menu 232. Preferably, the wager types available at selection menu 232 are determined by distribution facility 120 (FIG. 1). Thus, the wager types available to the user may be controlled by limiting what information is transmitted from distribution facility 120 (FIG. 1) to user terminals 122 regarding wager types. Highlighted portion 234 initially rests on one of the wager types, such as WPS, which stands for win, place, and show. Other available wager types include, but are not limited to, WIN (win), PLC (place), SHW (show), WP (win-place), WS (win-show), and EXA (exacta). Suitable wager types also include trifecta, quinella, daily double, and pick-n type wagers (where n is a value from, e.g., 3 to 10).

Preferably, menu 232 is similar in appearance and layout to other menus, such as menu 216 (FIG. 12), so that the user is presented with a fairly uniform interface. For example, odds are shown at the left of menu 232, just as they are shown at the left of menu 216 (FIG. 12). Similarly, the racetrack abbreviation, race number, current time, and time remaining to post are shown on the right of menu 232 in the same way that this information is displayed in menu 216 (FIG. 12). By changing the overall layout of the menus as little as possible from one screen to the next, viewer confusion is minimized and screen storage requirements or the user terminal 122 are reduced. An additional tem in menu 232, which is not shown in the wager mount menu 216 of FIG. 12, is selected wager amount 236 ($5 in the example of FIG. 13).

Figure 14:
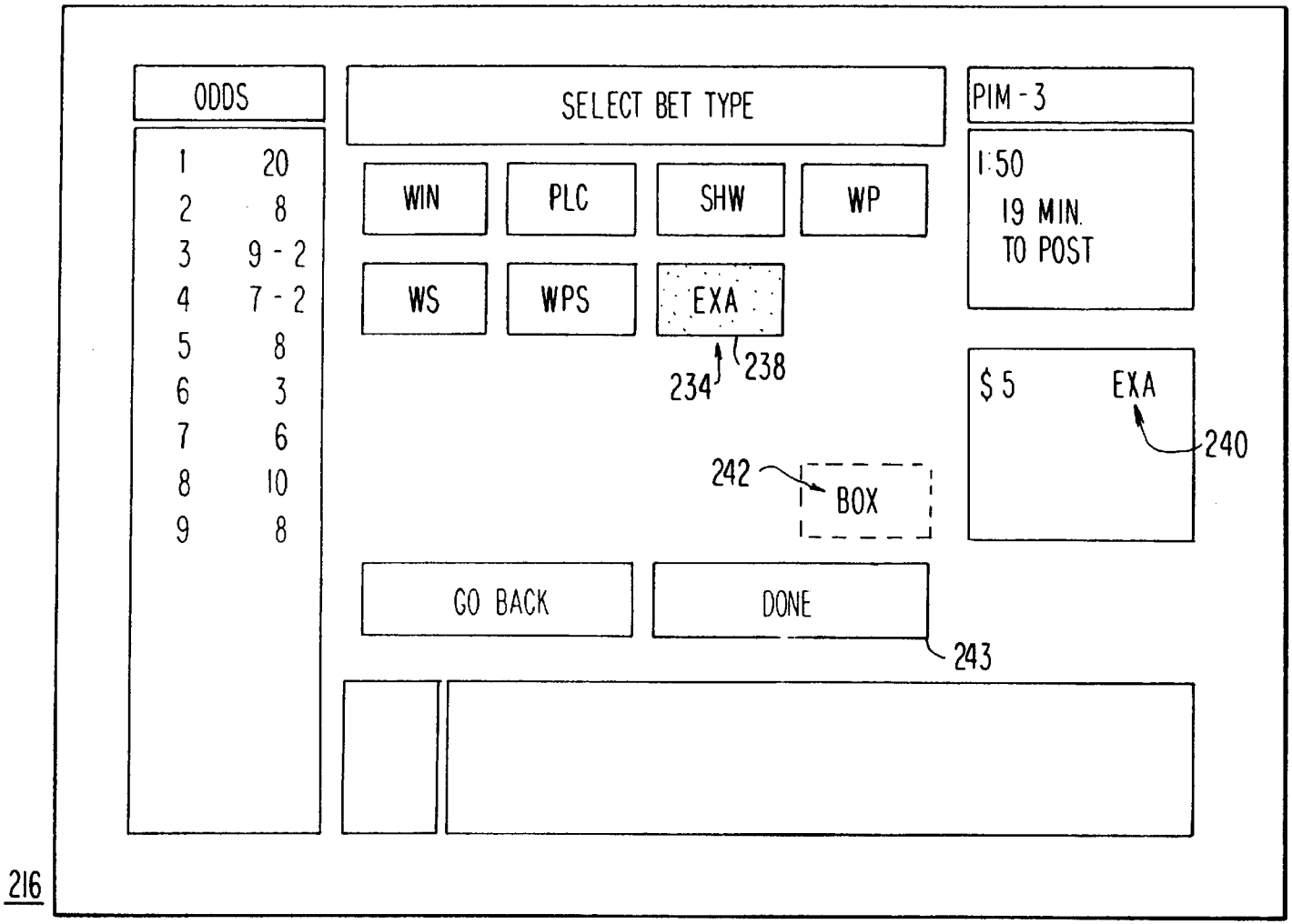

As shown in FIG. 14, the user selects the desired bet amount by moving highlighted portion 234 to the desired wager type and pressing the enter key on remote control 156 (FIG. 2). In FIG. 14, an exacta wager was chosen by selecting EXA box 238. The selected wager type may be indicated in any suitable fashion, for example, by changing the color of the wager type box. Further, as shown in FIG. 14, code 240 corresponding to the selected wager type can be displayed. After an exacta wager (or any multi-leg single race wager) is selected, highlighted portion 234 is either automatically placed on BOX 242 or, preferably, onto DONE 243 with the ability to move the cursor onto BOX 242 to allow a user to place a box bet (any multi-leg wager where the first leg or list of runners is used for all legs of the wager). Placing a box bet is a simplified method of placing a wager using the same runner list for each leg of a multiple leg wager.

Figure 15:
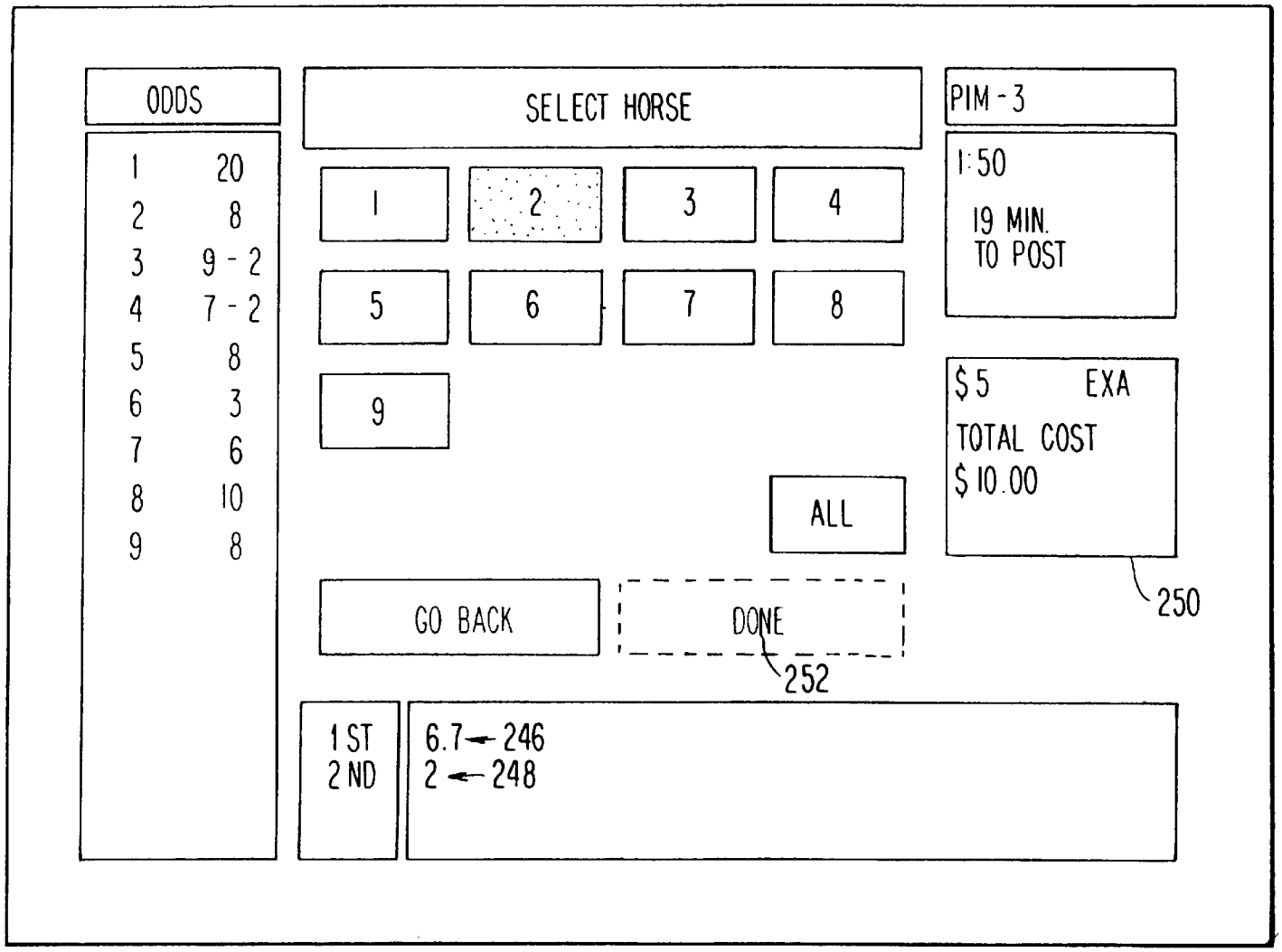

After selecting the wager type at step 230 of FIG. 3, the user selects runners at step 244. As shown in FIG. 15, for an exacta wager the user selects one or more runners for first leg 246 and second leg 248. If more than one runner is selected per leg, the number of possible exacta wager combinations is automatically calculated and the total cost of the wager updated accordingly at box 250. When all desired runners have been selected, the user selects done box 252, which causes the system to proceed to step 254 in FIG. 3.

Figure 16:
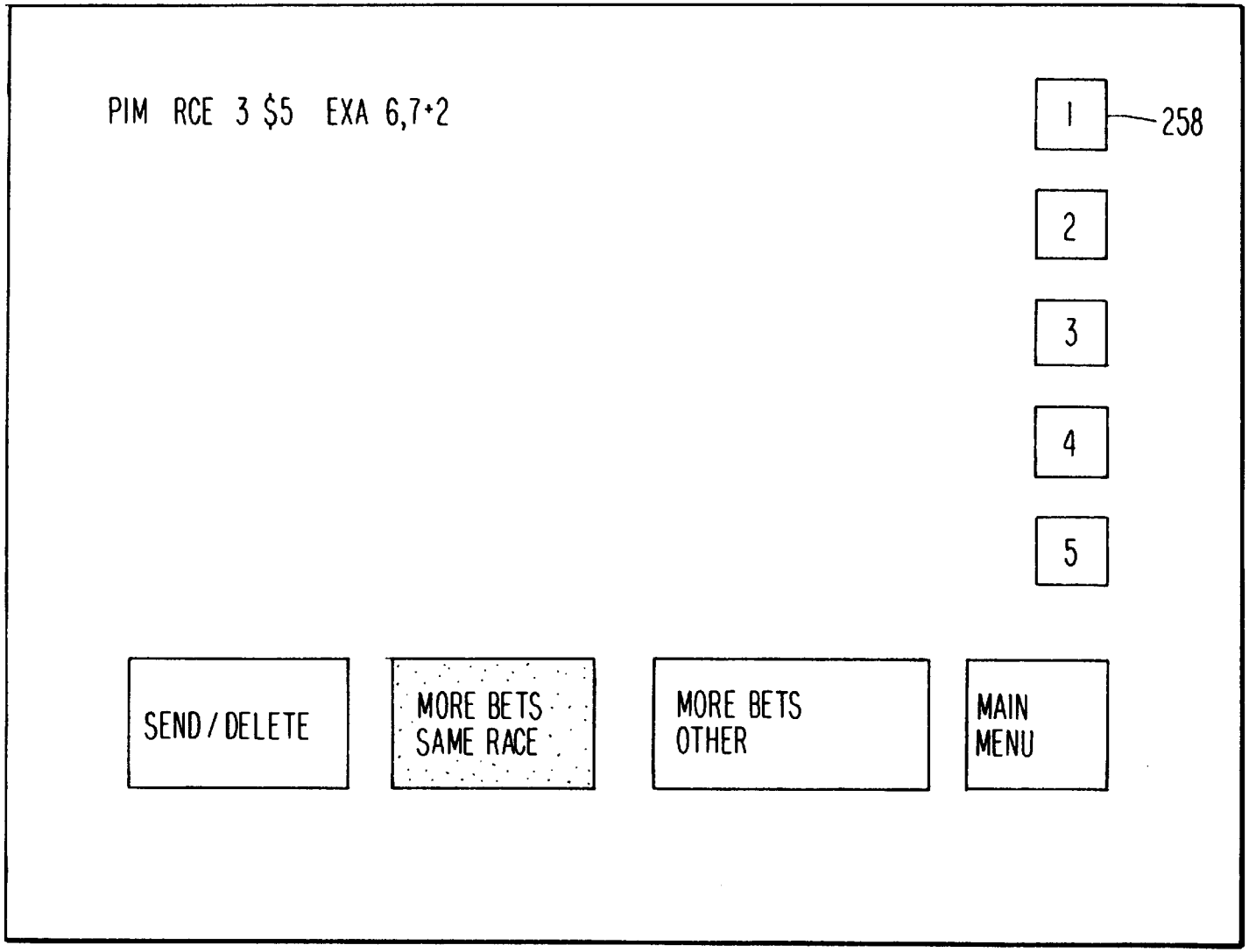

In step 254 (FIG. 3), wager queue menu 256 is displayed, as shown in FIG. 16. Each wager is summarized on a line adjacent to a wager number 258. In the example shown in FIG. 16, the first wager is a an exacta wager on the third race at Pimlico. Shown at the bottom of menu 256 are the menu options send/delete, more bets same race, more bets other race, and main menu. These menu options are displayed at step 258 (FIG. 3) when the wager queue is not full. Typically, the wager queue can contain up to five wagers. Before additional wagers can be added, the wagers in the queue must be sent to the racetrack. If the wager queue is full following step 254 (FIG. 3), then the menu choices of delete a wager, send wagers, duplicate a wager, and main menu are displayed at step 260. The menu options made available at step 260 are limited by the state of the queue. For example if the queue is full, the option "duplicate a wager" will not be available, etc. A typical menu 262 on which these options are displayed is shown in FIG. 17.

The menu options listed in menus 256 and 262 (FIGS. 16 and 17) allow the user to modify the wagers listed in the queue, make additional bets, etc. For example, as shown in FIG. 3, if at step 258 the user selects "more bets same race," the user is returned to step 214, at which a new wager amount can be selected. The user can then proceed through steps 230, 244, 254, etc. as described above. If at step 258 the user selects "more bets other race," the user is returned to step 204, at which a new track may be selected. Another option at step 258 is to return to the main menu. If "main menu" is selected, the user is returned to step 172.

Figure 17:
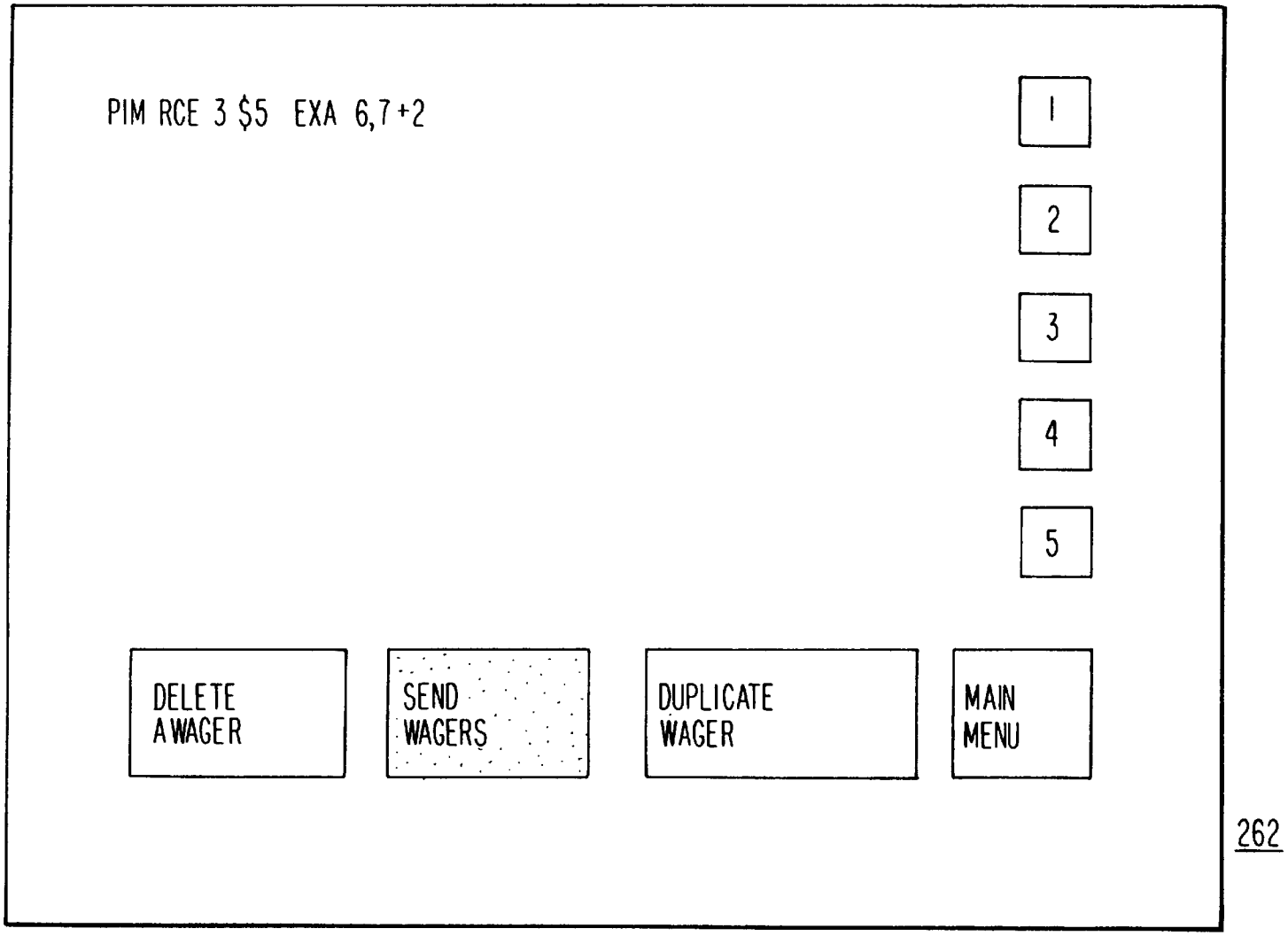

If the user selects "send/delete" at step 258 then the system proceeds to step 260 (menu 262 in FIG. 17). At step 260, the user has the option of deleting a wager that is no longer desired. For example, if the user wishes to delete wager 1, the user moves the highlighted portion of the menu to wager 1 and presses the enter key on remote control 156 (FIG. 2), whereupon the information for wager 1 is removed from menu 262 (FIG. 17). If "duplicate a wager" is selected, the user can make a copy of a wager, which appears on the next available wager line. Thus, if wagers 1 and 2 are filled, the user can position the highlighted portion of menu 262 (FIG. 17) adjacent to wager 1 and press enter. Wager 1 will then be duplicated as wager 3.

In order to place wagers, the wager information entered onto menu 262 must be sent to totalisator 102 (FIG. 1) via network 128 (FIG. 1). At the same time that a wager is sent, the user must transmit his personal identification code to allow the totalisator 102 (FIG. 1) to verify the status of the account against which the wager is to be placed. Totalisator 102 adjusts the user's account to reflect the results of the wager. If sufficient funds exist in the account, and if the wagering information is otherwise satisfactory, totalisator 102 (FIG. 1) will accept the wager and will typically debit the account. If the wager pays off, the account will be credited by the appropriate amount.

When a user is ready to send a wager to totalisator 102 (FIG. 1), the user selects "send wagers" from menu 262 in FIG. 17. Preferably, if no smart card is present, a message appears on monitor 126 (FIG. 1) instructing the user to insert smart card 170 (FIG. 2). The user is next instructed to enter his personal identification code using remote control 156 (FIG. 2). The personal identification code is compared to a prestored personal identification code on smart card 170 (FIG. 2). If, from comparison of the entered personal identification code to the personal identification code stored on card 170 (FIG. 2), it is determined that the user is authorized to use the account, then the transaction data necessary to place the wager with totalisator 102 (FIG. 1) are sent to totalisator 102 (FIG. 1). During the process of sending the wager information to totalisator 102 (FIG. 1), the user is preferably provided with messages on monitor 126 (FIG. 1) that indicate when the system is dialing and sending the data, and when it has been confirmed that the wager has been sent.

Figure 4:
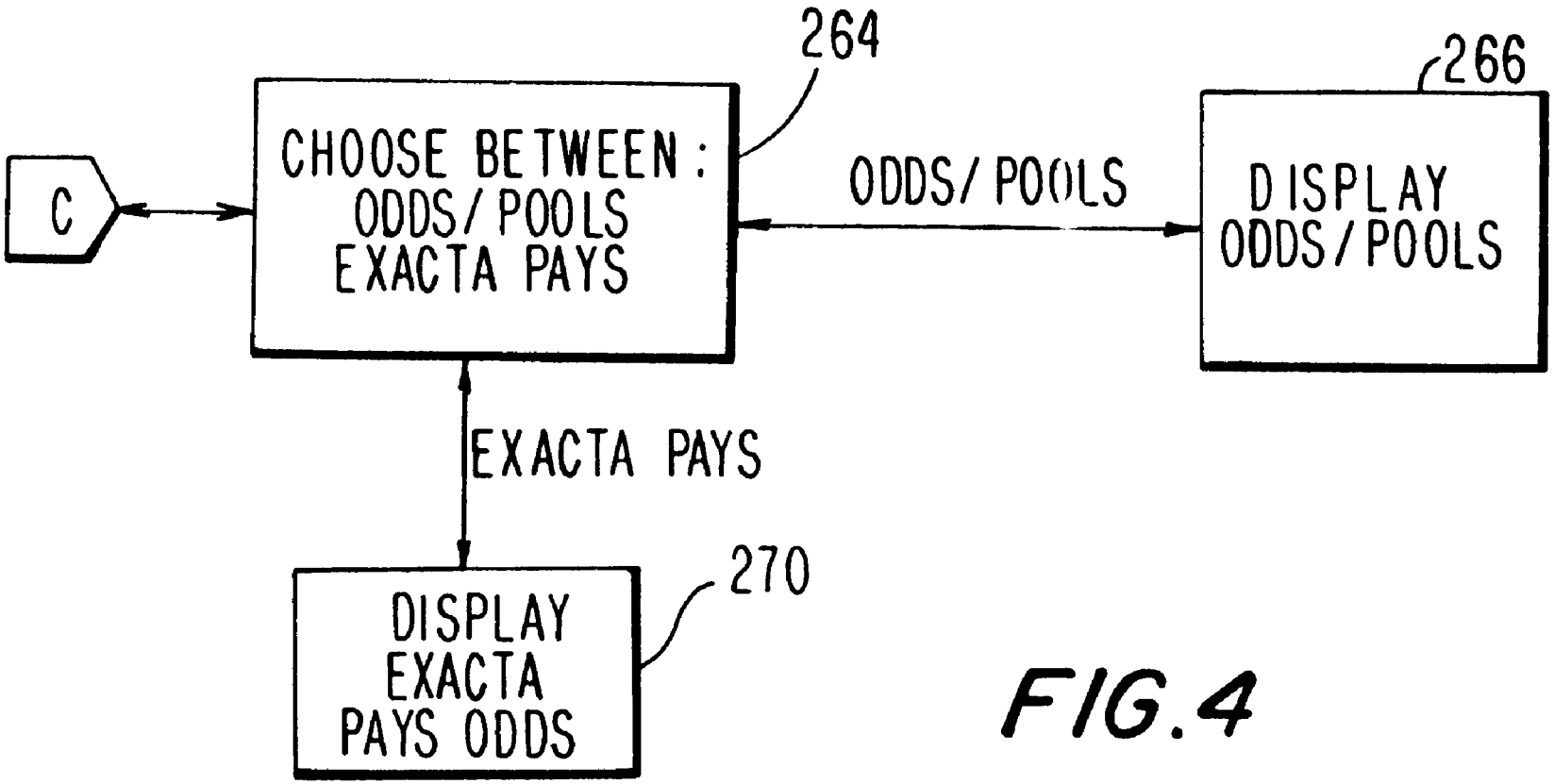

If, instead of selecting "place wager" at step 212, the user selects "current odds/probables," the system proceeds to step 264, as shown in FIG. 4. At step 264, the user is presented with a menu listing which odds and statistics are available for viewing. If the user selects "odds/pools" at step 264, the user is passed to step 266, in which odds and pools are preferably displayed in a format shown in FIG. 18. In chart 268, the win odds for each runner are displayed adjacent to the number of that runner. Also listed in chart 268 are the dollar amounts of each pool of placed wagers for each bet type (win, place, or show). At the bottom of chart 268 is a total of all pools for each wager type: win, place, and show.

Wager odds for wager types other than win odds can also be shown. For example, show or place odds can be displayed. With previously known off-track terminals it has not been possible to display show and place odds. Accordingly, if a home racing fan desired such information, he would need to make calculations by hand. In contrast, with the present invention, user terminal 122 processes the racing data provided by totalisator 102 (FIG. 1), so that odds for many wager types are available. The user can therefore quickly and accurately review these odds interactively in the home.

Information regarding exacta, trifecta, and other complex wager pool totals and payoff values for the various wager combinations may be selected at step 264 (FIG. 4). Any suitable display format may be used to show the desired information. A typical exacta pays screen 272 is shown in FIG. 19. Win odds are listed for each runner and predicted exacta payoffs are listed for each of the possible exacta combinations of runners. Thus, if there are nine runners there are typically nine screens 272. The first screen 272 lists the payoffs for runner 1 as a first place finisher (1 and x), where x is each of runners 2–9. Also listed are the payoffs for runner 1 as a second place finisher (x and 1). Subsequent screens are used to provide information for other runners. For example, the second screen 272 lists the payoffs for runner 2 as a first and second place finisher. Another item listed on screen 272 is exacta pool 274.

The odds and payoffs for other sophisticated wager types, such as trifectas, daily doubles, pick three, pick four, etc. can be listed in the same fashion if desired. Due to the limited nature of previously available off-track betting terminals, it has not been possible to determine odds and payoff information for many sophisticated wager types. For example, it has not previously been possible to determine odds for various combinations of runners within the complex wager types. With the present invention, complex wagering information may be calculated and displayed by user terminal 122 (FIG. 2). Because it has not previously been possible to display such detailed information using an off-track terminal, such information has either been completely unavailable or has only been available to racing fans who have traveled to the racetrack or to off-track betting establishments.

In addition, an advantage of the present system is that the user can interactively control the display of the odds and payoffs screens for the various wager types. For example, the user can move forward or backward through the wager information screens, such as screen 272 (FIG. 19), which shows the predicted payoff amounts if a particular runner combination wins an exacta wager. Previously known methods of displaying such information involve providing a non-interactive scrolling list of the information, e.g., on a monitor at a racetrack. But with that method it is necessary to wait until the information one wishes to view is presented on the monitor. In contrast, with the present invention the user can interactively advance forward and backwards through the screens such as exacta pays screens 272 as desired.

Returning to step 212 (FIG. 3), another menu option that can be selected by the user is to view handicapping data. If "handicapping data" is selected at step 212 (FIG. 3) then the user is presented with a menu of available handicapping data as shown at step 276 in FIG. 5. Preferably, the menu options available at step 276 include: snapshot power ratings, speed-class ratings, pace ratings, and jockey/trainer. If "snapshot power ratings" are selected at step 276, power ratings are displayed at step 277 (FIG. 5) on screen 278, as shown in FIG. 20. At the top of power ratings screen 278 is a banner including information such as race number 280 (e.g., race 1), race distance/surface 282 (e.g., 5 Furlongs on dirt), amount claimed 284, class rating 286, and runner age 288.

Below this banner, more detailed information pertaining to each runner is preferably listed. For example, runner name 290, number of days off since the last race 292, wins/starts for the selected surface and distance category 294, morning odds 296, and power rating 298. The information necessary to make-up screen 278 may be provided to the wagering system 100 (FIG. 1) via input 116 (FIG. 1).

Figure 5:
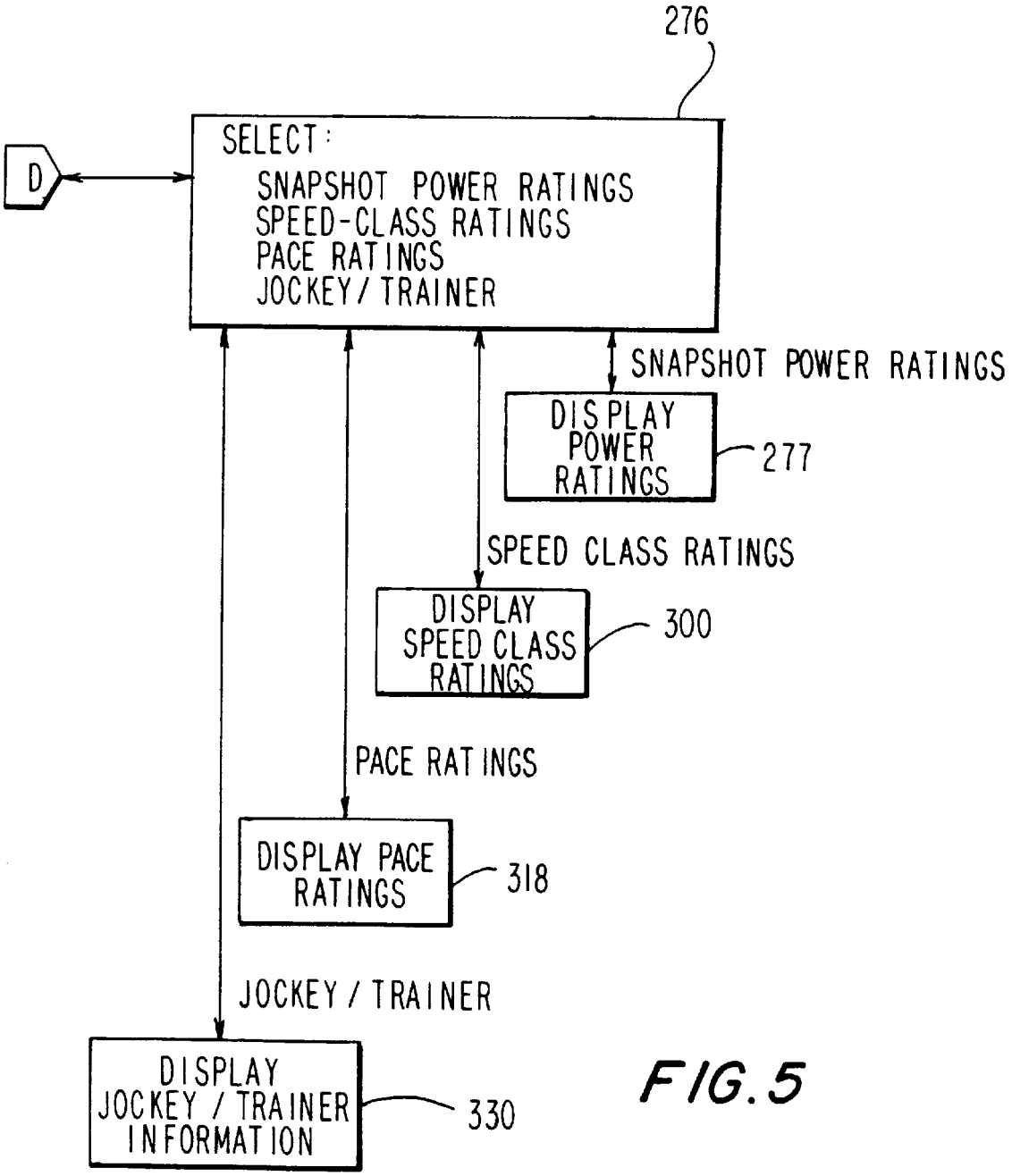

In addition to displaying snapshot power ratings, a user can choose to display speed/class ratings at step 276 (FIG. 5). If "speed/class ratings" is selected at step 276 (FIG. 5), then at step 300 (FIG. 5) screen 302 of speed/class ratings is displayed, as shown in FIG. 21. Screen 302 preferably contains information banner 304, as in screen 278 (FIG. 20). Also in screen 302 are runner name 306, speed rating 308, speed rating for this distance and track surface 310, highest speed rating for this distance and track surface 312, class rating 314, and class rating of last race 316.

Another option is available if the user selects "pace ratings" at step 276 (FIG. 5). Selecting "pace ratings" takes the user to step 318 (FIG. 5), at which pace ratings screen 320 is displayed, as shown in FIG. 22. As with screen 278 (FIG. 20) and screen 280 (FIG. 21), screen 320 contains handicapping data for each runner. Preferably, screen 320 contains typical position at early call 322, typical position at middle call 324, typical position at finish 326, and number of races in calculation 328.

A further display of handicapping data is available if the user selects "jockey/trainer" at step 276 (FIG. 5). If jockey/trainer is selected, control passes to step 330 (FIG. 5), at which screen 332 is displayed, as shown in FIG. 23. Screen 323 contains handicapping information about the jockeys and trainers for each runner. Typically, such information includes jockey and trainer names 334 and information about recent race statistics 336. Other jockey/trainer information that can be provided includes information relating to jockey changes and overweights for each runner.

Figure 24:
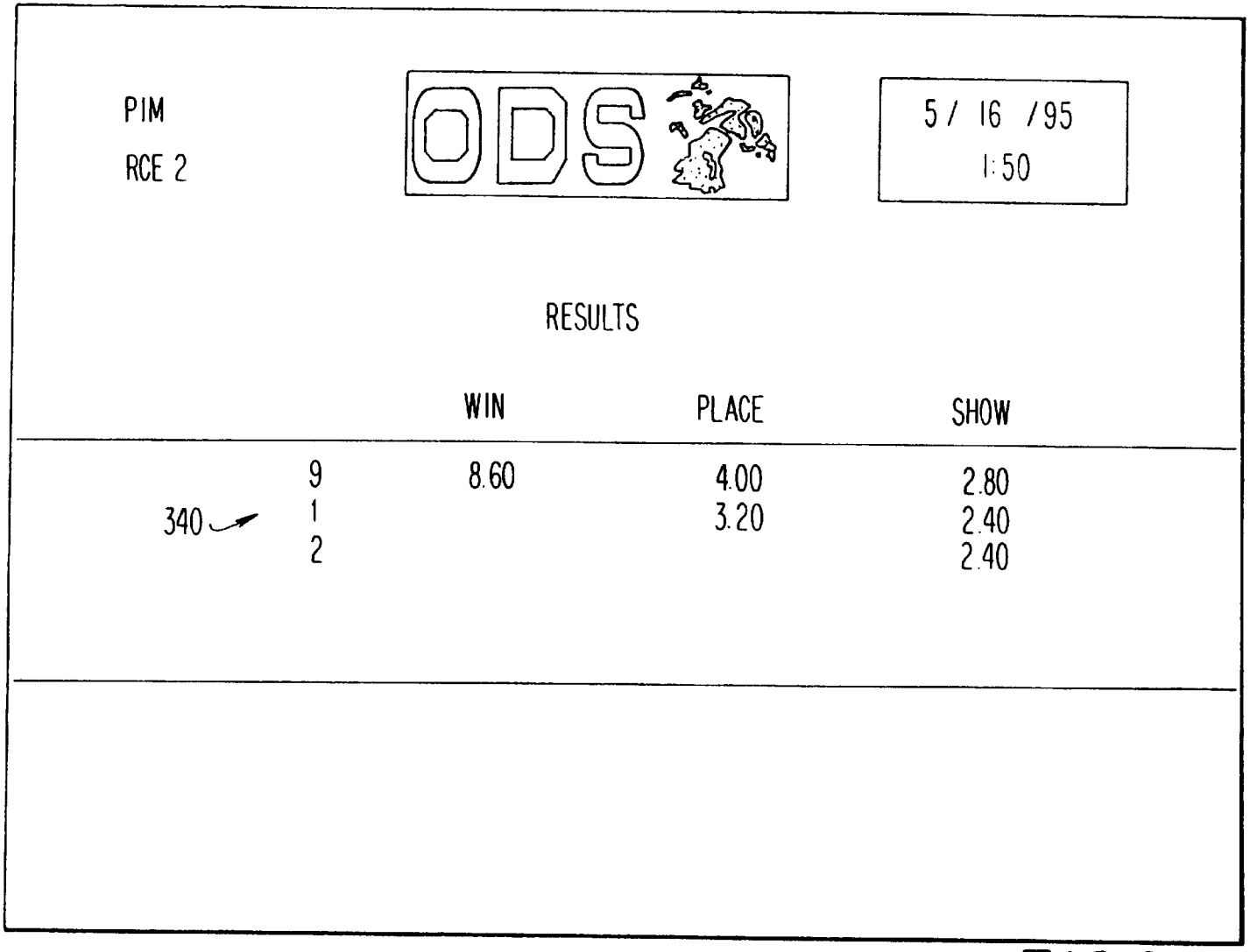

Returning to FIG. 3, another option available at step 212 is to display race results. If the user selects "results" at step 212, the results of the race selected at step 204 are displayed on the display 126 (FIG. 1) at step 338. One suitable format for displaying race results is shown in FIG. 24. Runner numbers 340 are displayed as well as payoffs for a standard wager (e.g., $2) for win, place, and show bets. If desired, results can also be displayed for the more sophisticated wager types such as exactas, trifectas, daily doubles, pick three, pick four, etc.

The present invention allows the user to interactively control the display of the race results screens. For example, the user can select a track and page through the results for the various races at that track. Preferably, the user can use the cursor keys on remote control 156 (FIG. 2) to move between the race results screens for various races.

Another option available at step 212 in FIG. 3 is for the user to view weather and track conditions for a selected racetrack. If the user selects "weather/conditions" at step 212, weather information is interactively presented at step 342. The weather for the city and state in which the selected racetrack is located is preferably displayed, as is more detailed weather information, including track conditions, temperature, humidity, dewpoint, and a short status description of the current weather (sunny, raining, foggy, etc.).

If the user selects "account information" (menu option 182 in FIG. 8) at the initial menu displayed at step 172 (FIG. 3), the menu options "bet queue," "account information," and "transaction history" are displayed at step 344, as shown in FIG. 6. If "bet queue" is selected at step 344, the queue is viewed at step 346 and control then passes to step 260 (FIG. 3). At step 260, the user can select from the menu choices "delete a wager," "send wagers," "duplicate a wager," and "main menu," as described above.

If "transaction history" is selected at step 344 in FIG. 6, the user terminal 122 (FIG. 2) preferably retrieves information concerning recent transactions such as wagers placed and the results of these wagers from smart card 170 (FIG. 2) at step 348. If desired, this information can be retrieved remotely, from totalisator 102. Using the retrieved information, the user's transaction history is displayed at step 350. After the user is finished reviewing the recent transaction history, the user is returned to step 172 (FIG. 3), where the initial menu options are displayed.

If the user selects "account balance" at step 344, at step 351, the user selects whether to retrieve his account balance remotely, from totalisator 102 (FIG. 1), or locally at terminal 122, from smart card 170. If the user selects "remote" at step 351, then the user enters his personal identification code at step 352. User terminal 122 (FIG. 2) then obtains current account information from totalisator 102 (FIG. 1) and displays this information at step 354. If the user selects "smart card" at step 351, then the user enters his personal identification code at step 353. User terminal 122 (FIG. 2) then obtains current account information from smart card 170 (FIG. 2) and displays this information at step 355. Preferably, information retrieved from smart card 170 (such as account balances) is for informational purposes only. No wagers can be authorized solely through the account information on smart card 170 (FIG. 2). This prevents unauthorized wagering if the card is tampered with. After the user is finished reviewing the account balance at step 354 or step 355, the user is returned to step 172 (FIG. 3), where the initial menu options are displayed.

The benefit of storing account and transaction history information locally on smart card 170 (FIG. 2) is that it is not necessary to communicate with totalisator 102 (FIG. 1) each time it is desired to review such information. Because the user does not need to communicate with totalisator 102 (FIG. 1) for routine transaction history and account balance queries, the user avoids any fees that may be associated with such queries. The user also reduces the frequency with which he needs to use his telephone line. Further, data corresponding to additional wagering transactions, such as recent wagering activity, may be stored on smart card 170 (FIG. 1).

The account and transactional information for each user is preferably stored on his individual smart card 170 (FIG. 2). This allows the user to visit other homes in which there are user terminals 122 (FIG. 1), without losing ready access to his account information. Alternatively, the account and transactional information can be stored in a suitable memory device in user terminal 122 (FIGS. 1 and 2).

Another menu option available at step 172 of FIG. 3 is the option to view news and information. If "news and information" (menu option 184 in FIG. 8) is selected at step 172, a submenu of news and information options is displayed at step 356, as shown in FIG. 7. The illustrative menu options displayed at step 356 include the option of viewing information about schedule times for racing video simulcasts available to the user. Racing simulcasts may be available via satellite, cable, broadcast, or other suitable video transmission medium. Typically, not all of the races run at the various racetracks are simulcast on television. Certain racetracks may not wish to create a disincentive for racing fans in the area to visit the track in person. For other racetracks there may not be sufficient demand to warrant the effort of televising all of the races. And because the post times of races are typically determined locally by the management of the racetrack, they may be subject to last minute changes or unforseen delays. For each of these reasons, it is difficult or impossible for a user to accurately determine which races are currently available via simulcast. Accordingly, with the present invention, when the user selects "simulcast schedule" at step 356, a current schedule listing the races available via simulcast is displayed.

Figure 25:
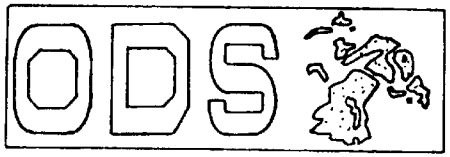

Other menu options available at step 356 include commercial advertisements. As shown in FIG. 7, menu option 358 is an advertisement called "Laurel on the Air," which could be, for example, local advertising for upcoming events on television or radio relating to the Laurel racetrack. An illustrative listing for Laurel on the air is shown in FIG. 25.

Figure 26:
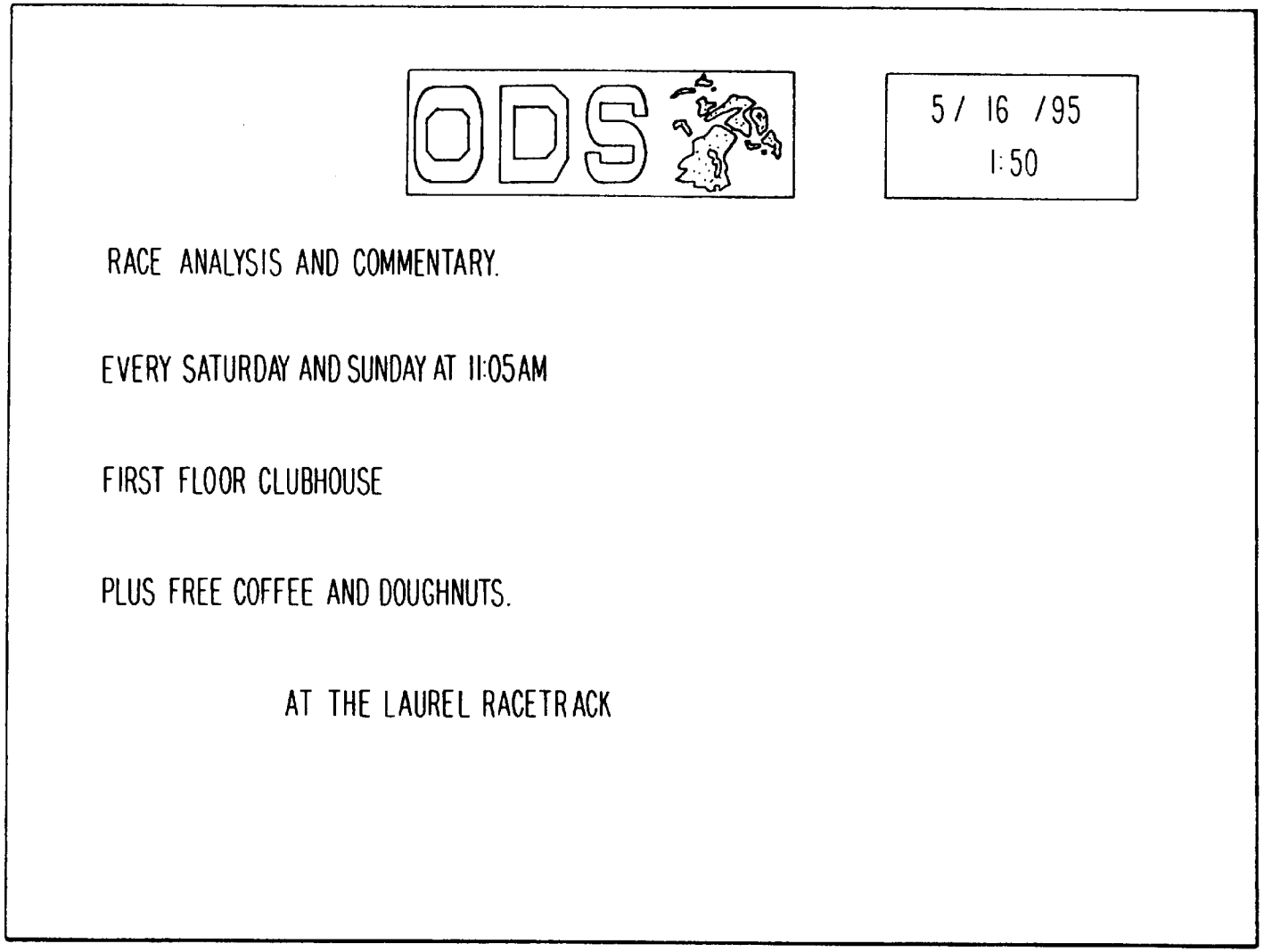

Menu option 360, entitled "handicapping seminar" could be, for example, an advertisement for an upcoming seminar on handicapping techniques to be presented at a particular racetrack. An illustrative handicapping screen is shown in FIG. 26.

Figure 27:
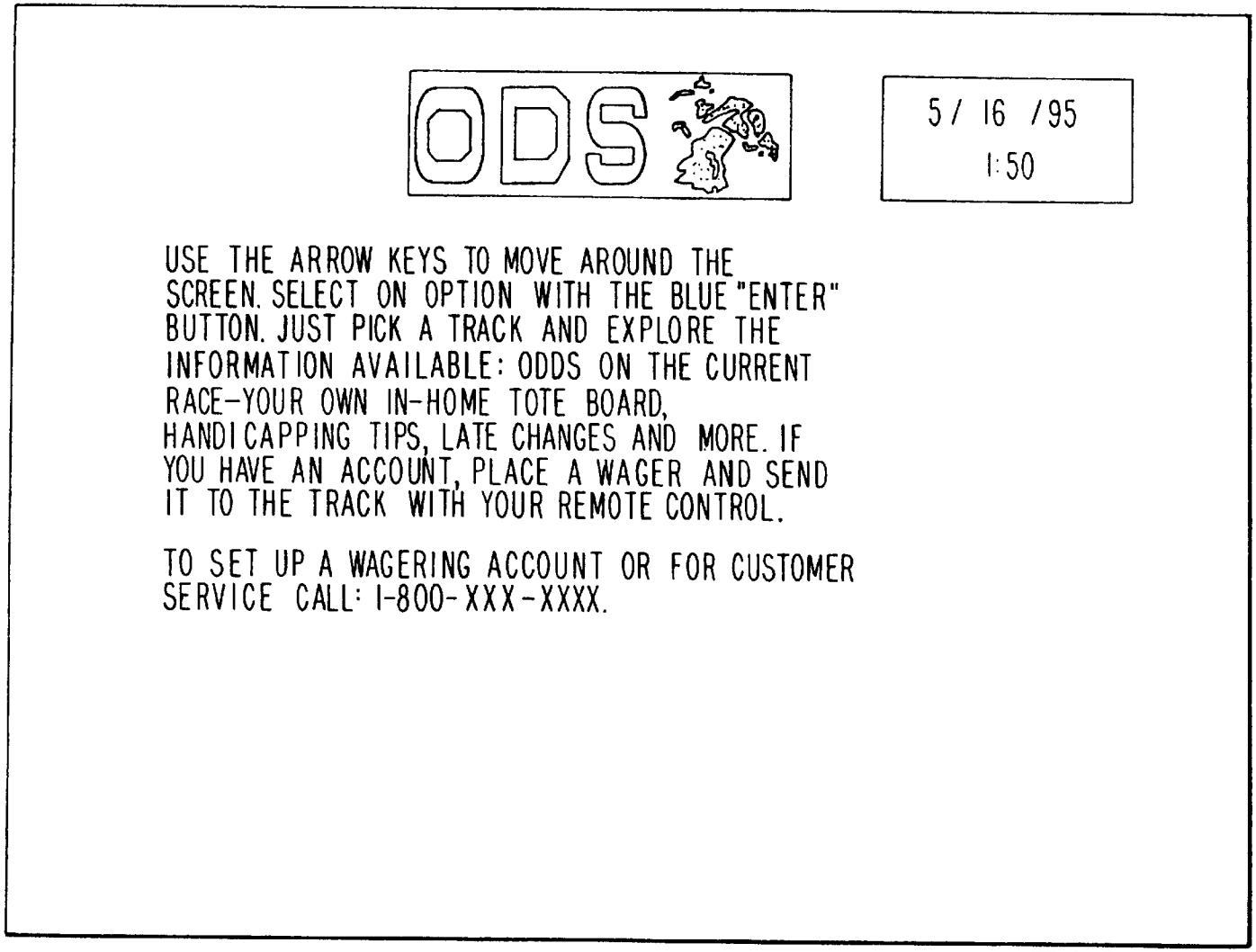
Figure 28:
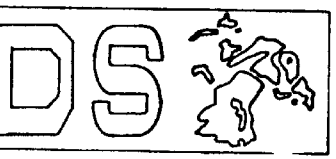

Menu option help 362 allows the system to display help information. For example, explanations of how to use the terminal 122, how to place certain types of wagers, or how to handicap effectively may be provided. A submenu that may be provided after menu option help 362 has been selected includes menu options "using the system," "how to bet," and "handicapping information." FIG. 27 shows a screen that can be displayed if "using the system" is selected. FIG. 28 shows a screen that can be displayed if "how to bet" is selected followed by information on "win, place, and show" bets. Information on additional wager types is preferably available by pressing an advance or equivalent cursor on remote control 156 (FIG. 2). If "handicapping information" is selected from the submenu, then descriptions of the various types of handicapping information available (see, e.g., FIGS. 20–23) are provided. The menu option 364 (FIG. 7) entitled "other" allows additional information to be provided.

The news and information menu options available at step 356 are illustrative only. As explained in connection with descriptions of further embodiments of the present invention, additional features may be added if desired, such as the ability to add video information to the services described above.

If desired, "hot" buttons may be used to provide shortcuts through the menu hierarchy of FIGS. 3–7. For example, a hot button 185 labeled "bet on the next race" may be provided as menu option 185 in FIG. 8. If the user selects this option at step 172 (FIG. 3), the user terminal 122 (FIG. 2) determines which upcoming race is the next race available for wagering. The user terminal 122 (FIG. 2) then presents the user with the option of selecting the wager amount for that race at step 214 (FIG. 3). Hot button 185 therefore allows the user to bypass selection steps 196, 204, and 212 (FIG. 3), which the user would otherwise need to pass through. Preferably, any hot button arrangement of the present invention allows the user to bypass one or more selection steps (also called "menu layers"). Hot buttons thus allow quicker movement though various layers of menus than would otherwise be possible (e.g, using a conventional tree-type menu structure without hot buttons).

Figure 29:
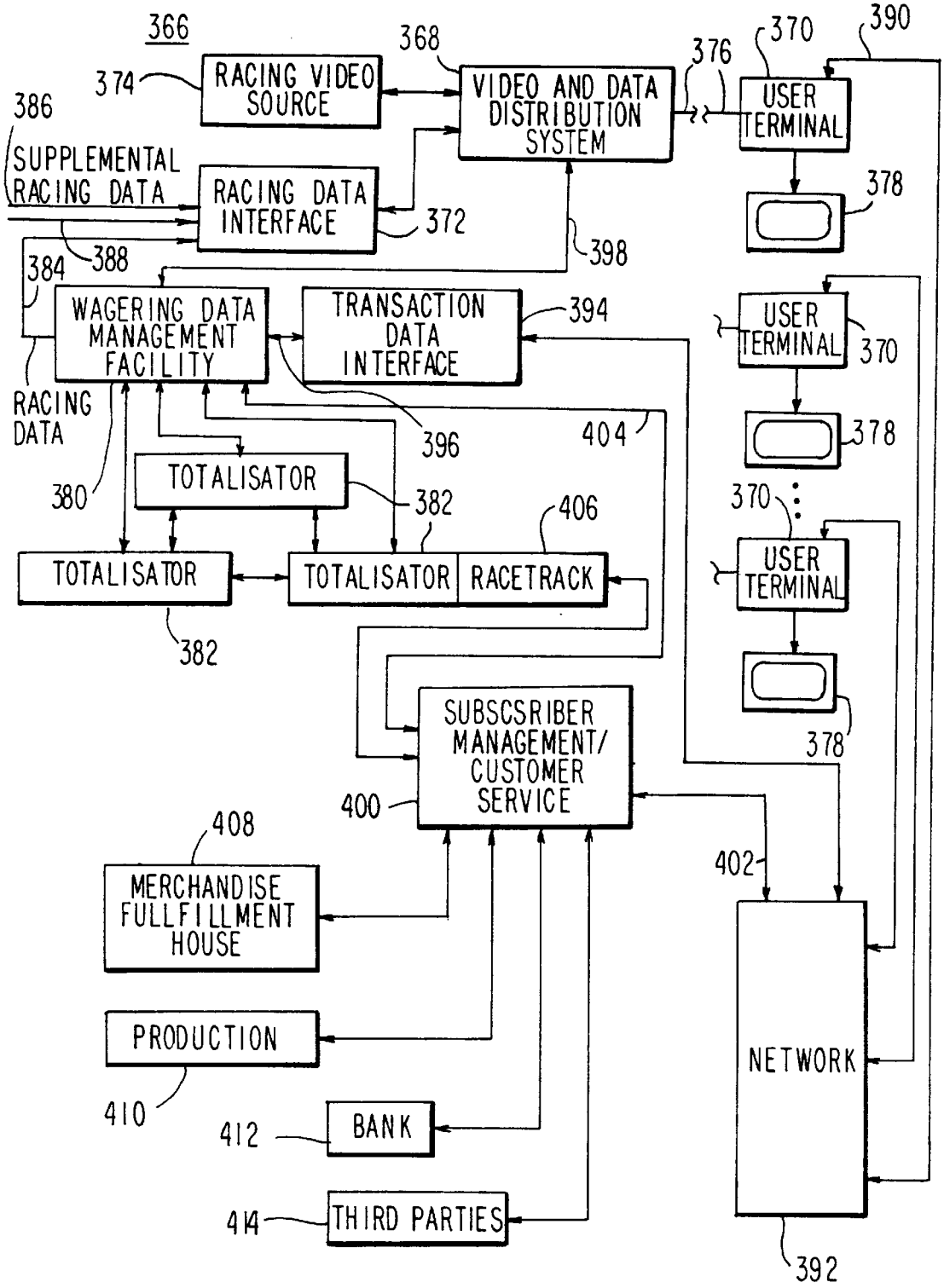
FIG. 29 is a block diagram of an alternative embodiment of a wagering system in accordance with the present invention.

Further aspects of the present invention are illustrated in connection with wagering system 366, shown in FIG. 29. Many features of wagering system 336 may be provided using an arrangement similar to wagering system 100 (FIG. 1), if desired. Wagering system 366 has a video and data distribution system 368 for distributing racing data racing videos to user terminals 370. The video and data distribution system 368 may be based on any suitable conventional distribution technology, such as satellite transmission, cable television transmission, or television broadcasting. Video and data distribution system 368 receives racing data from racing data interface 372. This signal feed typically has a significantly lower data-rate requirement than live video signals. Accordingly, the racing data transmitted from racing data interface 372 to video and data distribution system 368 may use any of a number of available signal distribution technologies. For example, leased telephone lines may be provided between racing data interface 372 and video and data distribution system 368. Alternatively, racing data may be transmitted by satellite at this stage.

Racing videos, which are received from racing video source 374, preferably use a high-capacity transmission medium such as satellite transmission or cable transmission for at least part of the signal pathway between the point of origination of the video signals and video and data distribution system 368. For example, one suitable source of racing videos is the simulcast transmission of video signals from racetracks. These racing videos can be transmitted by a combination of cable and satellite to a centralized racing video source 374, from which the videos may be transmitted to video and data distribution system 368 via satellite. Alternatively, the racing video may be archived on video tape or another video storage medium, so that the racing video source 374 should include suitable video playback equipment (not shown). Archived racing videos can be played back according to a predetermined schedule, or according to viewer demand.

Regardless of the source of the racing video signals provided at racing video source 374, and regardless of the medium used to transmit these videos from racing video source 374 to video and data distribution system 368, the racing videos are preferably available for the user to watch at home while the user simultaneously has access to the racing data provided by racing data interface 372. Because real time racing video clips require the full bandwidth of a television channel (although the video could be compressed somewhat using conventional data compression techniques), data and video link 376 between video and data distribution system 368 and user terminals 370 must at least have the capacity of a single television channel. Preferably, the racing videos are distributed over a dedicated racing channel. Racing data may be distributed using any suitable data distribution technique, such as transmission over a sideband or during the vertical blanking interval of the dedicated channel.

Video and data distribution system 368 includes a cable headend facility, satellite facility, or broadcast facility that preferably supplies a full range of conventional television channels to the user in addition to the capability of providing a dedicated racing channel to the user. When the user desires to watch television, the user can tune to one of these channels. The user can tune to a television channel using a user terminal 370 in conjunction with a monitor 378, which is preferably a conventional television set. If user terminal 370 does not contain a tuner capable of tuning to all of the available channels, or if it is desired to bypass the terminal 370 for other reasons, the user can watch television on monitor 378 directly, provided that monitor 378 includes a television tuner.

Thus, a number of alternative approaches can be used to provide racing videos and racing data to the user. However, a common element to all of these approaches is that video and data distribution system 368 be capable of delivering racing video signals from racing video source 374 to user terminals 370 in realtime. The video and data distribution system 368 also delivers racing data to user terminals 370. Thus, wagering system 366 avoids the shortcomings of previously known systems in which no racing videos could be provided to user-controllable terminals and in which limited racing data were at best provided to off-track terminals via telephone lines.

Racing data are provided by a number of sources, including wagering data management system 380. Wagering and data management facility 380 may be a totalisator such as totalisators 382, or may be a stand-alone computer system capable of communicating with totalisators 382. If desired, wagering data management facility 380 may include an accounting capability for managing user accounts.

The type of racing data provided to racing data interface 372 by wagering and data management facility 380 typically includes the current race at each track, which races and tracks are open for wagering, the post times of each race, and the number of races associated with each track. Racing data also include the win, place and show "pool" totals, exacta, trifecta, quinella and other wager payoff predictions, and the actual odds for the current race at each track, as well as the "morning line" odds for any future race. In addition, racing data typically include the number of minutes remaining until post time for the current race at each track.

Racing data provided by wagering data management facility 380 also include race results, such as actual payoff values versus a standard wager amount for win, place, and show wagers. Also provided are actual payoff values for the winning complex wager types, including exacta, trifecta, quinella, pick-n (where "n" is the number of races involved in the pick-n wager), and daily double. Payoff values may also be accompanied by a synopsis of the associated finish list.

In addition, pools, payoffs, and odds may be provided for other wager types, such as omni bets, superfectas, and double-triple bets.

The racing data from wagering data management facility 380 further include program information including the number of runners in each race, valid wager amounts and types accepted by racetracks, scratch lists, distances of each race, and race surfaces. Program information also includes race classification information, the purse, the allowed age range of runners, and the allowed number of wins and or starts for each runner. Racing data from wagering data management facility 380 are delivered to racing data interface 372 via data link 384, which may be any suitable data transmission medium, such as a leased telephone line, cable, satellite, etc.

Racing data interface 372 also receives racing data via supplemental input 386 and manual input 388. The racing data received at inputs 386 and 388 include racing data from third party information sources such as Axcis Pocket Information Network, Inc. of Santa Clara, Calif. Such third party racing data typically include post times, the number of races associated with each track and other information that typically is only provided via a printed racing program. Weather information, such as track conditions, temperature, humidity, dewpoint, and a short status description of the current weather (sunny, raining, foggy, etc.) may also be provided via inputs 386 or 388.

Wagering data management facility 380 preferably includes the capability of either maintaining a user's account or communicating with a user's account located at one of totalisators 382. Totalisators communicate with one another via the well-known Intertote Track System Protocol (ITSP). Racing fans using user terminals 370, communicate with wagering data management facility 380 via communication lines 390, network 392 and transaction data interface 394.

In accordance with one aspect of the present invention, communication lines 390 are telephone lines, network 392 is a telephone network, and transaction data interface 394 is an automated modem system for receiving incoming transaction data from communication devices contained within user terminals 370. Link 396, which provides a communication pathway between transaction data interface 394 and wagering and data management facility 380 may be any suitable type of communication link, for example, 30 RS-232 data lines. Although a telephone link may be used to provide twoway communications for transaction data (wagers placed, account information, etc.), any suitable communication pathway between user terminals 370 and wagering data management facility 380 may be used. For example, transaction data may be relayed to and from user terminals 370 via data and video link 376, video and data distribution system 368, and communication link 398.

In addition to the various elements described above, wagering system 366 may optionally include a subscriber management/customer service facility ("subscriber facility") 400, which is a computer-based facility for coordinating bank transfers and merchandise orders, handling paperwork required by tax and other regulations, and for supplying marketing information to third parties.

User terminals 370 are linked to subscriber facility 400 via communication lines 390, network 392, and communication line 402, which may be, for example, a leased telephone line. Subscriber facility 400 is linked to wagering data management facility 380 via communication line 404. Additional communication links are formed between subscriber facility 400 and racetrack 406, merchandise fulfillment house 408, production facility 410, bank facility 412, and third parties 414. These links may be formed using any suitable communications medium, such as telephone lines.

Subscriber facility 400 provides wagering system 366 with the capability to implement a variety of marketing and customer service related activities. For example, when the user desires to transfer bank account funds to his wagering account, a transfer authorization can be sent from user terminal 370 to subscriber facility 400 via communication line 402, where, after suitable processing, the transfer request is sent to bank-facility 412. Bank facility 412 may be at the user's bank, or an affiliated bank connected to a banking network capable of authorizing the requested transfer. After bank facility 412 approves the requested transfer of funds, subscriber facility 400 transmits suitable fund transfer instructions to wagering data management facility 380.

Another useful feature that may be implemented using subscriber facility 400 is allowing the user to place merchandise orders from the home. Commercial advertising may be provided with wagering system 366. For example, video advertising clips may be displayed simultaneously with racing videos etc. If a menu option indicates that merchandise, such as racing memorabilia, promotional materials, collectibles, etc. is available, then following step 356 (FIG. 7) the user may interactively place an order for merchandise using wagering system 366. If desired, the user may place merchandise orders against funds located in the wagering account located at wagering data management facility 380 or at the user's account at bank facility 412. Alternatively, the user may place orders using a credit card.

Generally, the information necessary to consummate an on-line purchase of merchandise is well known. This information is collected and disseminated to the appropriate parties by subscriber facility 400. For example, funds verification may be performed by communicating with wagering data management facility 380 or bank facility 412. Merchandise orders may be placed with the racetrack 406 that offered the merchandise, or with merchandise fulfillment house 408.

Subscriber facility 400 may also be used to facilitate monitoring of the usage of user terminals 122. In order to improve the performance of wagering system 366, it may be desirable to determine precisely how various users interact with the various menus etc. that are provided by user terminal 122. User terminals 122 can be programmed to monitor the way in which users interact with the menu structure implemented on user terminals 122. For example, user terminals 122 can monitor how long each user spends at each screen, etc. Periodically, this information may be collected by subscriber facility 400 via communication line 402. This information can be used to improve the performance of the menu structure implemented on user terminals 122, or may be used for marketing purposes (e.g., for direct marketing).

Production facility 410 may be used to satisfy regulatory paperwork requirements for tax and other purposes. In addition, additional or replacement smart cards or user terminals 370 may be ordered from production facility 410.

If desired, a user's personal preferences, such as wagering habits, betting preferences, merchandise orders etc. may be supplied to third parties 414. The user's personal preference data may be transmitted from user terminals 370 to wagering data management facility 380 during the placing of wagers. Later, wagering data management facility 380 transmits the personal preference data to subscriber facility 400, from where the data may be provided to, e.g., third parties 414.

Figure 30:
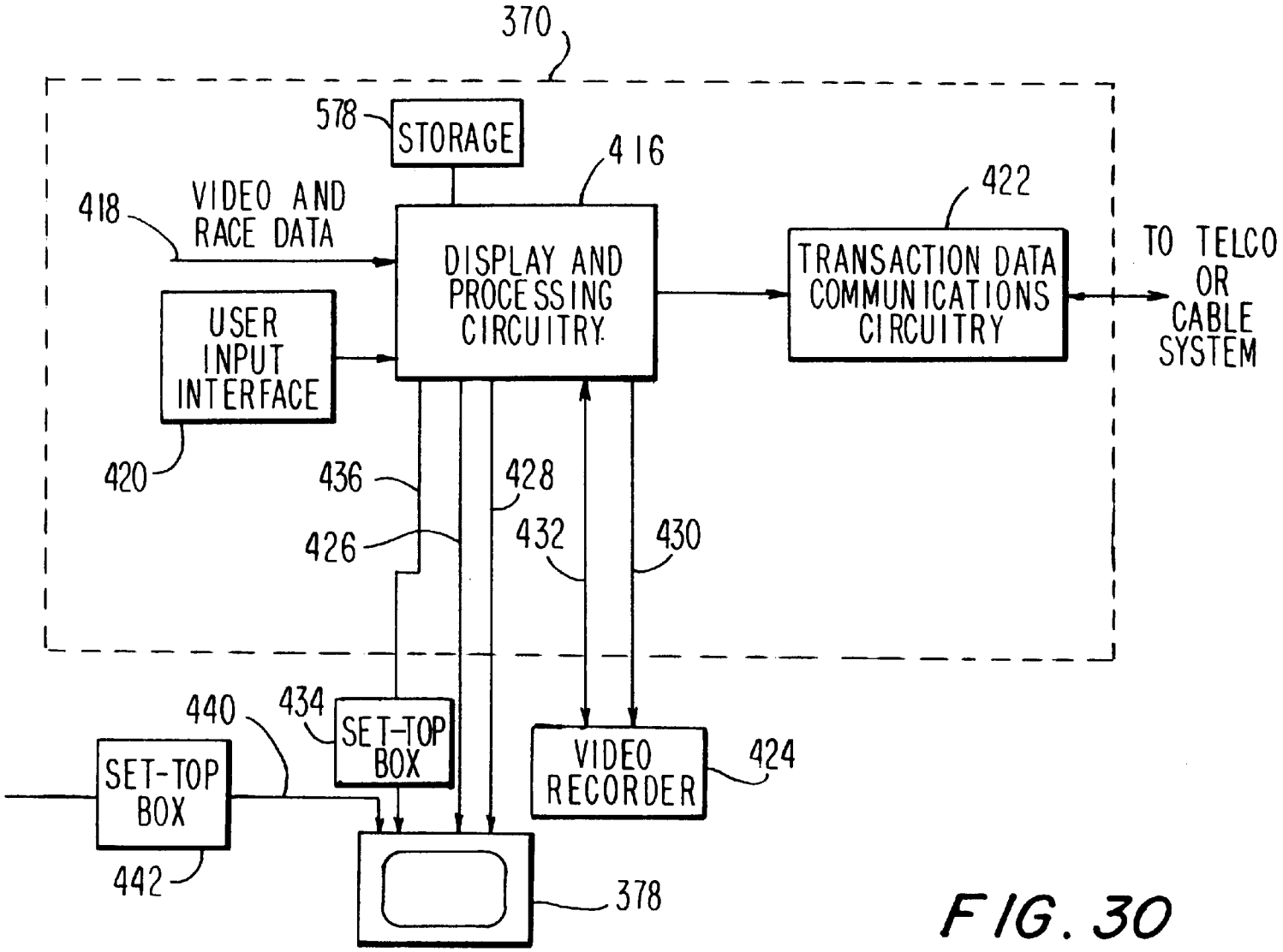
FIG. 30 is a block diagram of a user terminal suitable for use with the wagering system of FIG. 29.

A typical user terminal 370 is shown in FIG. 30. User terminal 370 has display and processing Circuitry 416, which receives racing data and realtime video signals including videos from racing video source 374 via video input 418. The user enters commands with user input interface 420, which may be any suitable input interface, such as a remote control, keyboard, a conventional voice-actuated controller system, etc. Display and processing circuitry 416, which is preferably microprocessor-based, coordinates the display of the racing data and videos on monitor 378 and the recording of videos on video recorder 424. User terminal 370 also has transaction data communication circuitry 422 (e.g., modem circuitry) for communicating transaction data to wagering data management facility 380 (FIG. 29) and subscriber facility 400 (FIG. 29).

As is well known, set-top converters, video cassette recorders, audio/video receivers, and other audio/video equipment may be interconnected in a variety of ways. For example, some audio/video components receive a full range of television channels on a radio frequency (RF) input line, and output a selected channel or other video signal on an RF channel such as channel 2, 3, or 4. An output provided on an RF channel must be processed by a television tuner tuned to that channel. Accordingly, this type of arrangement is suitable for audio/video equipment that is connected to an audio/video component having a television tuner (e.g., a conventional television set). Some audio/video equipment provides direct video and audio signal outputs, which may be received by a monitor or other audio/video component that does not have a television tuner.

In accordance with the present invention, the racing videos and data received via input 418 are typically received along with a complete range of television channels. In one suitable arrangement, the racing videos are provided on one or more dedicated channels and the racing data can be provided in an available region of bandwidth within these channels (e.g., on a frequency modulated sideband). If the racing videos and data are provided over a digital video channel (e.g., as used with certain television satellite systems), the video signals occupy one portion of the digital signal and the racing data another. Display and processing circuitry 416 contains circuitry for separating out the racing data from the video signals. Racing data are Processed by display and processing circuitry 416 so that various menus of options and data may be displayed. Racing videos and the menu displays can be provided to monitor 378 via RF output 426 or video and audio output 428.

Because cable channels are often scrambled, display and processing circuitry 416 may also contain suitable circuitry for descrambling the cable (or satellite) television channels to which the user subscribes. Alternatively, the user may attach a conventional set-top cable converter unit to their television, for use in conjunction with user terminal 370.

Further, various different connections are possible with video recorder 424. If video recorder 424 is a conventional video cassette recorder, video output 430 may be an RF output or a video and audio output. If video recorder 424 only contains recording components and not a television tuner, then an RF output would not be suitable. In that case, video output 430 is preferably a video/audio output rather than an RF output.

Commands from display and processing circuitry 416 are provided to video recorder 424 over communication path 432. Communication path 432 may be a direct electrical connection to video recorder 424 or may use an infrared output circuit coupled to the infrared input of video recorder 424. If desired, video recorder 424 may be provided with the capability of providing as an output video recorder status data regarding the state of video recorder 424 (e.g., tape inserted, play/record confirmed, index data on tape read/confirmed, etc.). The video recorder status data may be provided to display and processing circuitry 416 over communication path 432. Video recorder 424 may also be provided with a dedicated set-top converter box (such as shown connected to monitor 378 in FIG. 30). The set-top converter box may be provided downstream from the other components of user terminal 370 or may be provided as a completely separate input.

In the illustrative example shown in FIG. 30, set-top box 434 is provided midway between display and processing circuitry 416 and monitor 378. With this arrangement, line 436 is preferably an RF line. Another way in which television signals may be provided to monitor 378 is to provide additional RF or video/audio input 440 to monitor 378. If desired, descrambling on this line may be performed by set-top box 442. Switching between the desired audio/video and RF inputs to monitor 378 may be performed by circuitry within monitor 378, if desired.

If an audio/video receiver is also connected to the user's home system, further options are available. For example, the audio/video receiver (not shown) may be used to switch the various audio and video signals shown in FIG. 30. RF video signals may be switched using suitable RF switching equipment.

Thus, there are numerous suitable ways in which to arrange and interconnect various home audio/video components and user terminal 370. The particular arrangement chosen for user terminal 370 is not limited to any one setup. For example, monitor 378 may be a conventional television with an integral television tuner or may be any other suitable display monitor. Video recorder 424 may be a conventional video cassette recorder or may contain a status data output in addition to the components necessary to perform video recording and playback. One or more set-top boxes 442 or 434 may be provided. An audio/video receiver or RF signal switching and splitting circuitry may be connected to user terminal 370. Any of these components may be provided as a separate audio/video component or may be made integral with user terminal 370.

Figure 31:
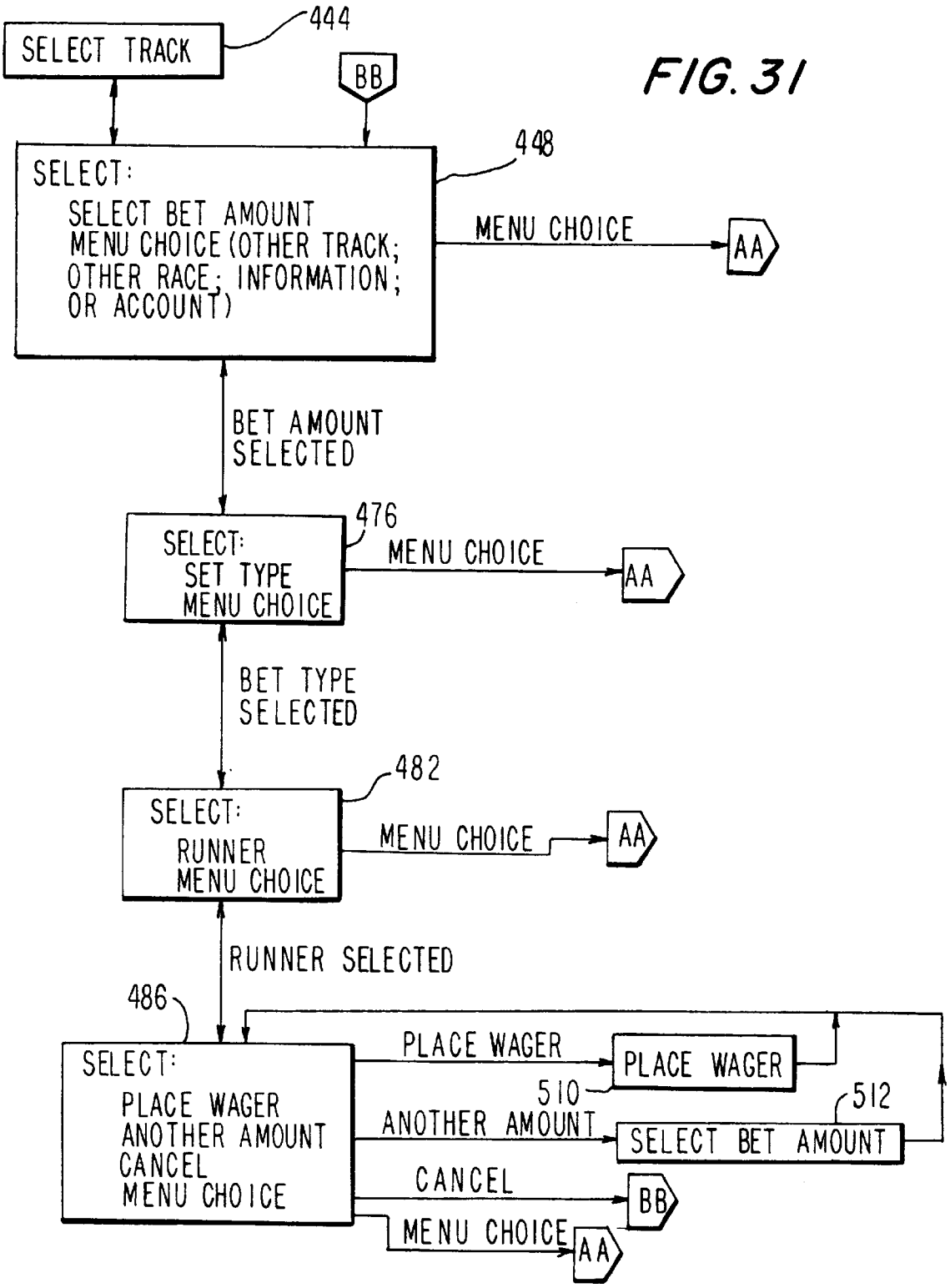
FIGS. 31–34 are logic flow diagrams illustrating the operation of the wagering system of FIG. 29.
Figure 35:
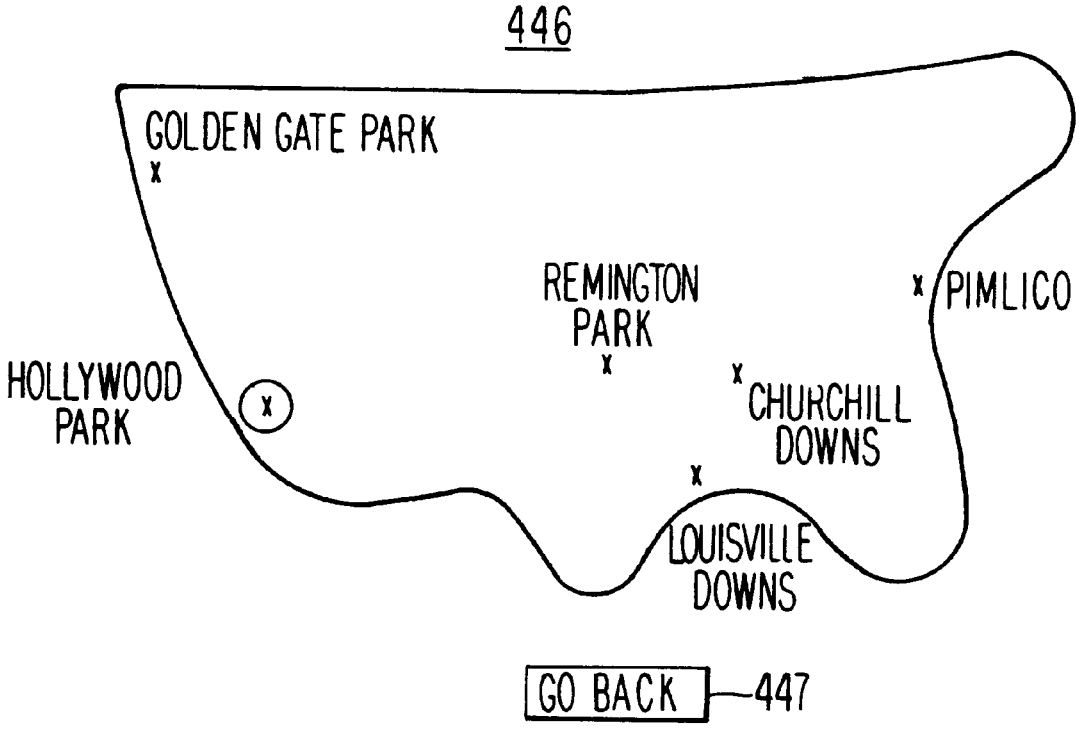

Wagering system 366 (FIG. 29) may be used to provide a variety of interactive wagering features. In accordance with one aspect of the present invention, when the user invokes wagering system 366 (e.g., by entering an appropriate command via user input interface 420 (FIG. 30), the user is presented with an initial racetrack selection menu at step 444, as shown in FIG. 31. A suitable format for the racetrack selection menu is a list highlighted to show the current selection. Another suitable format for the racetrack selection menu is map menu 446, shown in FIG. 35. With this approach, the various available racetracks are displayed on a map, e.g., of the United States. The currently selected racetrack (Hollywood park in FIG. 35) is highlighted. Preferably, the user can select a racetrack using cursor keys to move up/down and right/left until the highlighted portion is positioned on the desired racetrack. The user may then press enter to select that track. As shown in FIG. 35, map menu 446 preferably has go back button 447. If the user selects go back button 447, the user is returned to the previous menu. In addition to serving as a menu for track selections, a format similar to that of map menu 446 may be used to allow the user to make other selections, such as when choosing a region of the country from which racing or other information (e.g., commercial advertising) is desired. Map menu 446 may be highlighted using any suitable technique, e.g., using an icon.

Figure 36:
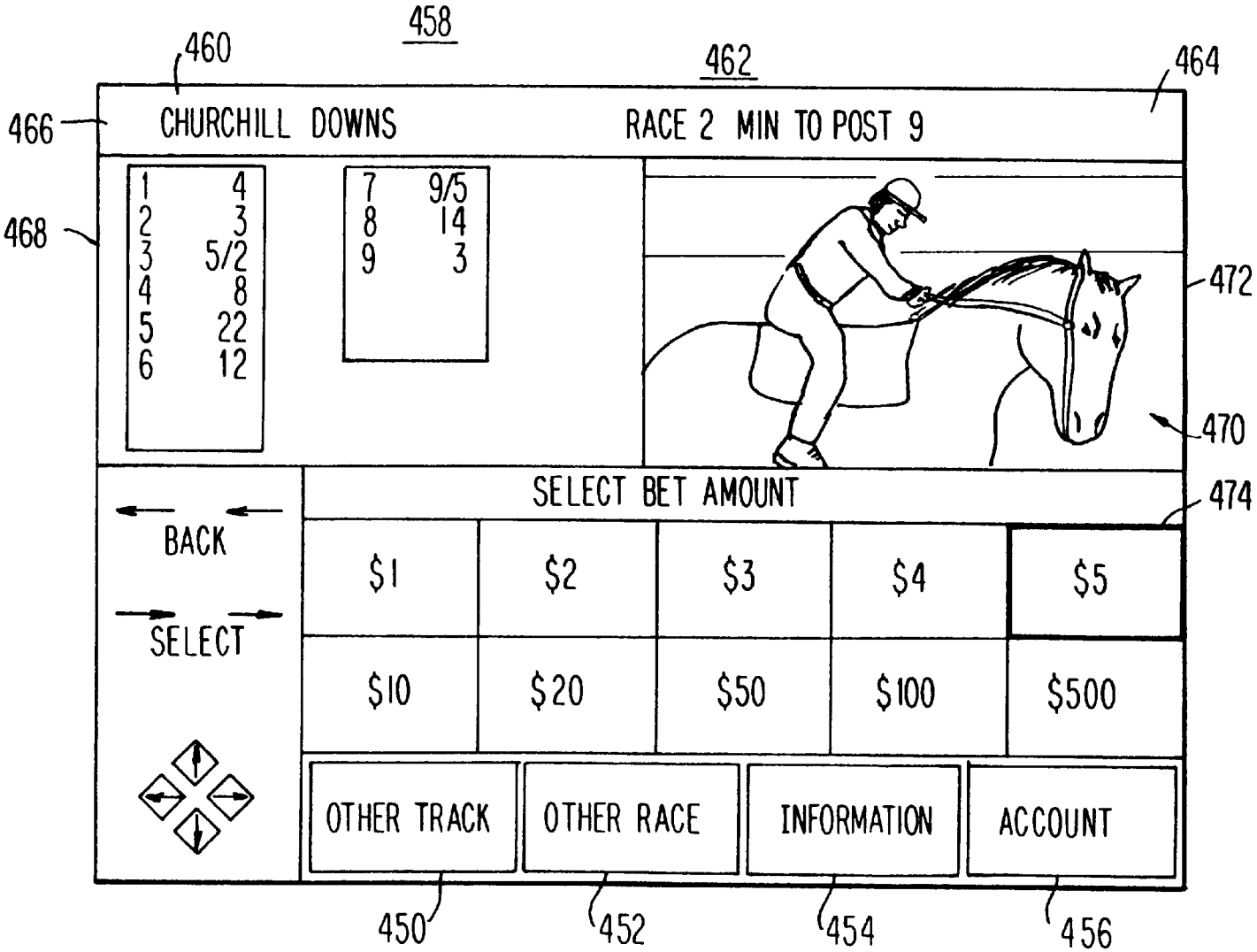

After a racetrack has been selected at step 444 of FIG. 31, the user decides whether to select a wager amount or make a menu choice at step 448. The term "menu choice" used in connection with FIGS. 31–34 includes: "other track," "other race," "information," and "account." In accordance with the present invention, menu choices other track 450, other race 452, information 454, and account 456 are displayed on a screen 458 of mixed text and video, as shown in FIG. 36. Preferably, menu options appear at the bottom of screen 458. The currently selected racetrack 460 (Churchill Downs), race no. 462 (race 2) and time until post 464 (nine minutes) appear in a banner 466 at the top of screen 458. The default for the currently selected race is the next race scheduled to be run at the selected racetrack. Current odds or other useful racing information items appear in box 468.

In addition, a realtime racing video 470 is simultaneously displayed in box 472. Preferably, racing video 470 is a simulcast from the selected racetrack corresponding to the next scheduled race. Typically, race previews are shown prior to each race. These previews may contain views of the racetrack, fans, and runners, interviews with jockeys and trainers, and commentary. At post time, the video of the race itself is shown. If no racing videos are available at the selected track, box 472 can contain a video clip of races at other tracks or can contain advertising information, etc.

The arrangement of screen 458 allows the user to gauge how much time is left to place a wager by viewing the time until post 464, and viewing racing video 470. Current odds may be readily reviewed at box 468. With screen 458, the user can watch racing previews and race videos in realtime, while wagering on races interactively.

In step 448 of FIG. 31, the user selects a bet amount by moving highlighted portion 474 (FIG. 36) to the desired dollar amount ($5 in FIG. 36). With any screen such as screen 458 (FIG. 36), the user can make a desired selection using input interface 420 (FIG. 30). For example, if user input interface 420 (FIG. 30) includes an infrared remote control and receiver, the user can press a "select" or "enter" key on the remote control to make a selection.

Figure 37:
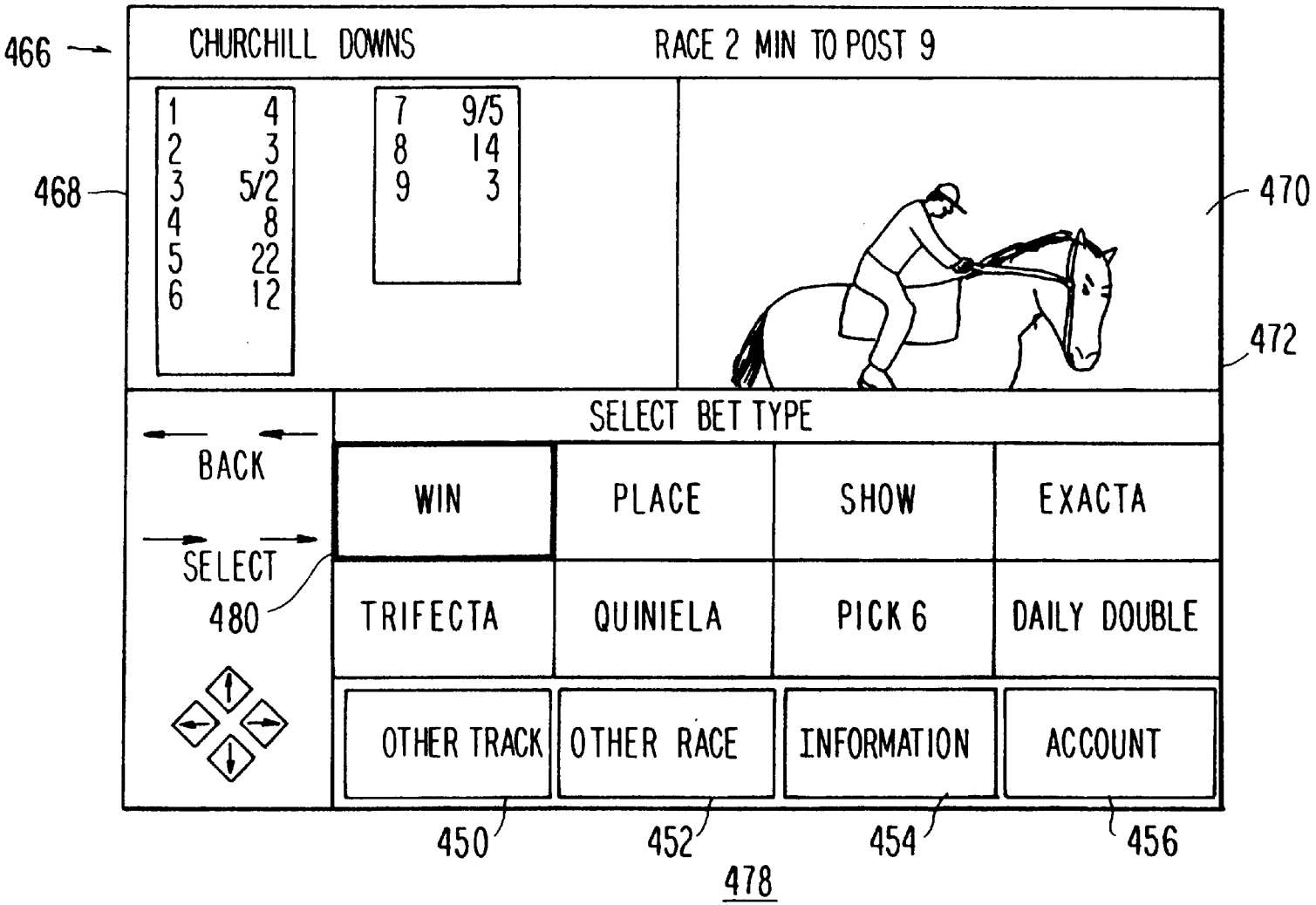

After selecting a bet amount at step 448 of FIG. 31, the user is passed to step 476, in which a bet type or a menu choice is selected. The bet type can be selected using a screen such as screen 478 in FIG. 37. As shown in FIG. 37, many of the display features of screen 458 (FIG. 36) remain unchanged as the user moves from step 448 (FIG. 31) to step 476 (FIG. 31). For example, banner 456 is unaffected, as are menu choices other track 450, other race 452, information 454, and account 456. Box 468 (which contains odds) and box 472 (which contains racing video 470) are also unchanged from step 448 (FIG. 31) to step 476 (FIG. 31). An advantage of providing screens that do not change excessively from step to step is that the user is less likely to be confused, and can find menu options more readily with this approach.

The user selects a bet type such as a win bet by moving highlighted portion 480 to the win bet and selecting it, e.g, by entering the appropriate command with user input interface 420 (FIG. 30).

Figure 38:
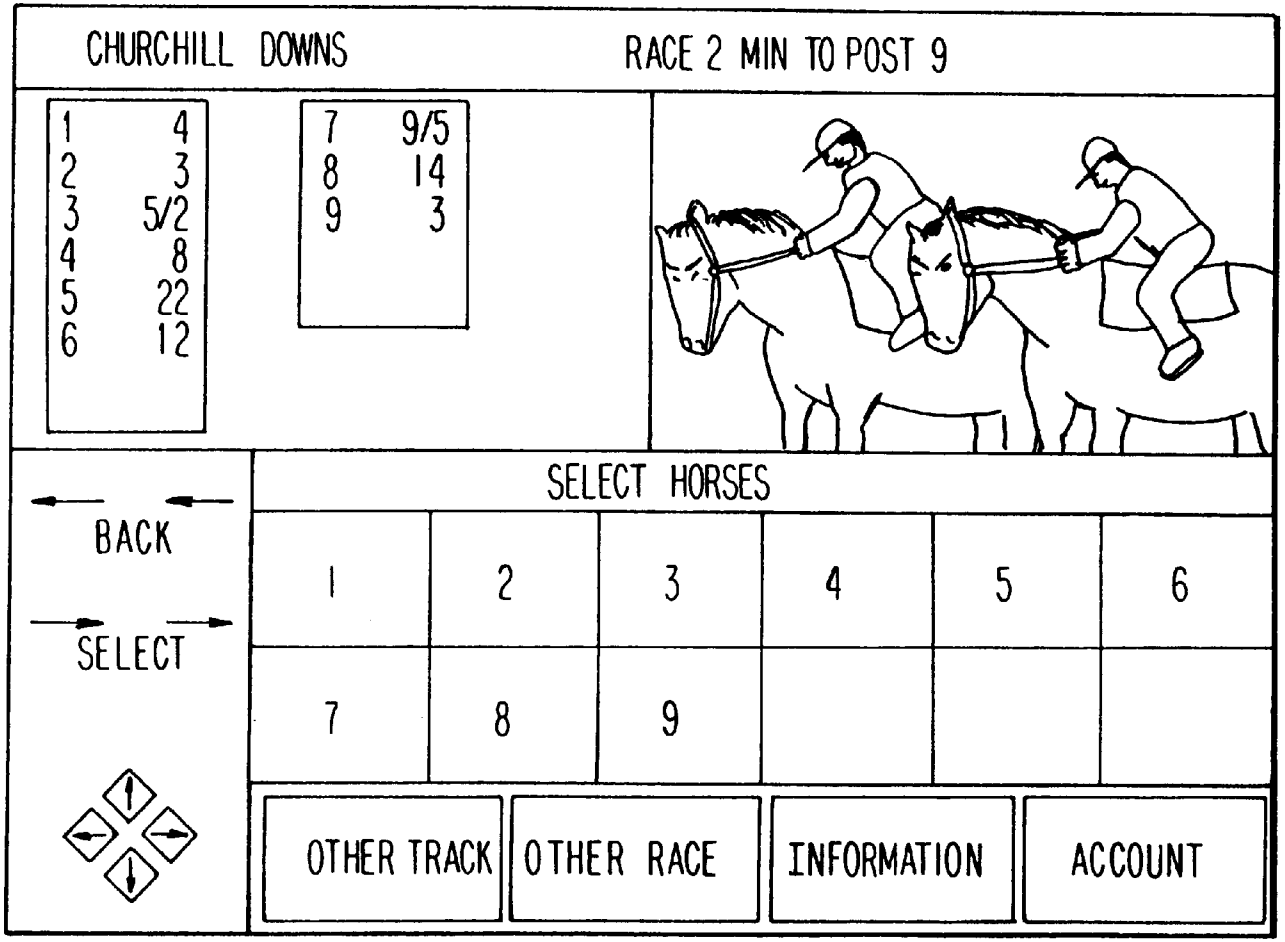
Figure 39:
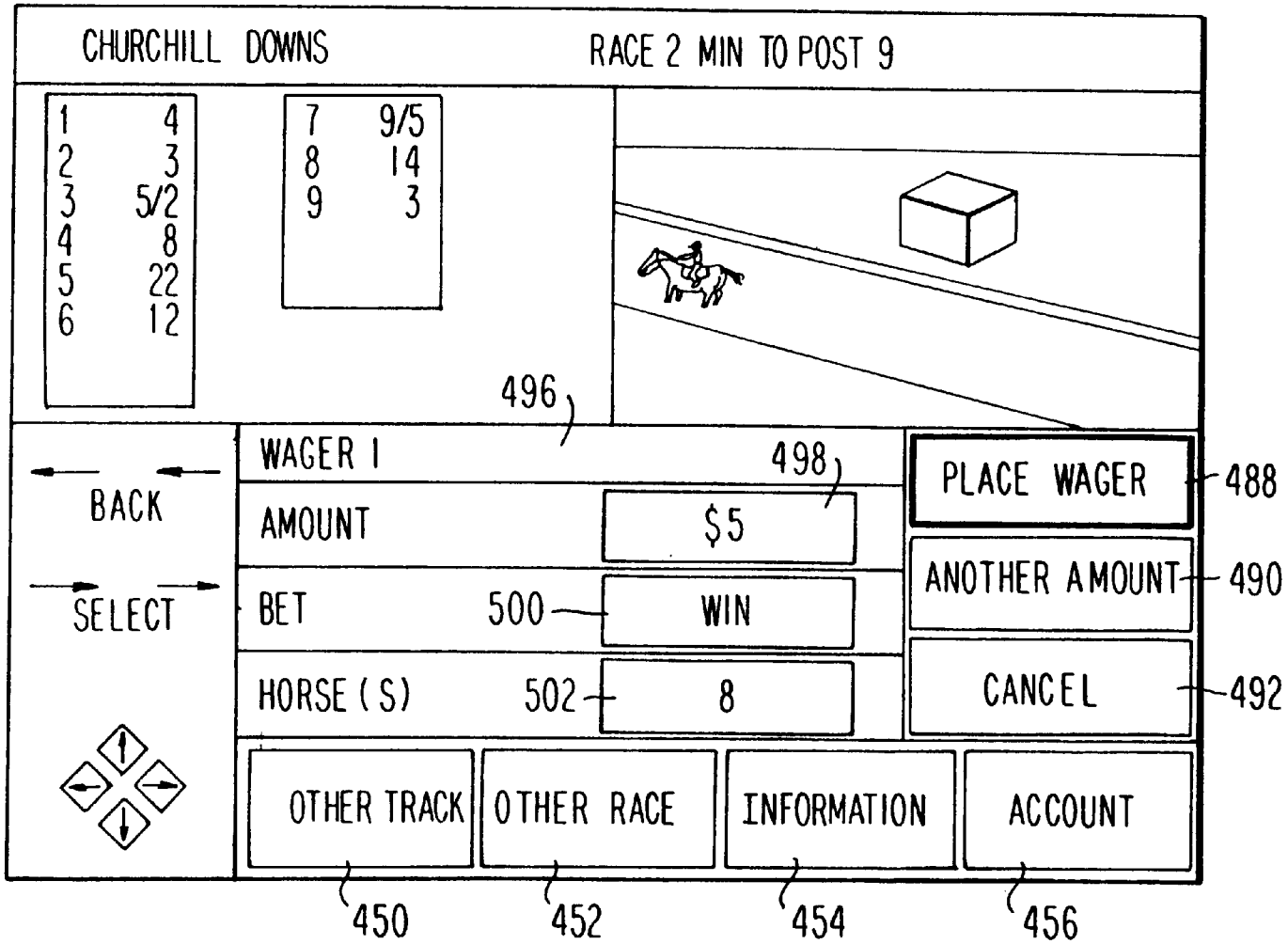

After selecting the bet type at step 476 of FIG. 31, the user is presented with a runner selection menu at step 482. A suitable screen format for the runner menu is given by screen 484 in FIG. 38. Having selected the number of runners either required or allowed for the selected bet type, the system proceeds to step 486, at which the user is presented with the menu options place wager 488, another amount 490, and cancel 492 in addition to the menu choices 450, 452, 454, and 456 listed at the bottom of screen 494 in FIG. 39. Also displayed on screen 494 are wager number 496, wager amount 498, bet type 500 for the wager selected in steps 448, 476, and 482.

If the option place wager 488 is selected, wager transaction data corresponding to the selected wager is transmitted from user terminal 370 (FIG. 29) to wagering data management facility 380 (FIG. 29) at step 510 (FIG. 31).

Figure 40:
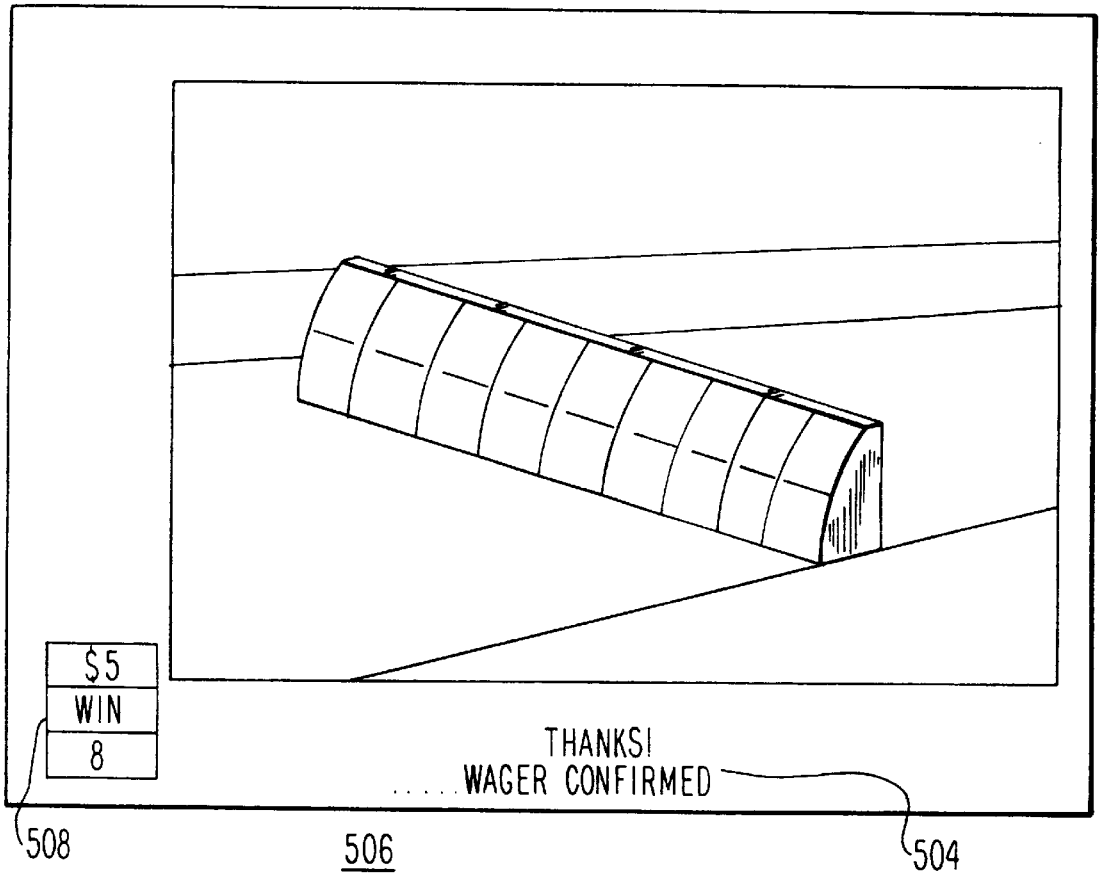

Following a brief screen in which the user is alerted that the wagering transaction is being sent (e.g., with the message "sending wager"), a confirmatory message, such as message 504 is displayed on screen 506, as shown in FIG. 40. Preferably, as the simulcast of the selected race approaches post time, the screen format assumes the larger, nearly full-screen size of screen 506. The racing video is shown in the central portion of screen 506. A relatively small portion 508 of the screen 506 is used to display the selected bet amount, bet type, and runner(s).

If the user selects another amount 490 (FIG. 39) at step 486 of FIG. 31, then the user can select a new bet amount at step 512 (using a menu such as screen 458 of FIG. 36). Selecting cancel 492 (FIG. 39) returns the user to step 448.

Figure 32:
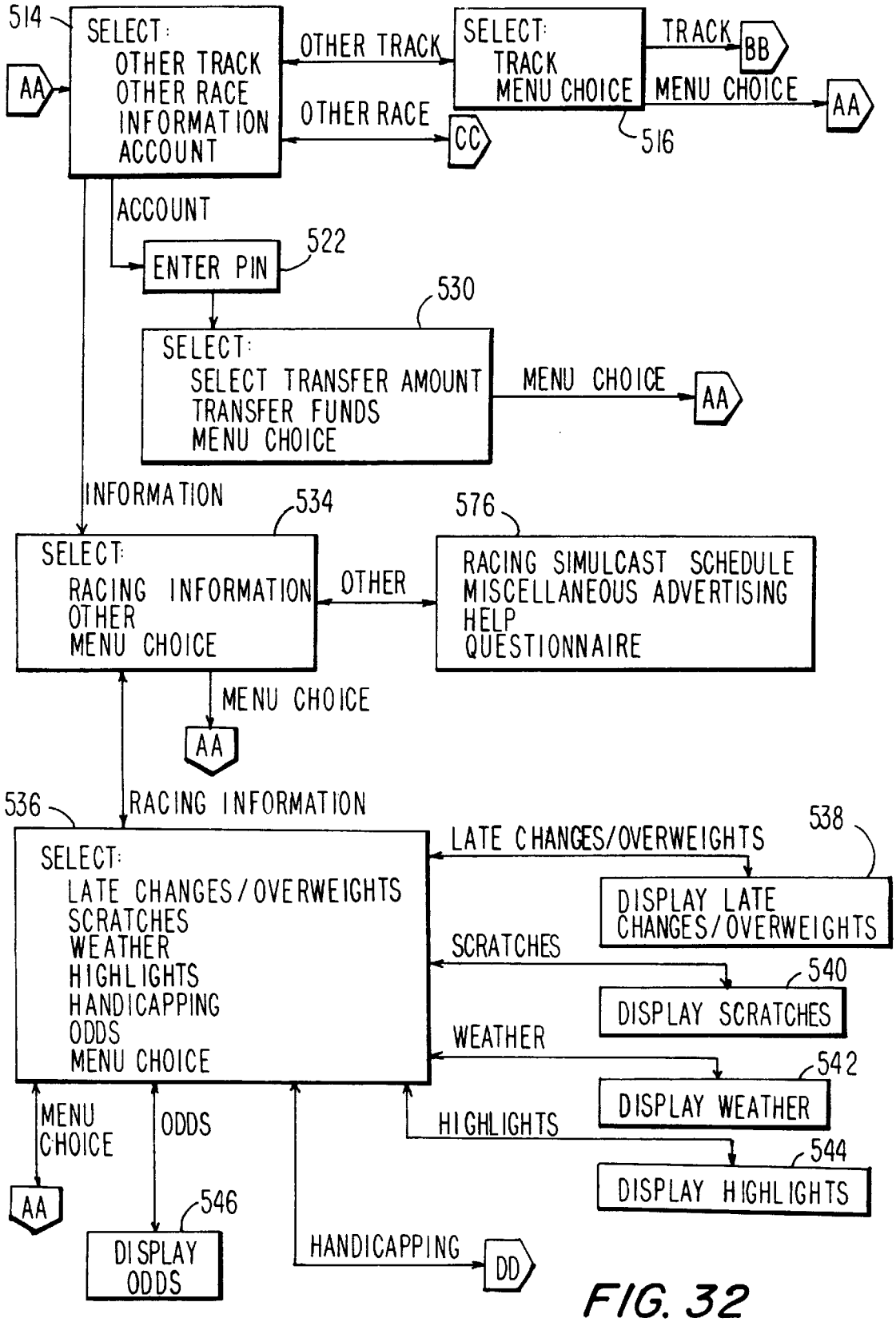
Figure 41:
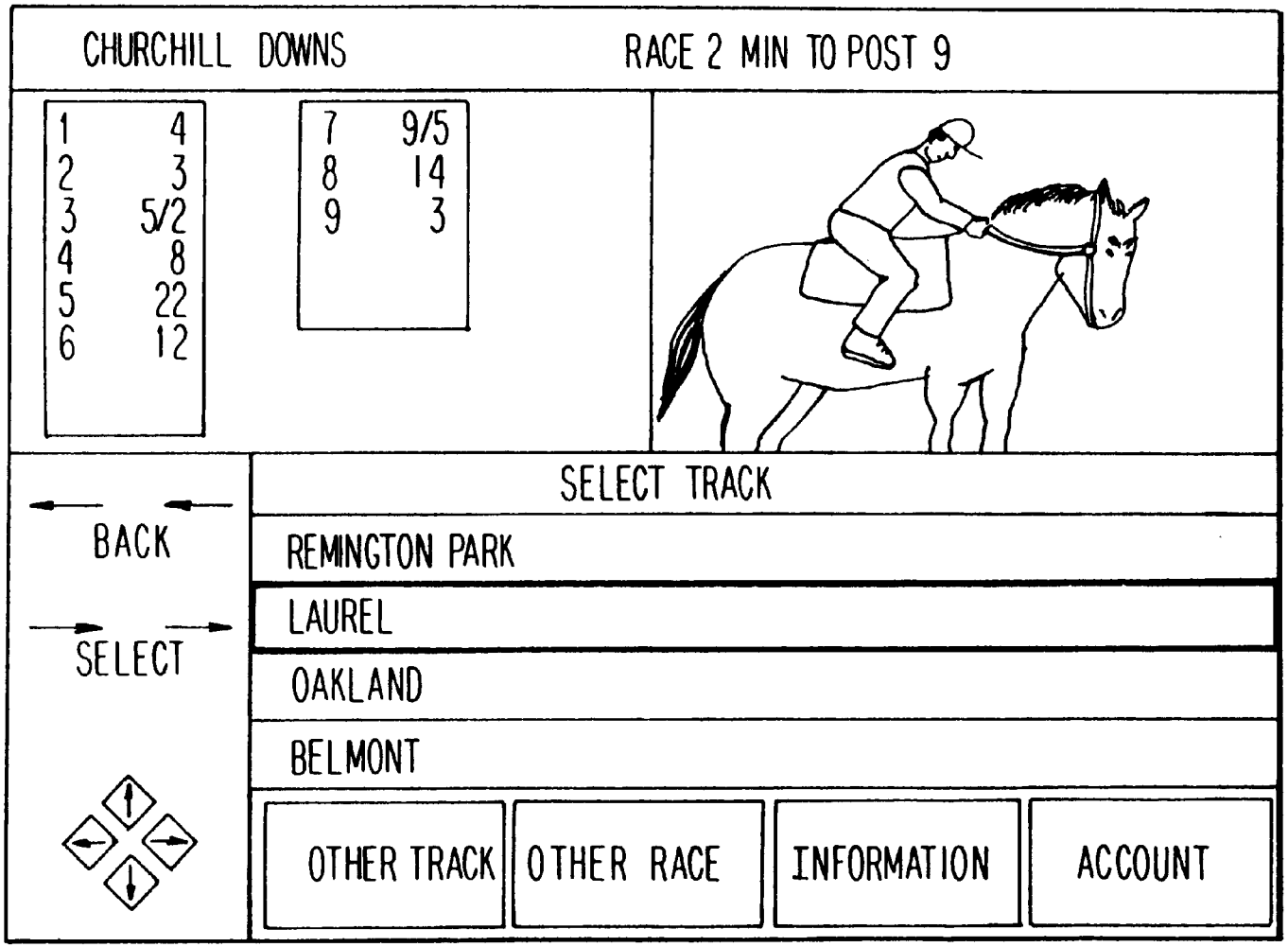

The results of selecting one of the "menu choices" (other track, other race, information, or account) from step 448, 476, 482, or 486, are shown in FIG. 32. If "other track" is selected at step 514, then the user is presented with the menu choices "track" and "menu choice" at step 516. A suitable menu format for selecting a new track is a format such as used for screen 518 in FIG. 41. If a "menu choice" is made, the user returns to step 514.

Figure 42:
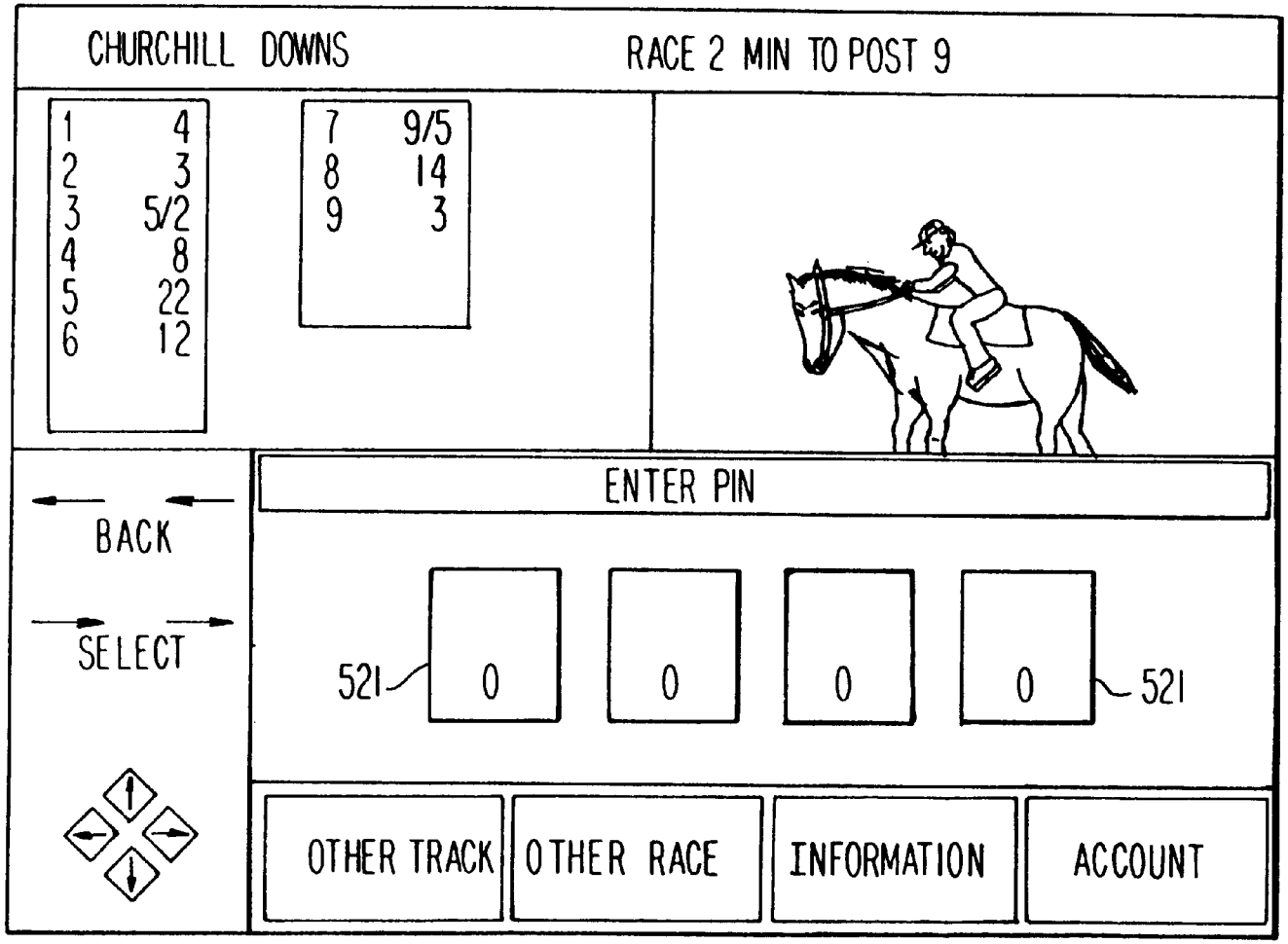
Figure 43:
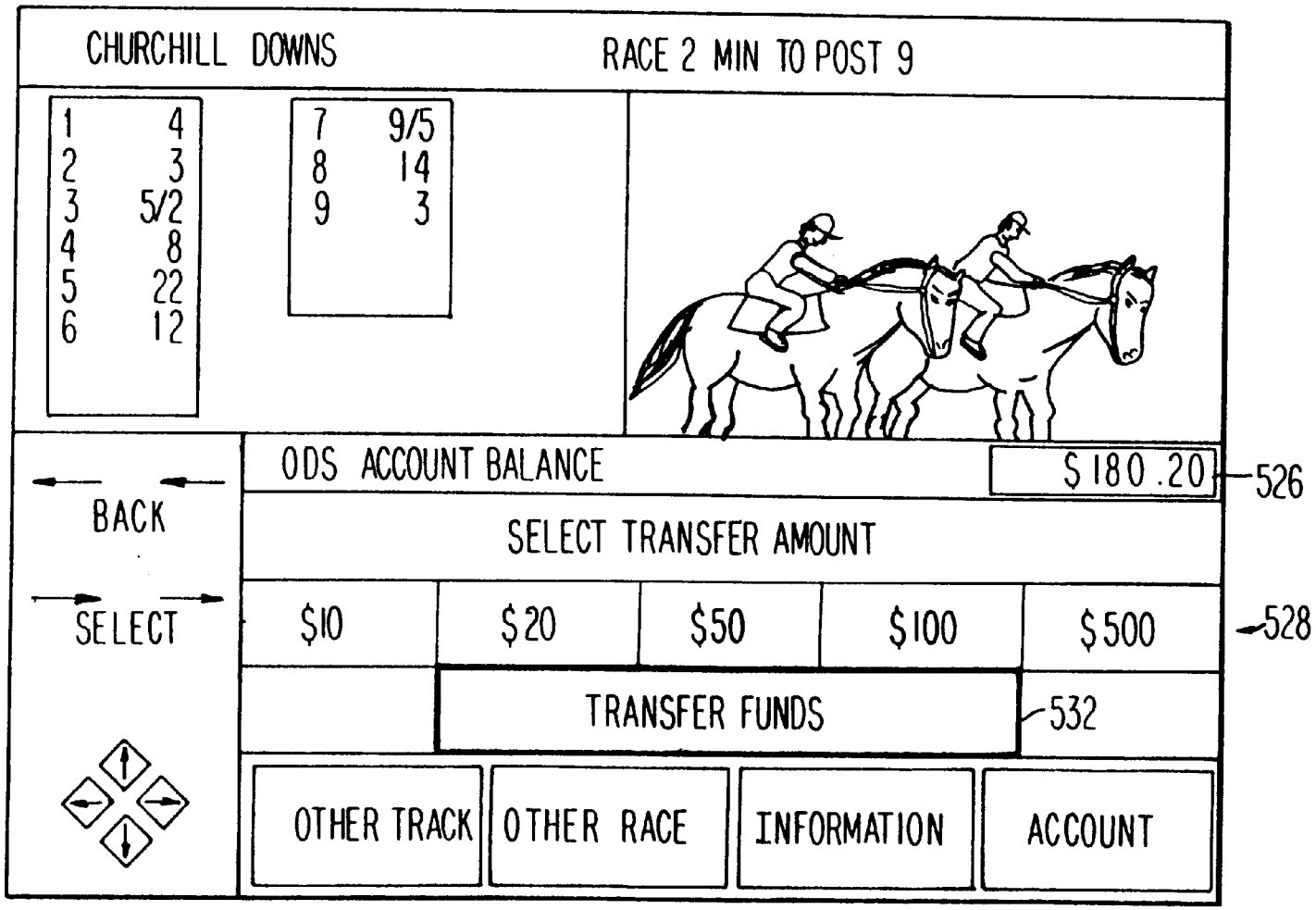

If "account" is selected by the user at step 514, the user is presented with a menu such as screen 520 of FIG. 42, which prompts the user to enter his personal identification code. The user enters the personal identification code at step 522 (FIG. 32) with user input interface 420 (FIG. 30). During the process of entering the personal identification code, boxes 521 change color to indicate when each code element (e.g. digit) is entered. After the personal identification code has been entered, screen 524 is displayed, as shown in FIG. 43. In screen 524, the user's account balance 526 is shown (as obtained, e.g., from the wagering data management facility 380 of FIG. 29). Also displayed is a menu of fund transfer amounts 528. At step 530 (FIG. 32) the user selects the desired amount of funds to transfer from bank facility 412 (FIG. 29) to his account at wagering data management facility 380 (FIG. 29) by highlighting menu option transfer funds 532 (FIG. 43). Following this selection, a confirmatory message, such as "bank transfer" is displayed. Account balance 526 is updated to reflect the new balance, once the transfer is complete.

Figure 44:
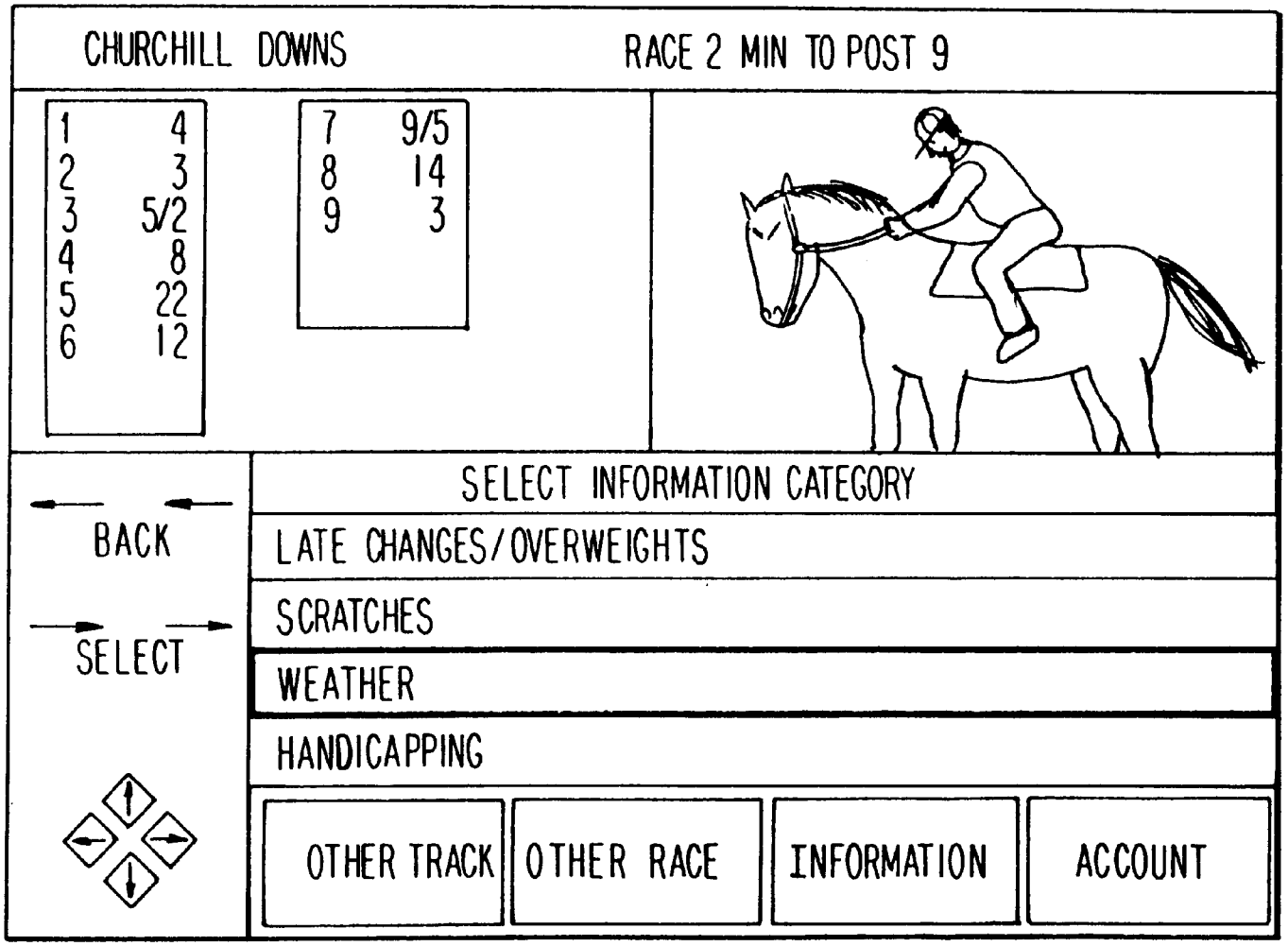

If the menu option "information" is selected at step 514 in FIG. 32, the user is given the opportunity to select from the menu options "racing information," "other," and "menu choice" at step 534. If "racing information" is selected, then the user is presented with a list of menu options at step 536. A suitable menu format for displaying the step 536 menu options is screen 538 (FIG. 44), which allows the user to highlight the desired menu option. Four options are listed in the information category portion of screen 538 (FIG. 44). To see additional listings, the user cursors down or up to scroll or page through the listing.

If the option "late changes/overweights" is selected at step 536 of FIG. 32, then a list of late changes and overweights is displayed at step 538. Scratches are displayed at step 540, when "scratches" is the selected menu option. At step 542, weather information is displayed when that option is selected at step 536. Racing highlights are displayed at step 544 if "highlights" is selected at step 536. Odds are displayed at step 546 if the menu option selected at step 536 is "odds." In addition, scratches are preferably noted on the screens that contain runner numbers (e.g., by the notation "scratch" adjacent to the appropriate runner number). Odds may be displayed using the traditional fractional format (e.g., 9/5) or may be displayed using a percentile format (e.g., 5.0%), as shown in FIG. 45.

Another category of racing information that may be viewed is handicapping information. To view handicapping information, the user selects "handicapping" at step 536. Making the selection "handicapping" moves the user to step 548 in FIG. 33, at which the user chooses between viewing handicapping data and creating a personal power rating. If the user selects "view handicapping data," various handicapping data screens are displayed, showing, for example, snapshot power ratings, speed/class ratings, pace ratings, and jockey/trainer information at step 550.

Figure 33:
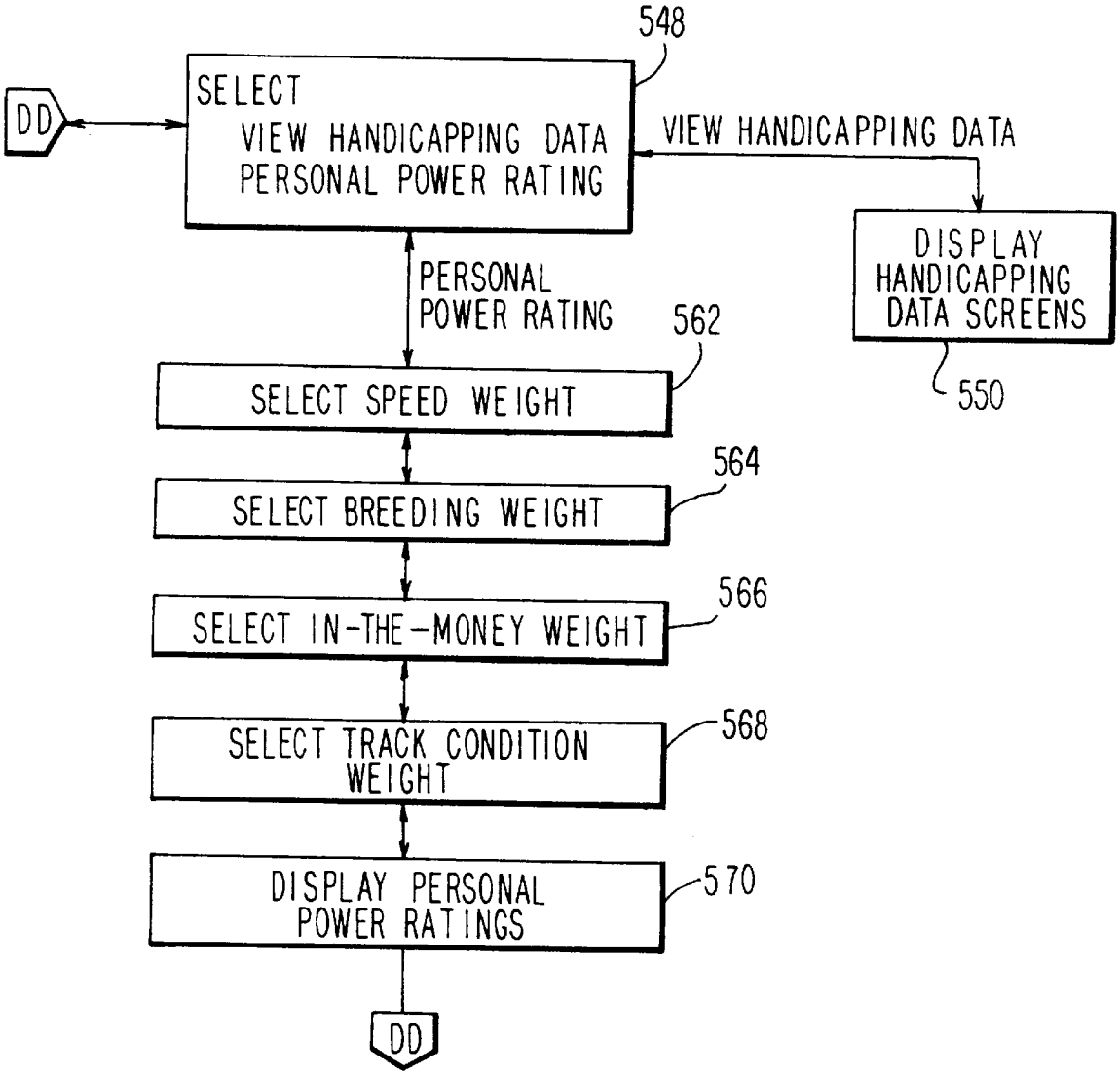
Figure 46:
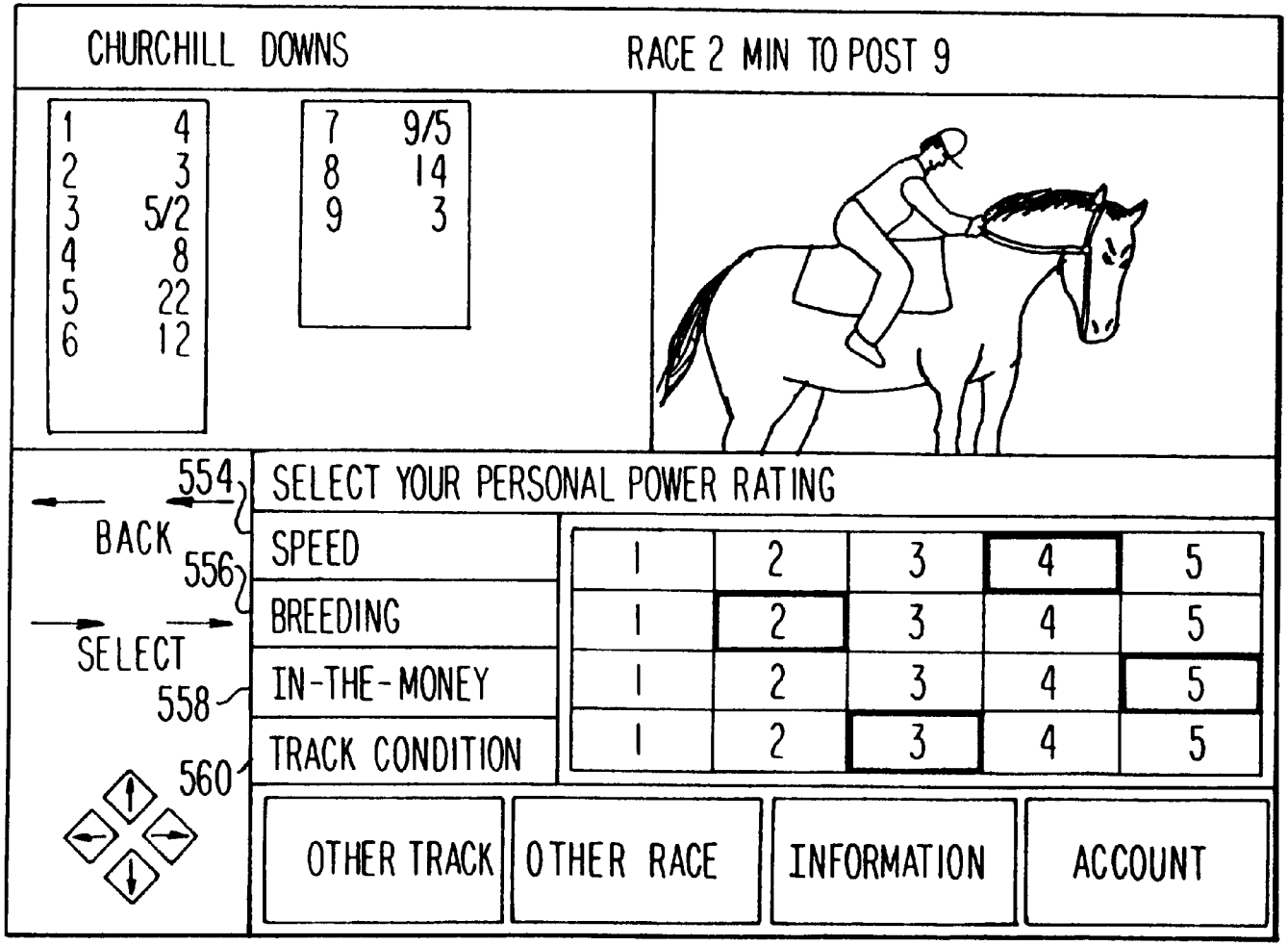

If "personal power rating" is selected at step 548 (FIG. 33), the user is presented with an opportunity to create his own personal power rating, by entering weights for various handicapping categories. As shown in FIG. 46, a menu of options is preferably displayed using a screen format such as used for screen 552. Handicapping categories include, but are not limited to, speed 554, breeding 556, in-the-money 558, and track condition 560. The current odds (e.g., the win odds) for each runner may also be included as a handicapping category, if desired. Weights are entered by moving a highlighted portion of screen 552 to the desired weight and selecting the highlighted weight with user input interface 420 (FIG. 30). The desired weight for the speed category is selected at step 562 (FIG. 33). The weights for breeding, in-the-money and track condition are entered at steps 564, 566, and 568 (FIG. 33), respectively. The weights chosen on screen 552 of FIG. 46 are: speed 4, breeding 2, in-the-money 5, and track condition 3.

Figure 47:
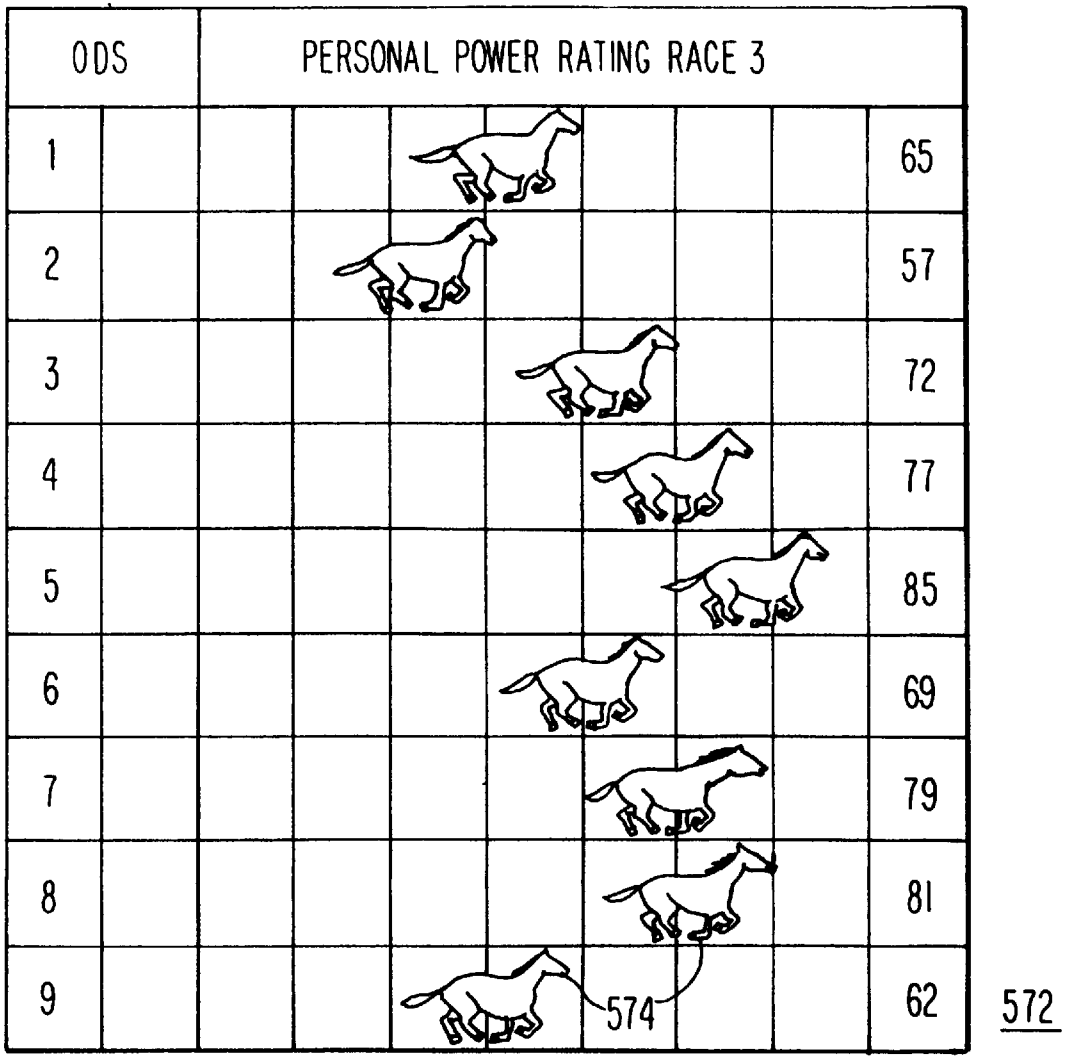

After all weights have been entered, the personal power ratings are displayed at step 570 (FIG. 33). Any suitable display format may be used to display the ratings. For example, the ratings may be displayed numerically, using a bar graph, a pie chart or other graphical display. As shown in FIG. 47, one suitable display is horizontal graph 572. Runners are listed numerically on the left side of graph 572. The corresponding results of the personal power rating selections made in steps 562, 564, 566, and 568 (FIG. 33) are shown numerically on the right side of graph 572. Also shown—in the center of graph 572—are runner icons 574, each horizontally located at a distance from the left edge of graph 572 that is representative of the numerical personal power rating result. After the personal power ratings are displayed at step 570, the system returns to step 548 (when instructed by the user).

User terminal 370 (FIG. 30) performs the calculations necessary to determine the personal power ratings based on the racing data received from racing data interface 372 (FIG. 29) and the selected personal power rating weights. Any suitable method of calculating the power ratings may be used, such as multiplying the weights by a numerical value representative of the runner's strength in the respective categories. For example, in the speed category, the weight of 4 selected in FIG. 46 could be multiplied by the runner's percentile ranking in average speed in its most recent races. Alternatively, a predetermined speed power rating could be used. Although screen 552 (FIG. 46) depicts four personal power rating categories, any number of categories may be used, limited only by the amount of statistical racing data available from racing data interface 372 (FIG. 29).

Returning to FIG. 32, if the menu option "other" is selected at step 534, then the user is presented with menu options "racing simulcast schedule," "miscellaneous advertising," "help," and "questionnaire" at step 576. A schedule of which races are being video-simulcast is displayed if "racing simulcast schedule" is selected. Preferably, a user can select from the displayed list of simulcast races. When a particular race is selected from those displayed at step 576, user terminal 122 (FIG. 29) returns the user to step 448 at FIG. 31, where the user is provided with an opportunity to place a wager on the selected race.

If "miscellaneous advertising" is selected at step 576, advertising information is displayed. Help information is displayed if "help" is selected. Because user terminal 370 (FIG. 30) is capable of handling video signals, the advertising information that is provided at step 576 can contain video clips in addition to text information. For example, racing data interface 372 (FIG. 29), racing video source 374 (FIG. 29) or other suitable advertising source may transmit compressed video clips to user terminal 370 of FIG. 30, where they are stored on local mass storage device 578 (FIG. 3) (e.g., a hard disk drive). When advertising, help, or any other information is selected that would benefit from a video presentation, the compressed video signal stored on local mass storage device 578 (FIG. 30) is played back using display and processing circuitry 416 (FIG. 30).

Another menu option that may be selected at step 576 (FIG. 32) is "questionnaire." When this selection is made, user terminals 122 provide an interactive questionnaire on the monitor 378, to which the user may respond, if interested. A typical use for such questionnaires would be to facilitate user feedback. For example, questionnaires may be provided that ask the user which particular services of wagering system 366 (FIG. 1) are of greatest interest, etc. When the questionnaire is completed, the results of the questionnaires may be transmitted to subscriber facility 400 (FIG. 29) using transaction data communications circuitry 422 (FIG. 30.) and communication line 402 (FIG. 29).

Figure 48:
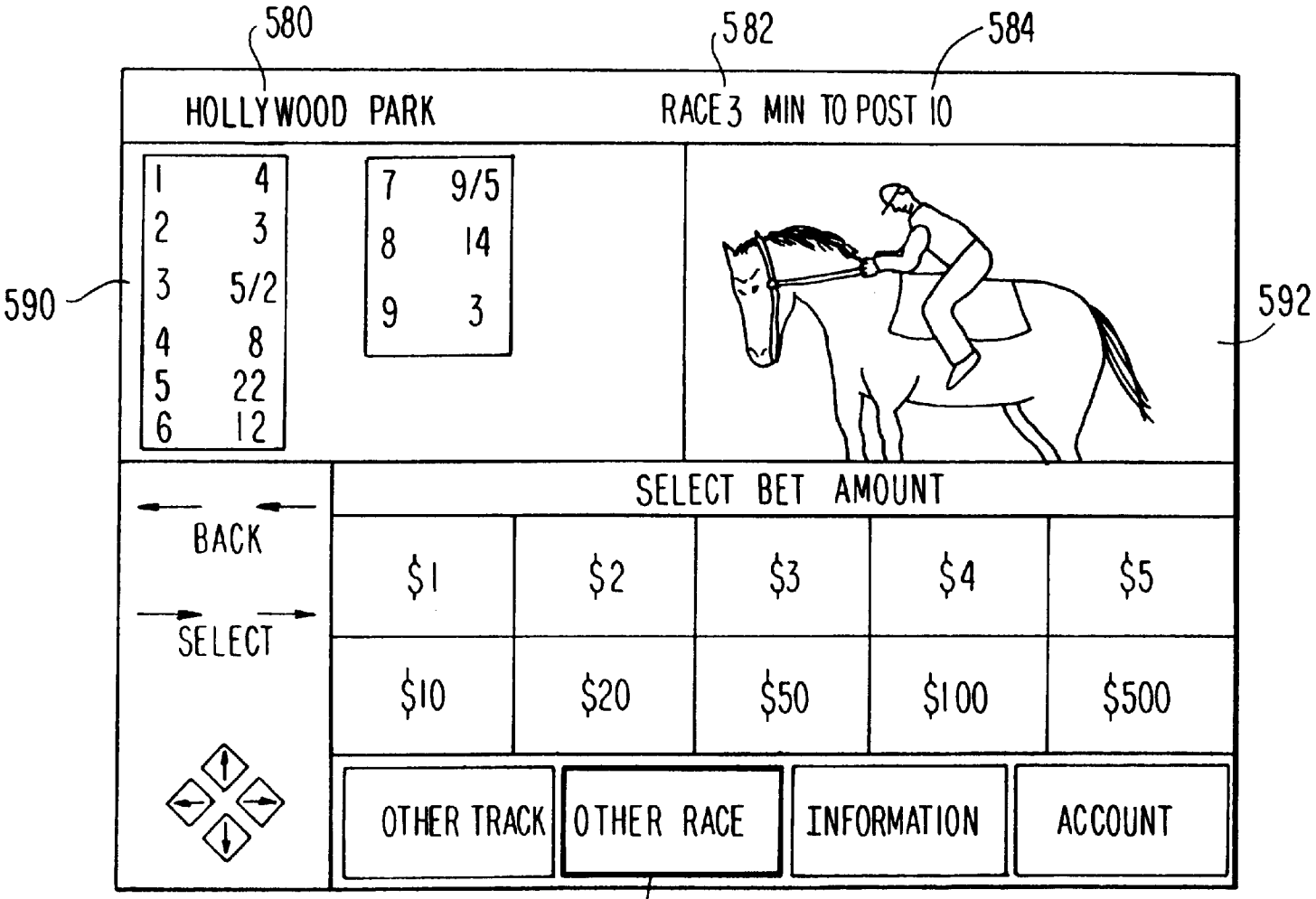

As described above, a "menu choice" option at step 514 (FIG. 32) is "other track." The selection of another racetrack is illustrated in FIG. 48, in which the racetrack Hollywood Park has been selected. When a new racetrack is selected, the previously selected racetrack 460 (e.g., Churchill Downs in FIG. 36) is replaced with the currently selected racetrack 580. In addition, the currently selected race 582 is automatically updated to reflect the next currently scheduled race to be run at the currently selected racetrack. As shown in FIG. 48, the next race scheduled at Hollywood Park is race 3. The time until post 584 is also automatically updated upon entering the screen 586 to correspond to the next currently scheduled race. Also automatically updated are odds 590 and racing video 592.

If it is desired to change to another race from a screen such as screen 586, which displays the menu choices "other track," "other race," "information," and "account," the user highlights portion 594 of screen 586 corresponding to menu option "other race" at step 514 (FIG. 32). Selecting "other race" at step 514 (FIG. 32) takes the user to step 596 in FIG. 34. A suitable screen for displaying the menu options available at step 596 is screen 598, shown in FIG. 49.

Figure 49:
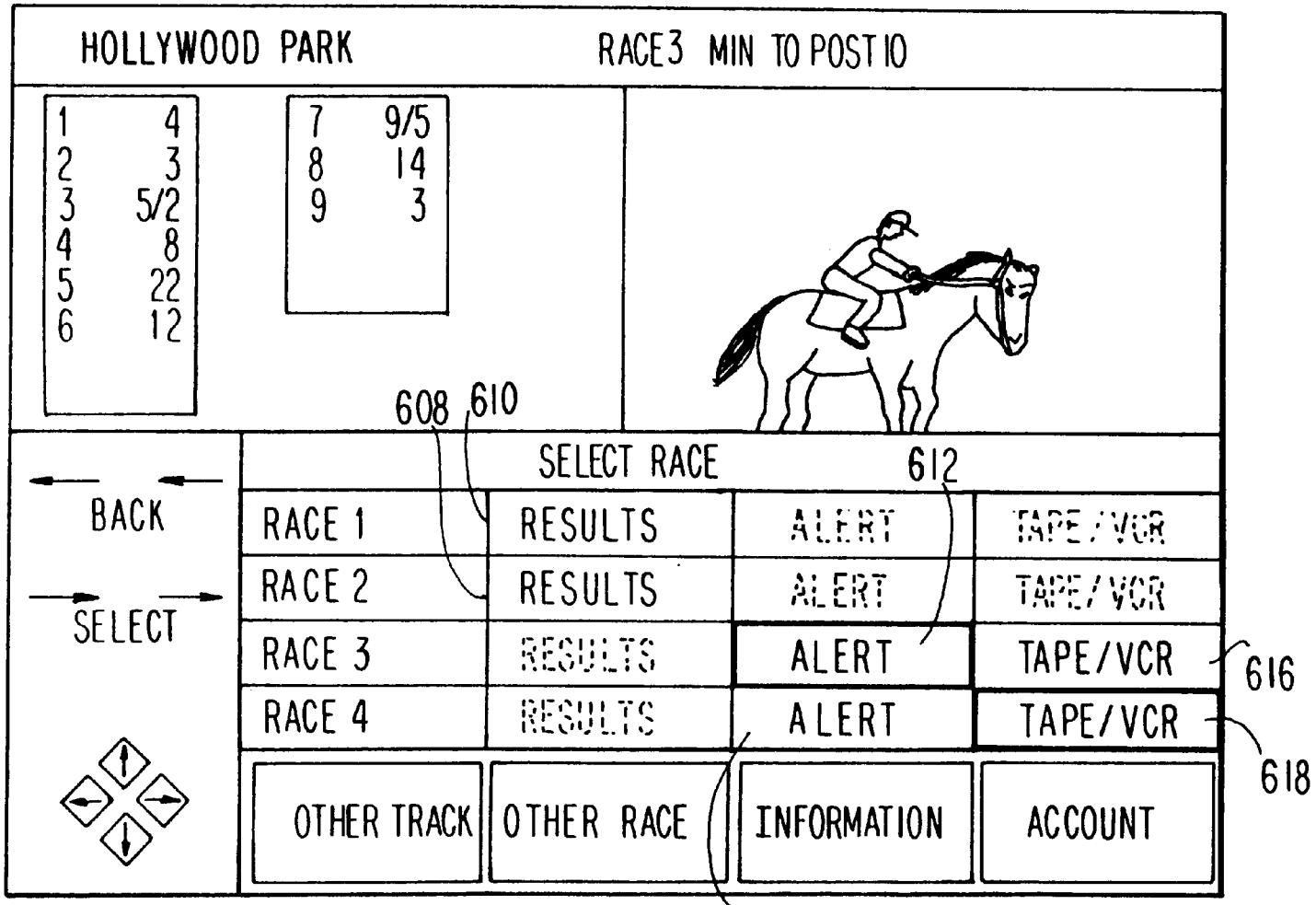
Figure 50:
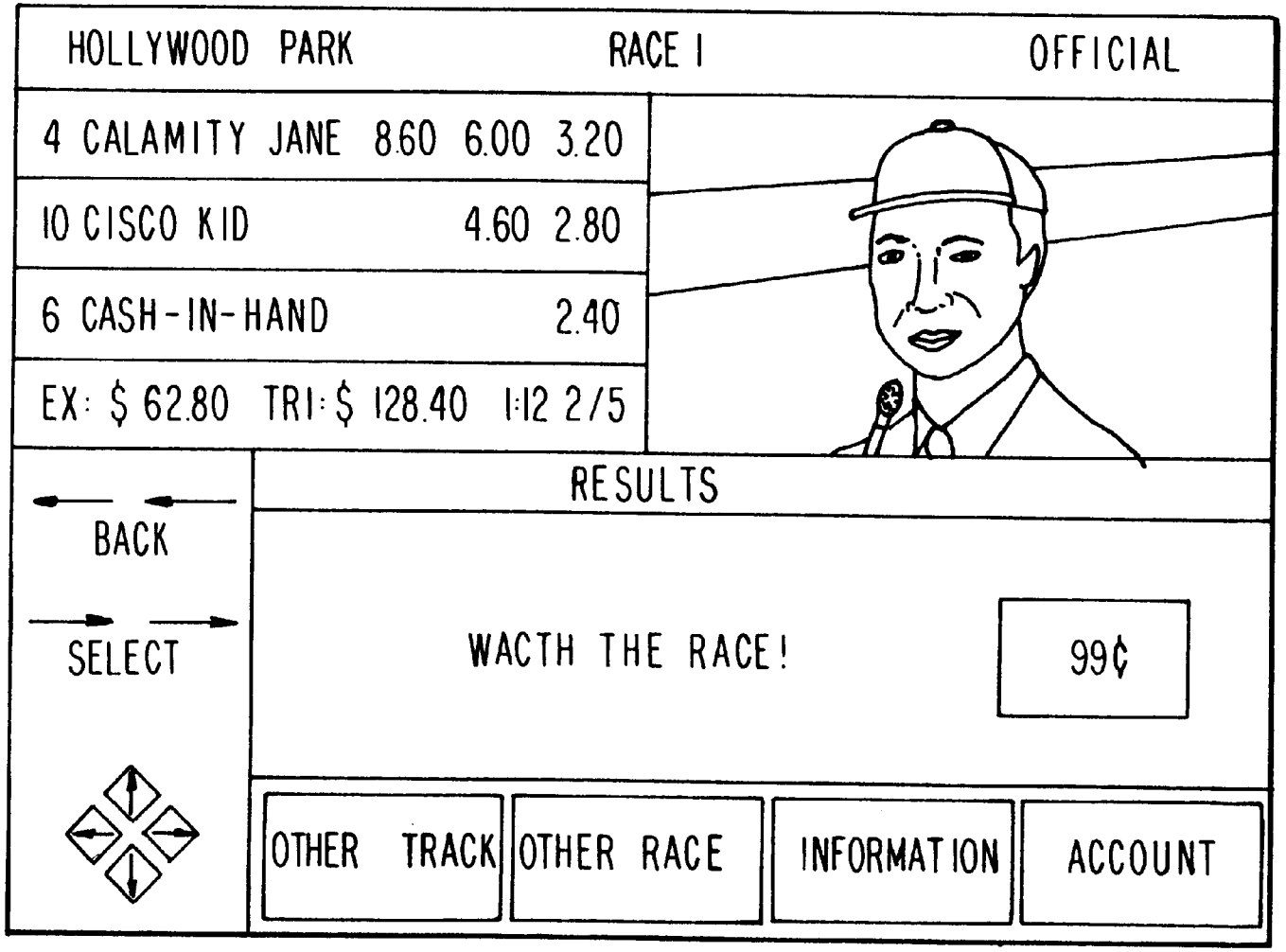

As shown in FIG. 49, a number of viewing options are presented for each race, such as "results," "alert," and "tape/VCR." For races that have been run, the appropriate option is "results," which allows a user to watch an earlier race. If the user selects "results" at step 596 of FIG. 34, the user is presented with the menu option "watch the race" at step 600. A suitable screen for presenting this option to the user is screen 602 of FIG. 50. If the user decides to watch the race and makes the menu selection "watch the race" at step 600 (FIG. 34), a video of the race is displayed at step 602 (FIG. 34) and, if desired, the user may be billed a transaction fee for making this selection. Transaction fees may be levied using any suitable technique. For example, user terminal 370 can maintain a running log of transaction fees charged the user for making selections such as "watch the race," etc. Periodically, this log may be transferred to subscriber facility 400, which compiles a bill for the user, or which debits the user's account (at bank 412 or wagering data management facility 380). The user may also be charged transaction fees for each wager placed at wagering data management facility 380. This type of transaction fee is preferably levied at the time at which the wager is placed, e.g., by debiting the user's account (at wagering data management facility 380 or bank 412) by the transaction fee in addition to the wager amount.

In order to allow the user to watch the results of previously run races, video clips of the races must be stored in a suitable facility and delivered to the user on demand. A variety of arrangements for accomplishing this task are possible. For example, as shown in FIG. 29, a user may place an order for a race video from user terminal 370 via communication line 390. The order is received by transaction data interface 394, which transmits the order and any necessary account verification information to wagering data management system 380. Race video order information can be transmitted to video and data distribution system 368 from wagering data management facility 380 via communication link 398. If it is desired to impose a charge for ordering videos of race results, wagering data management system 380 can debit the user's account accordingly when the order is received.

Video and data distribution system 368 can contain a high capacity storage medium, suitable for recording races as they are received from racing video source 374. In order to minimize the amount of storage necessary in video and data distribution system, it may be desired to record only the video of the race, and not any race previews. It may also be desired to digitally compress the videos.

Various approaches may be used for delivering the race videos that are stored at video and data distribution system 368 to user terminal 370. For example, the sideband or other portion of the bandwidth used by the wagering system 366 to deliver racing data to user terminals 370 may be sufficiently large to support the delivery of compressed video clips in addition to the racing data. If a compressed video clip contains encoded information, only authorized users who selected to watch the race results video will receive that video clip. A similar approach is to send the requested video information over an available video channel to authorized users. A pay-per-view cable channel is also a suitable pathway for providing racing videos to user terminal 370.

Regardless of how user terminal 370 receives the requested prerecorded race video clip, at step 602 (FIG. 34), user terminal 370 displays the video on monitor 378. If necessary, user terminal 370 decompresses any compressed video information.

Figure 34:
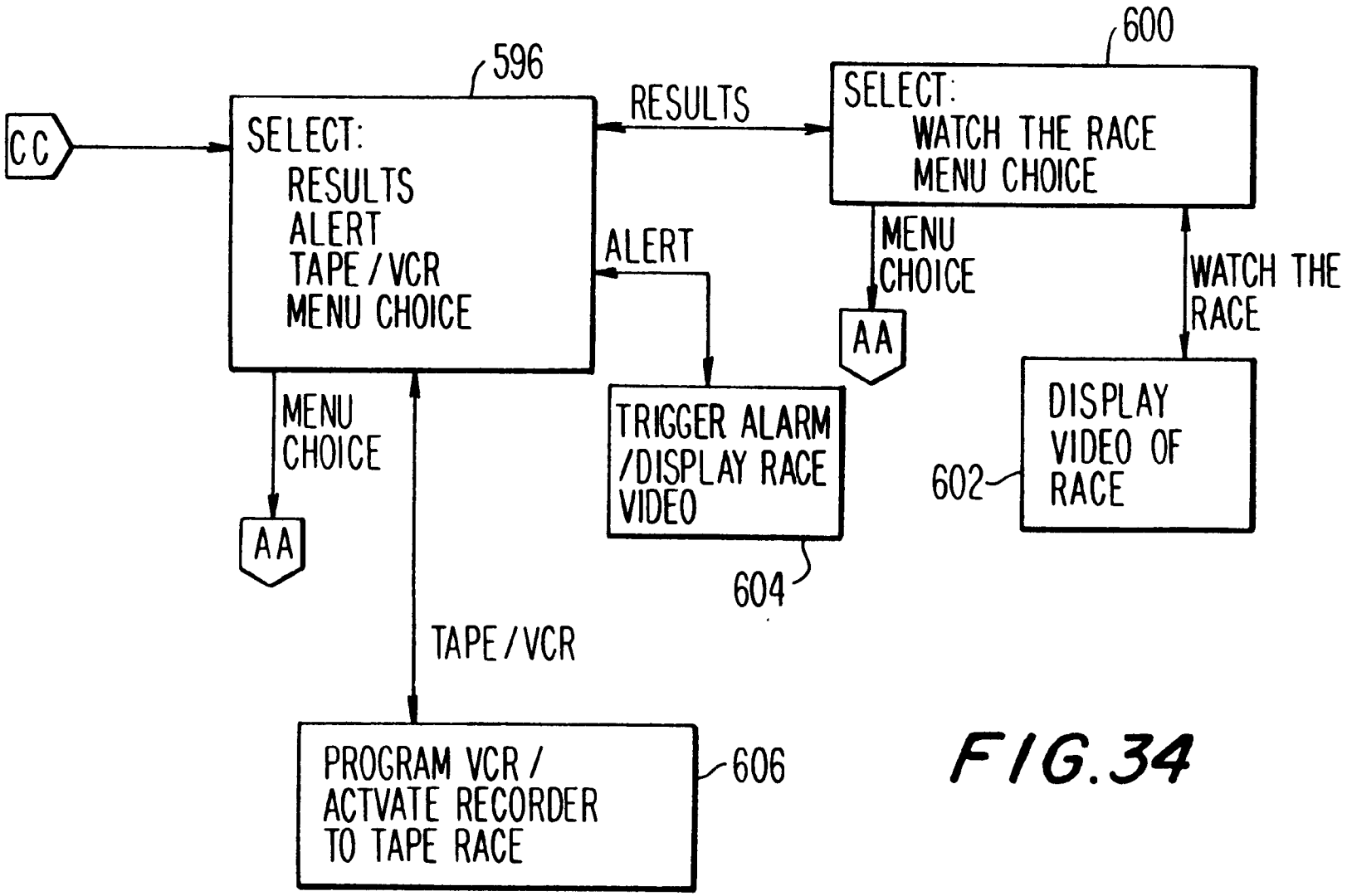

Different options are available for races that have not yet been run. For example, the user can select "alert" at step 596 (FIG. 34) to be alerted (e.g., by an audible tone and/or a visual prompt on the display screen) that the race is about to be run. If alert is selected at step 596 (FIG. 34), user terminal 370 (FIG. 30) triggers an alarm and displays the race video when appropriate at step 604 (FIG. 34). The user can also select "tape/VCR" at step 596 (FIG. 34). If "tape/VCR" is selected at step 596 (FIG. 34), at step 606 (FIG. 34) user terminal 370 (FIG. 30) programs video recorder 424 (FIG. 30) with the appropriate recording information or actuates video recorder 424 (FIG. 30) at the time of the selected race. Thus, selecting "tape/VCR" allows the selected race to be recorded. When desired, the user can review the race videos recorded by video recorder 424 (FIG. 30). If video recorder 424 (FIG. 30) is capable of transmitting data such as indexing data to user terminal 370 (FIG. 30), user terminal 370 (FIG. 30) can coordinate the playback of race videos.

Any suitable display can be used to present the user with the menu options of step 596 (FIG. 34). In the example of screen 598, the options available for each race appear in bold type, whereas unavailable options appear only faintly. For example, race 1 and race 2 have already been run. Accordingly, results 608 and 610 appear in bold type. Races 3 and 4 have not yet been run so alerts 612 and 614 and tape/VCR 616 and 618 appear in bold.

One skilled in the art will appreciate that the present invention may be practiced by other than the described embodiments, which are presented for purposes of illustration and not of limitation, and the present invention is limited only by the claims that follow.

What is claimed is:

1. A method of using an off-track wagering system to interactively wager on races, comprising:

providing a user with an opportunity to place a wager on a given race that has not been run using a user terminal, wherein the given race is subsequently recorded to create a race video clip;

providing the user with an opportunity to request the race video clip with the user terminal;

displaying the requested race video clip on a monitor connected to the user terminal in response to a request for that race video clip by the user.

2. The method of claim 1 further comprising recording the race video clips with a video and data distribution system.

3. The method of claim 2 further comprising sending requests for race video clips to the video and data distribution system.

4. The method of claim 1 further comprising:

presenting the user with an opportunity to view videos of live races in real time or prerecorded race video clips; and displaying videos of live races on the monitor in real time when requested by the user.

5. The method of claim 4 further comprising using the user terminal to set a video recorder to record a preselected race.

6. The method of claim 1 further comprising displaying racing data corresponding to the displayed race video clip on the monitor connected to the user terminal.

7. The method of claim 6 further comprising:

using a cable headend facility to provide racing data corresponding to the displayed video clip to the user terminal.

8. The method of claim 7 further comprising displaying the racing data on the monitor with the displayed racing video clip.

9. The method of claim 8 further comprising displaying advertising with the racing video clip and racing data.

10. The method of claim 7 further comprising transmitting the racing data to the user terminal on a sideband.

11. The method of claim 1 further comprising transmitting and receiving transaction data related to the wager over a telephone network.

12. The method of claim 1 further comprising levying a transaction fee when the user requests the race video clip.

13. The method of claim 1 further comprising using a cable headend facility to provide the racing video clips to the user terminal.

14. The method of claim 1 further comprising using as the monitor a television set having a tuner for tuning to a desired television channel.

15. The method of claim 1 further comprising presenting advertising on the monitor.

16. The method of claim 1 further comprising receiving the wager data with a totalisator.

17. The method of claim 1 further comprising levying a transaction fee when the user places the wager.

18. The method of claim 1 further comprising using the user terminal to set a video recorder to record a preselected race.

19. An off-track wagering system for interactively wagering on races comprising:

means for providing a user with an opportunity to place a wager on a given race that has not been run using a user terminal, wherein the given race is subsequently recorded to create a race video clip;

means for providing the user with an opportunity to request the race video clip with the user terminal; and means for displaying the requested race video clip on a monitor connected to the user terminal in response to a request for that race video clip by the user.

20. The system of claim 19 further comprising means for recording the race video clips with a video and data distribution system.

21. The system of claim 20 further comprising means for sending requests for race video clips to the video and data distribution system.

22. The system of claim 20 further comprising:

means for presenting the user with an opportunity to view videos of live races in real time or prerecorded racing video clips; and means for displaying videos of live races on the monitor in real time when requested by the user.

23. The system of claim 22 further comprising means for using the user terminal to set a video recorder to record a preselected race.

24. The system of claim 20 further comprising means for displaying racing data corresponding to the displayed race video clip on the monitor connected to the user terminal.

25. The system of claim 24 further comprising:

means for receiving the racing data with a cable headend facility; and means for providing the racing data from the cable headend facility to the user terminal.

26. The system of claim 25 further comprising means for displaying the racing data on the monitor with the displayed race video clip.

27. The system of claim 26 further comprising means for displaying advertising with the race video clip and racing data.

28. The system of claim 25 further comprising means for transmitting the racing data to the user terminal on a sideband.

29. The system of claim 19 further comprising means for transmitting and receiving transaction data related to the wager over a telephone network.

30. The system of claim 19 further comprising means for levying a transaction fee when the user requests the race video clip.

31. The system of claim 19 further comprising means for providing the race video clip to the user terminal with a cable headend facility.

32. The system of claim 19 further comprising means for using as the monitor a television set having a tuner for tuning to a desired television channel.

33. The system of claim 19 further comprising means for presenting advertising on the monitor.

34. The system of claim 19 further comprising means for receiving the wager data with a totalisator.

35. The system of claim 19 further comprising means for levying a transaction fee when the user places the wager.

36. The system of claim 19 further comprising means for using the user terminal to set a video recorder to record a preselected race.

37. An off-track wagering system for interactively wagering on races, comprising:

a user terminal configured to provide a user with an opportunity to place a wager on a given race that has not been run, wherein the given race is subsequently recorded to create a race video clip and wherein the user terminal is further configured to provide the user with an opportunity to request the race video clip;

a video and data distribution facility configured to allow the requested race video clip to be provided to the user terminal in response to a request for that race video clip by the user; and a monitor on which the requested race video clip is displayed.

38. The system of claim 37 further comprising a communication line to send requests for racing video clips to the video and data distribution facility.

39. The system of claim 37 wherein the video and data distribution facility is further configured to allow videos of live races to be provided in real time to the user terminal when requested by the user and wherein the user terminal is further configured to:

present the user with an opportunity to view videos of live races in real time or prerecorded racing video clips; and display on a monitor the requested videos of live races.

40. The system of claim 39 further comprising a video recorder that is set by the user terminal to record a race.

41. The system of claim 37 wherein the video and data distribution facility is further configured to allow racing data corresponding to the race video clip displayed on the monitor to be provided to the user terminal.

42. The system of claim 41 wherein the video and data distribution system includes a cable headend facility, the system further comprising a video and data link, wherein the cable headend facility is configured to allow the racing data to be provided to the user terminal using the video and data link.

43. The system of claim 42 wherein the user terminal is configured to display the racing data on the monitor with the displayed race video clip.

44. The system of claim 43 wherein the user terminal is configured to display advertising with the race video clip and racing data on the monitor.

45. The system of claim 42 wherein the cable headend facility is configured to transmit the racing data to the user terminal on a sideband.

46. The system of claim 37 further comprising a telephone network for transmitting and receiving transaction data related to the wager.

47. The system of claim 37 wherein the user terminal is configured to levy a transaction fee when the user requests the race video clip.

48. The system of claim 37 wherein the video and data distribution facility includes a cable headend facility and wherein the cable headend facility is configured to allow the race video clip to be provided to the user terminal.

49. The system of claim 37 wherein the monitor comprises a television set having a tuner for tuning to a desired television channel.

50. The system of claim 37 wherein the user terminal is configured to provide advertising on the monitor.

51. The system of claim 37 further comprising a totalisator for receiving the wager data.

52. The system of claim 37 wherein the user terminal is configured to levy a transaction fee when the user places the wager.

53. The system of claim 37 wherein the user terminal is further configured to set a video recorder to record a race.

54. The method of claim 1 further comprising transmitting and receiving transaction data related to the wager over a cable connected to the user terminal.

55. The system of claim 19 further comprising means for transmitting and receiving transaction data related to the wager over a cable connected to the user terminal.

56. The system of claim 37 further comprising a cable connected to the user terminal over which transaction data related to the wager is transmitted and received.

57. An off-track wagering system for interactively wagering on races that are recorded to create race video clips, comprising:

a user terminal programmed to provide a user with an opportunity to place a wager on a given race that has not been run, wherein the given race is subsequently recorded to create a video clip and wherein the user terminal is further programmed to provide the user with an opportunity to request the race video clip;

a video and data distribution facility including a cable headend facility that is configured to allow the requested race video clip to be provided to the user terminal in response to a request for that race video clip by the user; and a monitor connected to the user terminal on which the requested race video clip is displayed.

58. An off-track wagering system for interactively wagering on races that are recorded to create race video clips that are delivered to a user for viewing, comprising:

a user terminal configured to provide the user with an opportunity to place a wager on a given race that has not been run, wherein the given race is subsequently recorded to create a race video clip and wherein the user terminal is further configured to provide the user with an opportunity to request the race video clip; and a monitor connected to the user terminal on which the requested race video clip is displayed.

59. A method for interactive wagering on races using an off-track user terminal, comprising:

allowing a user at a user terminal that is connected to a cable headend facility by a cable path to use the cable path when accessing racing data from a wagering facility on races that have not been run and for which wagers may be placed;

displaying information on available tracks on which wagers may be placed to the user on a monitor connected to the user terminal;

displaying information on available races that have not yet been run to the user on the monitor connected to the user terminal;

allowing the user to use the user terminal connected to the cable headend facility to select a desired track for placing a wager;

allowing the user to use the user terminal connected to the cable headend facility to select a desired race that has not been run for placing the wager; and allowing the user to use the user terminal connected to the cable headend facility to place the wager on the selected race that has not been run at the selected track by transmitting wager data to a wagering facility at least partially using the cable path connected to the cable headend facility.

* * * * *

UNITED STATES PATENT AND TRADEMARK OFFICE

CERTIFICATE OF CORRECTION

PATENT NO. : 6,004,211
DATED : December 21, 1999
INVENTOR(S) : Mark A. Brenner et al.

It is certified that error appears in the above-identified patent and that said Letters Patent is hereby corrected as shown below:

Column 1,
Line 37, change “twoway” to -- two-way --;

Column 2,
Line 3, change ““twin”” to -- “win” --;

Column 11,
Line 45, change “additional tem” to -- additional item --;

Column 21,
Line 2, change “Circuitry” to -- circuitry --;
Line 43, change “Processed” to -- processed --.

Signed and Sealed this

Sixteenth Day of July, 2002

*Attest:*

*Attesting Officer*

JAMES E. ROGAN
*Director of the United States Patent and Trademark Office*